US009747756B2

(12) United States Patent
Yamauchi et al.

(10) Patent No.: US 9,747,756 B2
(45) Date of Patent: Aug. 29, 2017

(54) GAMING MACHINE AND CONTROL METHOD THEREOF

(71) Applicants: Universal Entertainment Corporation, Tokyo (JP); Aruze Gaming America, Inc., Las Vegas, NV (US)

(72) Inventors: Hiromoto Yamauchi, Tokyo (JP); Hiroki Nakamura, Tokyo (JP); Masumi Fujisawa, Tokyo (JP); Hideko Aoki, Tokyo (JP); Toshitaka Suzuki, Tokyo (JP); Takehisa Itagaki, Tokyo (JP); Yoichi Kato, Tokyo (JP); Yukihiro Kawakami, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 84 days.

(21) Appl. No.: 14/255,034

(22) Filed: Apr. 17, 2014

(65) Prior Publication Data

US 2014/0323201 A1 Oct. 30, 2014

(30) Foreign Application Priority Data

Apr. 24, 2013 (JP) ..... 2013-091804
Jul. 9, 2013 (JP) ..... 2013-143618

(51) Int. Cl.
*G07F 17/34* (2006.01)
*G07F 17/32* (2006.01)

(52) U.S. Cl.
CPC ..... *G07F 17/34* (2013.01); *G07F 17/3267* (2013.01)

(58) Field of Classification Search
None
See application file for complete search history.

(56) References Cited

U.S. PATENT DOCUMENTS

2001/0048193 A1* 12/2001 Yoseloff ..... G07F 17/32 273/138.1
2003/0040355 A1* 2/2003 Baerlocher ..... G07F 17/32 463/20
2009/0061985 A1* 3/2009 Inamura ..... G07F 17/34 463/20
2009/0104973 A1 4/2009 Kato
2009/0239608 A1* 9/2009 Tsukahara ..... G07F 17/3244 463/20
2011/0250947 A1 10/2011 Okamoto
2012/0309487 A1* 12/2012 Yoshikawa ..... G07F 17/3267 463/20
2013/0217467 A1* 8/2013 Fujisawa ..... G07F 17/34 463/20

* cited by examiner

*Primary Examiner* — Jay Liddle
*Assistant Examiner* — Alex F. R. P. Rada, II
(74) *Attorney, Agent, or Firm* — Lex IP Meister, PLLC

(57) ABSTRACT

As a normal game, symbols to be rearranged on a lower image display panel 141 are randomly determined, and the determined symbols are rearranged. When the combination of the rearranged symbols achieves bonus trigger, how many bonus symbol 167 is included in the symbols achieving the bonus trigger is included is determined. For the number of times corresponding the determined number of the bonus symbol 167, random determination is executed based on the bonus game number random determination table 192. The total sum of the numbers of times of execution of the free game having been awarded is awarded as the number of times of execution of the free game.

17 Claims, 60 Drawing Sheets

FIG.6

| | FIRST VIDEO REEL | SECOND VIDEO REEL | THIRD VIDEO REEL | FOURTH VIDEO REEL | FIFTH VIDEO REEL |
|---|---|---|---|---|---|
| CODE NO. | SYMBOL | SYMBOL | SYMBOL | SYMBOL | SYMBOL |
| 00 | CURRENCY | DRESS | EMPEROR | A | Q |
| 01 | BOX SYMBOL | BOX SYMBOL | BOX SYMBOL | BOX SYMBOL | BOX SYMBOL |
| 02 | BOX SYMBOL | BOX SYMBOL | BOX SYMBOL | BOX SYMBOL | BOX SYMBOL |
| 03 | BOX SYMBOL | BOX SYMBOL | BOX SYMBOL | BOX SYMBOL | BOX SYMBOL |
| 04 | BOX SYMBOL | BOX SYMBOL | BOX SYMBOL | BOX SYMBOL | BOX SYMBOL |
| 05 | 10 | CASTLE | DRAGON | EMPEROR | WILD |
| 06 | BOX SYMBOL | 9 | BOX SYMBOL | 9 | WILD |
| 07 | EMPEROR | CURRENCY | CASTLE | DRESS | DRAGON |
| 08 | 10 | EMPEROR | DRESS | J | J |
| 09 | J | Q | WILD | A | DRESS |
| 10 | CASTLE | DRESS | 9 | DRAGON | A |
| 11 | 9 | BOX SYMBOL | Q | BOX SYMBOL | EMPEROR |
| 12 | J | CASTLE | CURRENCY | DRESS | 10 |
| 13 | DRAGON | A | A | CASTLE | Q |
| 14 | BONUS | CURRENCY | BONUS | CURRENCY | CASTLE |
| 15 | A | BONUS | 10 | BONUS | Q |
| 16 | WILD | CURRENCY | A | 10 | CURRENCY |
| 17 | Q | 10 | CURRENCY | Q | BOX SYMBOL |
| 18 | DRESS | DRAGON | 9 | J | DRESS |
| 19 | CURRENCY | Q | 10 | WILD | CURRENCY |
| 20 | CASTLE | J | Q | Q | 9 |
| 21 | Q | J | J | CURRENCY | EMPEROR |

FIG.9

191

| SYMBOL | 3 SYMBOLS | 4 SYMBOLS | 5 SYMBOLS |
|---|---|---|---|
| J | 10 | 20 | 100 |
| Q | 10 | 20 | 100 |
| 9 | 10 | 20 | 100 |
| A | 10 | 20 | 100 |
| 10 | 20 | 50 | 200 |
| CURRENCY | 20 | 50 | 200 |
| DRESS | 20 | 50 | 200 |
| DRAGON | 30 | 60 | 300 |
| CASTLE | 30 | 100 | 400 |
| EMPEROR | 40 | 150 | 500 |
| WILD | 50 | 200 | 1000 |
| BONUS | BONUS GAME(※) | | |

(※) BONUS GAME IS AWARDED WHEN AT LEAST ONE BONUS SYMBOL IS REARRANGED IN EACH OF FIRST, SECOND, AND THIRD VIDEO REELS

FIG.10

192

| NUMBER OF BONUS SIMBOLS / OBTAINED NUMBER OF TIMES OF EXECUTION OF FREE GAME | 3 SYMBOLS | 4 SYMBOLS | 5 SYMBOLS | 6 SYMBOLS | 7 SYMBOLS | 8 SYMBOLS | 9 SYMBOLS | 10 SYMBOLS | 11 SYMBOLS | 12 SYMBOLS | 13 SYMBOLS | 14 SYMBOLS | 15 SYMBOLS |
|---|---|---|---|---|---|---|---|---|---|---|---|---|---|
| | Very_Low | | | Low | | | Middle | | High | | Very_High | | EXTRA |
| 3 | 50/100 | | | 40/100 | | | 10/100 | | 5/100 | | 5/100 | | 2/100 |
| 6 | 30/100 | | | 30/100 | | | 20/100 | | 5/100 | | 5/100 | | 3/100 |
| 9 | 10/100 | | | 10/100 | | | 20/100 | | 10/100 | | 5/100 | | 5/100 |
| 12 | 7/100 | | | 12/100 | | | 20/100 | | 30/100 | | 20/100 | | 20/100 |
| 15 | 2/100 | | | 5/100 | | | 20/100 | | 20/100 | | 25/100 | | 20/100 |
| 30 | 1/100 | | | 3/100 | | | 10/100 | | 30/100 | | 40/100 | | 50/100 |
| TOTAL | 100/100 | | | 100/100 | | | 100/100 | | 100/100 | | 100/100 | | 100/100 |

FIG.11

193

| NO | PAYOUTS | WINNING PROBABILITIES |
|---|---|---|
| 201A | 10 | 10/71 |
| 201B | 80 | 4/71 |
| 201C | 20 | 10/71 |
| 201D | 90 | 3/71 |
| 201E | 30 | 10/71 |
| 201F | 70 | 4/71 |
| 201G | 40 | 10/71 |
| 201H | 60 | 6/71 |
| 201I | 100 | 5/71 |
| 201J | 50 | 9/71 |
| | TOTAL | 71/71 |

FIG.38

290

(LEVEL SETTING TABLE)

| NUMBER OF BONUS SYMBOLS | 3 SYMBOLS | 4 SYMBOLS | 5 SYMBOLS | 6 SYMBOLS | 7 SYMBOLS | 8 SYMBOLS - 19 SYMBOLS | 20 SYMBOLS |
|---|---|---|---|---|---|---|---|
| Level | EXTRA | Very_High | High | Middle | Low | Very_Low | EXTRA |

FIG.39

291

(TABLE A)

| OBTAINED NUMBER OF TIMES OF EXECUTION OF FREE GAME \ Level | Very_Low | Low | Middle | High | Very_High | EXTRA |
|---|---|---|---|---|---|---|
| 1 | 750/1000 | 60/100 | 50/100 | 40/100 | 20/100 | 20/100 |
| 2 | 210/1000 | 33/100 | 30/100 | 32/100 | 50/100 | 30/100 |
| 3 | 30/1000 | 4/100 | 10/100 | 20/100 | 20/100 | 20/100 |
| 5 | 8/1000 | 1/100 | 8/100 | 5/100 | 7/100 | 20/100 |
| 7 | 1/1000 | 1/100 | 1/100 | 2/100 | 2/100 | 5/100 |
| 10 | 1/1000 | 1/100 | 1/100 | 1/100 | 1/100 | 5/100 |
| TOTAL | 1000/1000 | 100/100 | 100/100 | 100/100 | 100/100 | 100/100 |

FIG.40

292

(TABLE B)

| OBTAINED NUMBER OF TIMES OF EXECUTION OF FREE GAME \ Level | Very_Low | Low | Middle | High | Very_High | EXTRA |
|---|---|---|---|---|---|---|
| 1 | 40/100 | 30/100 | 30/100 | 30/100 | 30/100 | 15/100 |
| 2 | 30/100 | 35/100 | 35/100 | 35/100 | 35/100 | 20/100 |
| 3 | 20/100 | 22/100 | 22/100 | 22/100 | 22/100 | 30/100 |
| 5 | 7/100 | 10/100 | 10/100 | 10/100 | 10/100 | 20/100 |
| 7 | 2/100 | 2/100 | 2/100 | 2/100 | 2/100 | 10/100 |
| 10 | 1/100 | 1/100 | 1/100 | 1/100 | 1/100 | 5/100 |
| TOTAL | 100/100 | 100/100 | 100/100 | 100/100 | 100/100 | 100/100 |

FIG.41

294

(TABLE C)

| OBTAINED NUMBER OF TIMES OF EXECUTION OF FREE GAME \ Level | Very_Low | Low | Middle | High | Very_High | EXTRA |
|---|---|---|---|---|---|---|
| 1 | 15/100 | 10/100 | 10/100 | 10/100 | 10/100 | 2/100 |
| 2 | 25/100 | 20/100 | 20/100 | 20/100 | 20/100 | 2/100 |
| 3 | 20/100 | 30/100 | 30/100 | 30/100 | 30/100 | 2/100 |
| 5 | 20/100 | 20/100 | 20/100 | 20/100 | 20/100 | 2/100 |
| 7 | 10/100 | 10/100 | 10/100 | 10/100 | 10/100 | 2/100 |
| 10 | 10/100 | 10/100 | 10/100 | 10/100 | 10/100 | 90/100 |
| TOTAL | 100/100 | 100/100 | 100/100 | 100/100 | 100/100 | 100/100 |

FIG.42

294

| TABLE | WEIGHT |
|---|---|
| TABLE A | 1/3 |
| TABLE B | 1/3 |
| TABLE C | 1/3 |
| TOTAL | 3/3 |

FIG.57A

| | FIRST VIDEO REEL | SECOND VIDEO REEL | THIRD VIDEO REEL | FOURTH VIDEO REEL | FIFTH VIDEO REEL |
|---|---|---|---|---|---|
| 0 | RED | BLUE | GREEN | PINK | BLACK |
| 1 | RED | BLUE | GREEN | PINK | BLACK |
| 2 | RED | BLUE | GREEN | PINK | BLACK |
| 3 | RED | BLUE | GREEN | PINK | BLACK |
| 4 | BLUE | PINK | RED | GREEN | RED |
| 5 | BLUE | PINK | RED | GREEN | RED |
| 6 | BLUE | PINK | RED | GREEN | RED |
| 7 | BLUE | PINK | RED | GREEN | RED |
| 8 | PINK | GREEN | BLUE | RED | BLUE |
| 9 | PINK | GREEN | BLUE | RED | BLUE |
| 10 | PINK | GREEN | BLUE | RED | BLUE |
| 11 | PINK | GREEN | BLUE | RED | BLUE |
| 12 | GREEN | RED | PINK | BLUE | PINK |
| 13 | GREEN | RED | PINK | BLUE | PINK |
| 14 | GREEN | RED | PINK | BLUE | PINK |
| 15 | GREEN | RED | PINK | BLUE | PINK |
| ⋮ | ⋮ | ⋮ | ⋮ | ⋮ | ⋮ |
| 98 | BLACK | FEATURE | FEATURE | FEATURE | NINE |
| 99 | BLACK | FEATURE | FEATURE | FEATURE | FEATURE |
| 100 | | FEATURE | FEATURE | FEATURE | FEATURE |
| 101 | | FEATURE | FEATURE | FEATURE | FEATURE |
| 102 | | FEATURE | FEATURE | FEATURE | FEATURE |
| 103 | | FEATURE | FEATURE | FEATURE | FEATURE |
| 104 | | FEATURE | FEATURE | FEATURE | FEATURE |
| 105 | | FEATURE | FEATURE | FEATURE | FEATURE |
| 106 | | FEATURE | FEATURE | FEATURE | FEATURE |
| 107 | | FEATURE | FEATURE | FEATURE | FEATURE |
| 108 | | FEATURE | FEATURE | FEATURE | FEATURE |
| 109 | | FEATURE | FEATURE | FEATURE | FEATURE |
| 110 | | FEATURE | FEATURE | FEATURE | FEATURE |

FIG.57B

| | | | | | |
|---|---|---|---|---|---|
| 111 | | FEATURE | FEATURE | FEATURE | FEATURE |
| 112 | | FEATURE | FEATURE | FEATURE | FEATURE |
| 113 | | FEATURE | FEATURE | FEATURE | FEATURE |
| 114 | | FEATURE | FEATURE | FEATURE | FEATURE |
| 115 | | FEATURE | FEATURE | FEATURE | FEATURE |
| 116 | | ACE | FEATURE | FEATURE | FEATURE |
| 117 | | ACE | FEATURE | FEATURE | FEATURE |
| 118 | | ACE | JACK | QUEEN | FEATURE |
| 119 | | ACE | JACK | QUEEN | KING |
| 120 | | WILD | JACK | QUEEN | KING |
| 121 | | WILD | JACK | QUEEN | KING |
| 122 | | WILD | WILD | WILD | KING |
| 123 | | WILD | WILD | WILD | WILD |
| 124 | | BLACK | WILD | WILD | WILD |
| 125 | | BLACK | WILD | WILD | WILD |
| 126 | | BLACK | BLACK | BLACK | WILD |
| 127 | | BLACK | BLACK | BLACK | BLACK |
| 128 | | BLACK | BLACK | BLACK | BLACK |
| 129 | | BLACK | BLACK | BLACK | BLACK |
| 130 | | BLACK | BLACK | BLACK | BLACK |
| 131 | | BLACK | BLACK | BLACK | |
| 132 | | | BLACK | BLACK | |
| 133 | | | BLACK | BLACK | |
| 134 | | | | | |
| | 151 | 152 | 153 | 154 | 155 |

FIG.58A

| | FIRST VIDEO REEL | SECOND VIDEO REEL | THIRD VIDEO REEL | FOURTH VIDEO REEL | FIFTH VIDEO REEL |
|---|---|---|---|---|---|
| 0 | RED | BLUE | GREEN | PINK | WILD |
| 1 | RED | BLUE | GREEN | PINK | WILD |
| 2 | RED | BLUE | GREEN | PINK | WILD |
| 3 | RED | BLUE | GREEN | PINK | WILD |
| 4 | BLUE | PINK | RED | GREEN | RED |
| 5 | BLUE | PINK | RED | GREEN | RED |
| 6 | BLUE | PINK | RED | GREEN | RED |
| 7 | BLUE | PINK | RED | GREEN | RED |
| 8 | PINK | GREEN | BLUE | RED | BLUE |
| 9 | PINK | GREEN | BLUE | RED | BLUE |
| 10 | PINK | GREEN | BLUE | RED | BLUE |
| 11 | PINK | GREEN | BLUE | RED | BLUE |
| 12 | GREEN | RED | PINK | BLUE | PINK |
| 13 | GREEN | RED | PINK | BLUE | PINK |
| 14 | GREEN | RED | PINK | BLUE | PINK |
| 15 | GREEN | RED | PINK | BLUE | PINK |
| ⋮ | ⋮ | ⋮ | ⋮ | ⋮ | ⋮ |
| 98 | BLACK | FEATURE | FEATURE | FEATURE | FEATURE |
| 99 | BLACK | FEATURE | FEATURE | FEATURE | FEATURE |
| 100 | BLACK | FEATURE | FEATURE | FEATURE | FEATURE |
| 101 | BLACK | FEATURE | FEATURE | FEATURE | FEATURE |
| 102 | BLACK | FEATURE | FEATURE | FEATURE | FEATURE |
| 103 | BLACK | FEATURE | FEATURE | FEATURE | FEATURE |
| 104 | BLACK | ACE | FEATURE | FEATURE | FEATURE |
| 105 | BLACK | ACE | FEATURE | FEATURE | FEATURE |
| 106 | BLACK | ACE | JACK | QUEEN | FEATURE |
| 107 | BLACK | ACE | JACK | QUEEN | KING |
| 108 | BLACK | WILD | JACK | QUEEN | KING |
| 109 | BLACK | WILD | JACK | QUEEN | KING |
| 110 | | WILD | WILD | WILD | KING |
| 111 | | WILD | WILD | WILD | WILD |
| 112 | | BLACK | WILD | WILD | WILD |
| 113 | | BLACK | WILD | WILD | WILD |
| 114 | | BLACK | BLACK | BLACK | WILD |
| 115 | | BLACK | BLACK | BLACK | BLACK |

FIG.58B

| | | | | | |
|---|---|---|---|---|---|
| 116 | | BLACK | BLACK | BLACK | BLACK |
| 117 | | BLACK | BLACK | BLACK | BLACK |
| 118 | | BLACK | BLACK | BLACK | BLACK |
| 119 | | BLACK | BLACK | BLACK | BLACK |
| 120 | | BLACK | BLACK | BLACK | BLACK |
| 121 | | BLACK | BLACK | BLACK | BLACK |
| 122 | | BLACK | BLACK | BLACK | BLACK |
| 123 | | BLACK | BLACK | BLACK | BLACK |
| 124 | | BLACK | BLACK | BLACK | BLACK |
| 125 | | BLACK | BLACK | BLACK | BLACK |
| 126 | | BLACK | BLACK | BLACK | BLACK |
| 127 | | BLACK | BLACK | BLACK | BLACK |
| 128 | | BLACK | BLACK | BLACK | BLACK |
| 129 | | BLACK | BLACK | BLACK | BLACK |
| 130 | | BLACK | BLACK | BLACK | BLACK |
| 131 | | BLACK | BLACK | BLACK | BLACK |
| 132 | | BLACK | BLACK | BLACK | BLACK |
| 133 | | BLACK | BLACK | BLACK | BLACK |
| 134 | | BLACK | BLACK | BLACK | BLACK |
| 135 | | BLACK | BLACK | BLACK | BLACK |
| 136 | | BLACK | BLACK | BLACK | BLACK |
| 137 | | BLACK | BLACK | BLACK | BLACK |
| 138 | | WILD | BLACK | BLACK | BLACK |
| 139 | | WILD | BLACK | BLACK | BLACK |
| 140 | | WILD | WILD | WILD | BLACK |
| 141 | | WILD | WILD | WILD | |
| 142 | | | WILD | WILD | |
| 143 | | | WILD | WILD | |
| 144 | | | | | |
| | 151 | 152 | 153 | 154 | 155 |

FIG.59

| FIRST IDEO REEL | | SECOND VIDEO REEL | | THIRD VIDEO REEL | | FOURTH VIDEO REEL | | FIFTH VIDEO REEL | | |
|---|---|---|---|---|---|---|---|---|---|---|
| 105 | BLACK | 137 | BLACK | 139 | BLACK | 139 | BLACK | 136 | BLACK | |
| 106 | BLACK | 138 | WILD | 140 | WILD | 140 | WILD | 137 | BLACK | |
| 107 | BLACK | 139 | WILD | 141 | WILD | 141 | WILD | 138 | BLACK | |
| 108 | BLACK | 140 | WILD | 142 | WILD | 142 | WILD | 139 | BLACK | |
| 109 | BLACK | 141 | WILD | 143 | WILD | 143 | WILD | 140 | BLACK | |
| 0 | RED | 0 | BLUE | 0 | GREEN | 0 | PINK | 0 | WILD | ←「FROM 0」 |
| 1 | RED | 1 | BLUE | 1 | GREEN | 1 | PINK | 1 | WILD | |
| 2 | RED | 2 | BLUE | 2 | GREEN | 2 | PINK | 2 | WILD | ←「FROM 2」 |
| 3 | RED | 3 | BLUE | 3 | GREEN | 3 | PINK | 3 | WILD | |
| 4 | BLUE | 4 | PINK | 4 | RED | 4 | GREEN | 4 | RED | ←「FROM 4」 |
| 5 | BLUE | 5 | PINK | 5 | RED | 5 | GREEN | 5 | RED | |
| 6 | BLUE | 6 | PINK | 6 | RED | 6 | GREEN | 6 | RED | ←「FROM 6」 |
| 7 | BLUE | 7 | PINK | 7 | RED | 7 | GREEN | 7 | RED | |
| 8 | PINK | 8 | GREEN | 8 | BLUE | 8 | RED | 8 | BLUE | ←「FROM 8」 |
| 9 | PINK | 9 | GREEN | 9 | BLUE | 9 | RED | 9 | BLUE | |

FIG.60

389

| FIRST VIDEO REEL | SECOND VIDEO REEL | THIRD VIDEO REEL | FOURTH VIDEO REEL | FIFTH VIDEO REEL | WEIGHT |
|---|---|---|---|---|---|
| FROM 0 | FROM 0 | FROM 0 | FROM 0 | FROM 4 | 1/9 |
| FROM 2 | FROM 2 | FROM 2 | FROM 2 | FROM 6 | 1/9 |
| FROM 4 | FROM 4 | FROM 4 | FROM 4 | FROM 8 | 1/9 |
| NO REWRITING | NO REWRITING | NO REWRITING | NO REWRITING | NO REWRITING | 6/9 |
| | | | | | TOTAL 9/9 |

GAMING MACHINE AND CONTROL METHOD THEREOF

CROSS REFERENCE TO RELATED APPLICATION

The present application claims priority from Japanese Patent Application No. 2013-091804, which was filed on Apr. 24, 2013 and Japanese Patent Application No. 2013-143618, which was filed on Jul. 9, 2013, the disclosure of which is herein incorporated by reference in its entirety.

BACKGROUND OF THE INVENTION

The present invention relates to a gaming machine and a control method of the gaming machine.

An example of a known slot machine (gaming machine) is disclosed by Patent Literature 1 (U.S. Laid-Open Patent Application No. 2011/0250947). This slot machine operates in such a way that, when a player inserts a coin, bill or the like into an insertion slot of a slot machine and presses a spin button, symbols are scroll-displayed on a symbol display area provided on the front surface of a cabinet, and then the symbols are automatically stopped. Based on the state of the stopped symbols, various prizes such as a bonus are established.

Among such slot machines awarding a bonus or the like, there is a slot machine in which a plurality of types of bonuses are provided, and one of these bonuses is selected in response to a player's operation of an input device such as a button and the selected bonus is awarded (see e.g., Patent Literature 2 (U.S. Laid-Open Patent Application No. 2009/0104973)).

SUMMARY OF THE INVENTION

The player of the above-described slot machine (gaming machine) with a plurality of types of bonuses typically has a great interest in the contents and effects of the bonuses when playing games.

An object of the present invention is to provide a gaming machine providing new forms of bonus awarding as a novel entertainment feature, and a control method of the gaming machine.

The present invention relates to a gaming machine running a normal game and a bonus game developing from the normal game, the gaming machine including:

a symbol display device configured to display a result of a game by rearranging symbols;

a storage device configured to store a bonus game number random determination table in which the number of times of execution of the bonus game is associated with a random number; and a controller, the controller being programmed to execute the processes of:

(1A) as the normal game, randomly selecting the symbols which are to be rearranged on the symbol display device;

(1B) rearranging the symbols selected in the process (1A) on the display device and awarding a benefit in accordance with a combination of the rearranged symbols;

(1C) when the benefit awarded in the process (1B) is the right to run the bonus game, counting how many predetermined bonus symbol is included in the combination of the symbols with which the right to run the bonus game is awarded;

(1D) performing random determination based on the bonus game number random determination table for the number of times corresponding to the number of the predetermined bonus symbol counted in the process (1C); and (1E) as the number of times of execution of the bonus game, awarding the total number determined in the process (1D).

According to the arrangement above, in the normal game, when symbols are rearranged on the symbol display device and a benefit corresponding to the combination of the rearranged symbols is the right to run the bonus game, how many predetermined bonus symbol is included in the rearranged symbols is determined. The random determination is executed based on the bonus game number random determination table for the number of times corresponding to the number of the predetermined bonus symbol, and the number of times of execution of the bonus game is awarded to the player as a result of the random determination.

With this, when the right to run the bonus game is obtained, the player is interested in the number of the symbols to be rearranged, because, the more the predetermined bonus symbol is included in the combination of the rearranged symbols, the more the random determination of the number of times of execution of the bonus game is executed. Furthermore, because the random determination of the total number of times of execution of the bonus game is executed for the number of times corresponding to the number of the predetermined bonus symbol, the player enjoys the random determination for that number of times.

The gaming machine of the present invention is arranged so that, the bonus game number random determination table used in the process (1D) defines that a winning probability of the number of times of execution of the bonus game varies in accordance with the number of the bonus symbol counted in the (1C).

According to the arrangement above, in accordance with the number of the bonus symbols rearranged when the right to run the bonus game is obtained, the winning probability of the number of times of execution of the bonus game randomly determined based on the bonus game number random determination table is varied. For example, the more the bonus symbols are rearranged when the right to run the bonus game is obtained, the higher the winning probability is, i.e., the more the number of times of execution of the bonus game is, as a result of the random determination based on the bonus game number random determination table. As such, the more the number of the bonus symbols rearranged when the right to run the bonus game is obtained, the more the player is advantageous.

The gaming machine of the present invention is arranged so that, in the process (1D), a result of the random determination based on the bonus game number random determination table is notified each time the random determination is performed.

According to the arrangement above, a result of random determination of the number of times of execution of the bonus game based on the bonus game number random determination table is notified each time the random determination is executed.

With this, each time a result of the random determination is notified, the player pays attention to the awarded number of times of execution of the bonus game.

The gaming machine of the present invention is arranged so that, the controller is programmed to further execute the processes of:

(1F) as options, presenting the execution of the bonus game for the number of times awarded as a result of the random determination in the process (1D) and the execution of a one-time game with which the benefit is awarded as a result of random determination once; and (1G) executing the bonus game for the awarded number of times when the execution of the bonus game is chosen in the process (1F), or executing the one-time game when the execution of the one-time game is chosen in the process (1F).

This arrangement allows the player to select either the execution of the bonus game for the awarded number of times or the execution of the one-time game with which the benefit is awarded as a result of the random determination once.

With this arrangement, when, for example, the awarded total number of times of execution of the bonus game is large and it takes time to execute the bonus game for that number of times, the player may select the one-time game with which a benefit is awarded as a result of the random determination once, in order to shorten the time to run the bonus game for the awarded number of times.

The gaming machine of the present invention is arranged so that, an expectation value of the benefit awarded in the one-time game is equal to a value calculated by multiplying the expectation value of the benefit awarded as a result of running the bonus game once by the awarded number of times of execution of the bonus game.

According to the arrangement above, because the expectation value of the payout awarded when the one-time game is selected is arranged to be equal to a value calculated by multiplying the expectation value of the benefit awarded by executing the bonus game once by the awarded number of times of execution of the bonus game, the payout to be awarded is mathematically identical between the case where the bonus game is executed for the awarded number of times and the case where the one-time game is selected. With this, no matter whether the execution of the bonus game is selected or the execution of the one-time game is selected, the player enjoys the game with the same expectation of the payout.

The gaming machine of the present invention is arranged so that, in the process (1F), an estimated termination time which indicates when the execution of the free game for the awarded number of times ends is notified.

According to the arrangement above, the player is able to know an estimated termination time which indicates when the running of the bonus game for the awarded number of times ends. This allows the player to choose the execution of the bonus game for the awarded number of times or the execution of the one-time game, in consideration of the notified estimated termination time.

The gaming machine of the present invention is arranged so that, the symbol display device displays the result of the game by displaying the symbols on reels and rearranging these reels, in at least one of the normal game and the bonus game, a random symbol is arranged on at least one of the reels, and each time the normal game or the bonus game starts, a symbol displayed in the random symbol is randomly determined.

According to this arrangement, a random symbol is displayed on at least one of the reels, and a symbol displayed in the random symbol is randomly determined before the start of the game.

With this, a combination of symbols which is likely to be achieved varies in each game. In other words, as a payout which is likely to be awarded is different each time the game is run, the game play is diversified and becomes more entertaining for the player.

The present invention relates to a method of controlling a gaming machine running a normal game and a bonus game developing from the normal game, the gaming machine including:

a symbol display device configured to display a result of a game by rearranging symbols;

a storage device configured to store a bonus game number random determination table in which the number of times of execution of the bonus game is associated with a random number; and a controller, under control of the controller, the method including the steps of:

(2A) as a normal game, randomly selecting the symbols which are to be rearranged on the symbol display device;

(2B) rearranging the symbols selected in the step (2A) on the display device and awarding a benefit in accordance with a combination of the rearranged symbols;

(2C) when the benefit awarded in the step (2B) is the right to run the bonus game, counting how many predetermined bonus symbol is included in the combination of the symbols with which the right to run the bonus game is awarded;

(2D) performing random determination based on the bonus game number random determination table for the number of times corresponding to the number of the predetermined bonus symbol counted in the step (2C);

(2E) as the number of times of execution of the bonus game, awarding the total number determined in the step (2D).

According to the method above, in the normal game, when symbols are rearranged on the symbol display device and a benefit corresponding to the combination of the rearranged symbols is the right to run the bonus game, how many predetermined bonus symbol is included in the rearranged symbols is determined. The random determination is executed based on the bonus game number random determination table for the number of times corresponding to the number of the predetermined bonus symbol, and the number of times of execution of the bonus game is awarded to the player as a result of the random determination.

With this, when the right to run the bonus game is obtained, the player is interested in the number of the symbols to be rearranged, because, the more the predetermined bonus symbol is included in the combination of the rearranged symbols, the more the random determination of the number of times of execution of the bonus game is executed. Furthermore, because the random determination of the total number of times of execution of the bonus game is executed for the number of times corresponding to the number of the predetermined bonus symbol, the player enjoys the random determination for that number of times.

The present invention relates to a gaming machine awarding a benefit based on at least a result of a normal game and a result of a bonus game developing from the normal game, the gaming machine including:

a symbol display device configured to display a result of a game by rearranging symbols; and a controller, the controller being programmed to execute the processes of:

(3A) as the normal game, randomly selecting the symbols to be rearranged on the symbol display device;

(3B) rearranging the symbols selected in the process (3A) on the display device and awarding a benefit based on a combination of the rearranged symbols, wherein, the benefit includes the right to run the bonus game at most 100 times or more;

(3C) when the benefit awarded in the process (3B) is the right to run the bonus game, as options, presenting the execution of the bonus game for the awarded number of times and the execution of a one-time game with which the benefit is awarded as a result of random determination once; and (3D) executing the bonus game for the awarded number of times when the execution of the bonus game is chosen in the process (3C), or executing the one-time game when the execution of the one-time game is chosen.

According to the arrangement above, when the right to run the bonus game with which the awarded number of times of execution of the bonus game may be 100 or more is achieved, the player is allowed to select either the execution of the bonus game for the awarded number of times or the execution of the one-time game with which a benefit is awarded as a result of random determination once.

According to this arrangement, when, for example, the awarded total number of times of execution of the bonus game is large and it takes time to execute the bonus game for that number of times, the player may select the one-time game with which a benefit is awarded as a result of the random determination once, in order to shorten the time to run the bonus game for the awarded number of times.

The gaming machine of the present invention is arranged so that, an expectation value of the benefit awarded in the one-time game is equal to a value calculated by multiplying the expectation value of the benefit awarded as a result of running the bonus game once by the awarded number of times of execution of the bonus game.

According to the arrangement above, because the expectation value of the payout awarded when the one-time game is selected is arranged to be equal to a value calculated by multiplying the expectation value of the benefit awarded by executing the bonus game once by the awarded number of times of execution of the bonus game, the payout to be awarded is mathematically identical between the case where the bonus game is executed for the awarded number of times and the case where the one-time game is selected. With this, no matter whether the execution of the bonus game is selected or the execution of the one-time game is selected, the player enjoys the game with the same expectation of the payout.

The gaming machine of the present invention is arranged so that, an expectation value of the benefit awarded in the one-time game is equal to a value calculated by multiplying the expectation value of the benefit awarded as a result of running the bonus game once by the awarded number of times of execution of the bonus game.

According to the arrangement above, the player is able to know an estimated termination time which indicates when the running of the bonus game for the awarded number of times ends. This allows the player to choose the execution of the bonus game for the awarded number of times or the execution of the one-time game, in consideration of the notified estimated termination time.

The gaming machine of the present invention is arranged so that, in the process (3C), only when the benefit awarded in the process (3B) is the right to run the bonus game for a predetermined number of times, presenting the execution of the bonus game and the execution of the one-time game as the options.

According to this arrangement, when the awarded number of times of execution of the bonus game is equal to or larger than a predetermined number, the player is allowed to select either the execution of the bonus game for the awarded number of times or the execution of the one-time game with which a benefit is awarded as a result of random determination once.

According to this arrangement, when, for example, the awarded total number of times of execution of the bonus game is large and it takes time to execute the bonus game for that number of times, the player may select the one-time game with which a benefit is awarded as a result of the random determination once, in order to shorten the time to run the bonus game for the awarded number of times.

The present invention relates to a gaming machine running a normal game and a bonus game developing from the normal game, the gaming machine including:

a symbol display device configured to display a result of a game by rearranging symbols;

a storage device configured to store a plurality of bonus game number random determination tables in each of which an awarded number of times of execution of the bonus game is associated with the number of a predetermined bonus symbol in a combination of symbols with which the right to run the bonus game is awarded and a random number and a table selection random determination table in which the bonus game number random determination tables are associated with random numbers; and a controller, the controller being programmed to execute the processes of:

(4A) as the normal game, randomly selecting the symbols which are to be rearranged on the symbol display device;

(4B) rearranging the symbols selected in the process (4A) on the display device and awarding a benefit in accordance with a combination of the rearranged symbols;

(4C) when the benefit awarded in the process (4B) is the right to run the bonus game, counting how many predetermined bonus symbol is included in the combination of the symbols with which the right to run the bonus game is awarded;

(4D) performing random determination based on the table selection random determination table to select one of the bonus game number random determination tables based on which the number of execution of the bonus game is determined;

(4E) based on the number of the predetermined bonus symbol determined in the process (4C) and said one of the bonus game number random determination tables selected in the process (4D), performing random determination for the number of times corresponding to the number of the predetermined bonus symbol determined in the process (4C); and (4F) as the number of times of execution of the bonus game, awarding the total number determined in the process (4E).

According to the method above, in the normal game, when symbols are rearranged on the symbol display device and a benefit corresponding to the combination of the rearranged symbols is the right to run the bonus game, how many predetermined bonus symbol is included in the rearranged symbols is determined. Furthermore, a bonus game number random determination table used for determining the number of times of execution of the bonus game is selected from a plurality of bonus game number random determination tables. Then the random determination based on the determined number of the predetermined bonus symbol and the selected bonus game number random determination table is executed for the number of times corresponding to the determined number of the predetermined bonus symbol, and the total number of times of execution of the bonus game awarded as a result of the random determination is awarded to the player.

As the random determination of the total number of times of execution of the bonus game is executed for the number of times corresponding to the number of the predetermined bonus symbol, the player enjoys the random determination for that number of times.

Furthermore, because the number of times of execution of the bonus game awarded to the player is determined based on not only the number of bonus symbols in the combination of the symbols achieving the right to run the bonus game but also the three bonus game number random determination tables, another condition for determining the number of times of execution of the bonus game is added. This makes it possible to finely adjust the number of times of execution of the bonus game to be awarded.

The gaming machine of the present invention is arranged so that, the bonus game number random determination tables are different from one another in an expectation value of the number of execution of the bonus game to be awarded.

According to this arrangement, because the bonus game number random determination tables are different from one another in an expectation value of the number of times of execution of the bonus game to be awarded, the player enjoys paying attention to results of random determination based on the table selection random determination table, because the player is advantageous when the bonus game number random determination table having a high expectation value of the number of times of execution of the free game is selected as a result of random determination based on the table selection random determination table.

The gaming machine of the present invention is arranged so that, the controller is programmed to further execute the process of notifying which one of the bonus game number random determination tables is selected in the process (4D).

According to this arrangement, because which bonus game number random determination table is selected is notified, the player is able to know whether the expectation value of the number of times of execution of the bonus game is high or low in the selected bonus game number random determination table.

The gaming machine of the present invention is arranged so that, the bonus game number random determination tables define that the expectation value of the number of execution of the bonus game to be awarded varies in accordance with the number of the bonus symbols counted in the process (4C).

According to the arrangement above, because the bonus game number random determination tables are arranged so that the expectation value of the number of times of execution of the bonus game varies in accordance with the determined number of the bonus symbols, the player is interested in how many predetermined bonus symbol is included in the combination of the rearranged symbols, when obtaining the right to run the bonus game.

The gaming machine of the present invention is arranged so that, the expectation value of the number of execution of the bonus game to be awarded increases as the number of the bonus symbols counted in the process (4C) decreases.

According to this arrangement, because the random determination of the total number of times of execution of the bonus game is executed for the number of times corresponding to the number of the predetermined bonus symbol in the combination of the rearranged symbols, the player is able to enjoy the random determination for that number of times. In other words, the more the number of the bonus symbols is, the more the number of times of execution of the bonus game tends to be.

On the other hand, as described above, the expectation value of the number of times of execution of the bonus game is arranged to increase as the number of the bonus symbols decreases.

For this reason, when the number of the bonus symbols is small, the expectation value of the number of times of execution of the bonus game as a result of the random determination once is high, but the number of times of the random determination is small. In the meanwhile, when the number of the bonus symbols is large, while the expectation value of the number of times of execution of the bonus game as a result of the random determination once is low, the number of times of the random determination is large.

This restrains the final number of times of execution of the bonus game awarded based on the number of the bonus symbols not to significantly vary between different conditions.

The gaming machine of the present invention is arranged so that, the expectation value of the number of execution of the bonus game to be awarded is highest when the number of the bonus symbols counted in the process (4C) is minimum or maximum.

According to the arrangement above, the expectation value of the number of times of execution of the bonus game is highest when the determined number of the bonus symbols is minimum or maximum. With this, the player becomes interested in how many predetermined bonus symbol is included in a combination of rearranged symbols.

The gaming machine of the present invention is arranged so that, the random determination based on the table selection random determination table in the process (4D) is executed each time the random determination based on the bonus game number random determination tables is performed.

According to the arrangement above, the random determination is performed for the number of times corresponding to the number of the bonus symbols in the combination of the symbols with which the right to run the bonus game is awarded, based on the bonus game number random determination tables based on which the number of times of execution of the bonus game to be awarded is determined. Each time the random determination is performed, which bonus game number random determination table is used is randomly determined based on the table selection random determination table.

The present invention relates to a method of controlling a gaming machine running a normal game and a bonus game developing from the normal game, the gaming machine including:

a symbol display device configured to display a result of a game by rearranging symbols;

a storage device configured to store a plurality of bonus game number random determination tables in each of which an awarded number of times of execution of the bonus game is associated with the number of a predetermined bonus symbol in a combination of symbols with which the right to run the bonus game is awarded and a random number and a table selection random determination table in which the bonus game number random determination tables are associated with random numbers; and a controller, under control of the controller, the method comprising the steps of:

(5A) as the normal game, randomly selecting the symbols which are to be rearranged on the symbol display device;

(5B) rearranging the symbols selected in the step (5A) on the display device and awarding a benefit in accordance with a combination of the rearranged symbols;

(5C) when the benefit awarded in the step (5B) is the right to run the bonus game, counting how many predetermined bonus symbol is included in the combination of the symbols with which the right to run the bonus game is awarded;

(5D) performing random determination based on the table selection random determination table to select one of the bonus game number random determination tables based on which the number of execution of the bonus game is determined;

(5E) based on the number of the predetermined bonus symbol determined in the step (5C) and said one of the bonus game number random determination tables selected in the step (5D), performing random determination for the number of times corresponding to the number of the predetermined bonus symbol determined in the step (5C); and (5F) as the number of times of execution of the bonus game, awarding the total number determined in the step (5E).

According to the method above, in the normal game, when symbols are rearranged on the symbol display device and a benefit corresponding to the combination of the rearranged symbols is the right to run the bonus game, how many predetermined bonus symbol is included in the rearranged symbols is determined. Furthermore, a bonus game number random determination table used for determining the number of times of execution of the bonus game is selected from a plurality of bonus game number random determination tables. Then the random determination based on the determined number of the predetermined bonus symbol and the selected bonus game number random determination table is executed for the number of times corresponding to the determined number of the predetermined bonus symbol, and the total number of times of execution of the bonus game awarded as a result of the random determination is awarded to the player.

As the random determination of the total number of times of execution of the bonus game is executed for the number of times corresponding to the number of the predetermined bonus symbol, the player enjoys the random determination for that number of times.

Furthermore, because the number of times of execution of the bonus game awarded to the player is determined based on not only the number of bonus symbols in the combination of the symbols achieving the right to run the bonus game but also the three bonus game number random determination tables, another condition for determining the number of times of execution of the bonus game is added. This makes it possible to finely adjust the number of times of execution of the bonus game to be awarded.

It is possible to provide a gaming machine providing new forms of bonus awarding as a novel entertainment feature, and a control method of the gaming machine.

BRIEF DESCRIPTION OF THE DRAWINGS

FIG. 6 is an explanatory diagram of a symbol column on each video reel of the slot machine of First Embodiment.

FIG. 9 is an explanatory diagram of a payout determination table of First Embodiment.

FIG. 10 is an explanatory diagram of a bonus game number random determination table of First Embodiment.

FIG. 11 is an explanatory diagram of a roulette payout table of First Embodiment.

FIG. 38 is an explanatory diagram showing of a level setting table of Second Embodiment.

FIG. 39 is an explanatory diagram showing of a bonus game number random determination table (table A) of Second Embodiment.

FIG. 40 is an explanatory diagram showing a bonus game number random determination table (table B) of Second Embodiment.

FIG. 41 is an explanatory diagram showing a bonus game number random determination table (table C) of Second Embodiment.

FIG. 42 is an explanatory diagram showing a table selection random determination table of Second Embodiment.

FIG. 57A is an explanatory diagram showing a symbol arrangement on a video reel in a normal game according to another embodiment.

FIG. 57B is an explanatory diagram showing a symbol arrangement on a video reel in a normal game according to another embodiment.

FIG. 58A is an explanatory diagram showing the symbol arrangement on the video reel in a free game according to said another embodiment.

FIG. 58B is an explanatory diagram showing the symbol arrangement on the video reel in a free game according to said another embodiment.

FIG. 59 is an explanatory diagram showing the symbol arrangement on the video reel in the free game according to said another embodiment.

FIG. 60 is an explanatory diagram showing a rewriting position random determination table.

DESCRIPTION OF THE PREFERRED EMBODIMENTS (Outline of Slot Machine 10)

Figure 1:
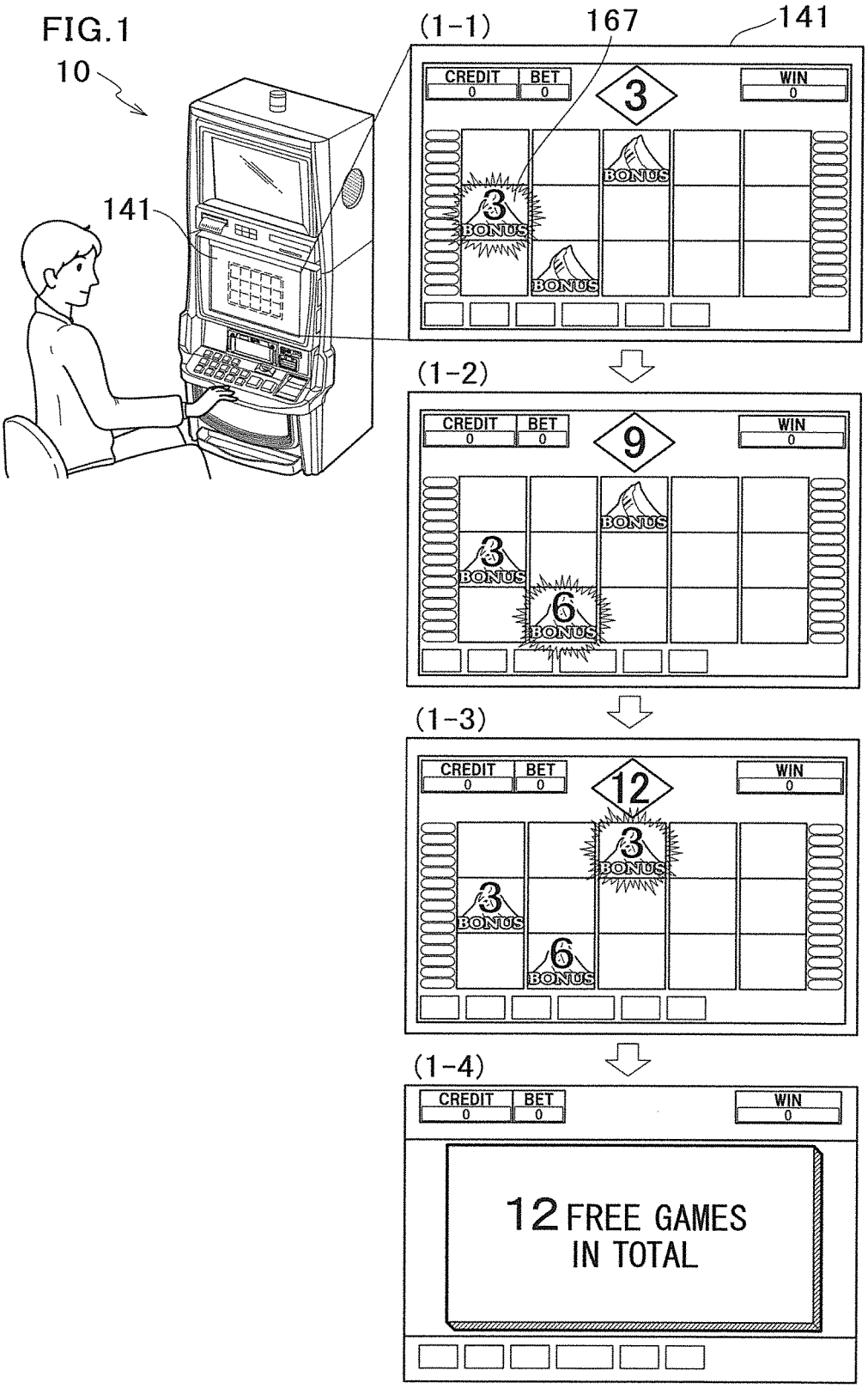
FIG. 1 is an explanatory diagram providing an overview of a slot machine game of one embodiment.

As shown in FIG. 1, a slot machine 10 according to the present invention includes a lower image display panel 141 (symbol display device) configured to display a result of a game by rearranging symbols, a RAM 73 (storage device) configured to store a bonus game number random determination table 192 in which the awarded number of times of execution of a free game (bonus game) is associated with a random number, a motherboard 70, and a main CPU 71 (controller). The main CPU 71 is configured to execute the following processes:

(1A) as a normal game, a process of randomly determining the symbols to be rearranged on the lower image display panel 141;

(1B) a process of rearranging the symbols determined in the process (1A) on the lower image display panel 141 and awarding a benefit in accordance with the combination of the rearranged symbols;

(1C) when the benefit awarded in the process (1B) is the right to run a free game, counting the number of bonus symbols 167 (bonus symbols) in the combination of symbols with which the right to run the free game has been awarded;

(1D) executing random determination based on a bonus game number random determination table 192 for a number of times corresponding to the number of bonus symbols 167 counted in the process (1C) (see (1-1) to (1-3) in FIG. 1); and (1E) as the number of times the free game is executable, awarding the total number of times of execution of the free game, which has been randomly determined in the process (1D) (see (1-4) in FIG. 1).

(Definitions or the Like)

The slot machine 10 above is a type of a gaming machine. While the present embodiment deals with the slot machine 10 as an example of the gaming machine, the slot machine 10 may be a different type of machine on condition that a normal game can be individually run by the machine and a bonus game developing from the normal game can be run by the machine.

A normal game of the present embodiment is run by the slot machine 10. The normal game is a slot game of rearranging symbols (see FIG. 6). The normal game is a concept as opposed to a free game, a bonus game, and a roulette game.

The rearrangement of the symbols in the slot game is performed on the lower image display panel 141. The slot game includes a process of running a normal game of rearranging symbols on the lower image display panel 141 on condition that a gaming value is bet and awarding a normal payout based on the rearranged symbols and a process of running a free game of rearranging symbols in a condition different from that of the normal game when the symbols rearranged in the normal game achieve a predetermined condition and awarding a payout based on the rearranged symbols.

As the symbols, there are "J", "Q", "9", "A", "10", "CURRENCY 161", "DRESS" 162, "DRAGON" 163, "CASTLE" 164, "EMPEROR" 165, "WILD" 166, "BONUS" 167, and "BOX SYMBOL 168".

A coin, a bill, or electrically valuable information corresponding to these is used as a gaming value. It is to be noted that the gaming value in the disclosure is not limited to these, and for example a medal, a token, electric money or the like can be adopted. Further, a later-described ticket with a barcode is also used.

The free game of the present embodiment may be any type of game on condition that the gaming state thereof is different from that of the normal game. The free game is a game which is executable with a smaller amount of gaming values bet than in the normal game. The expression "executable with a smaller amount of gaming value bet" includes a case where an amount of gaming values bet is zero. Therefore, the free game may be a game which is run without betting a gaming value and the gaming value is paid out for an amount corresponding to rearranged symbols. In other words, the free game may be a game that starts even if no gaming value is consumed. On the other hand, the normal game is run on condition that a gaming value is bet, and is a game of paying out gaming value for an amount corresponding to rearranged symbols. In other words, the normal game is a game that starts with the consumption of the gaming value.

The term "rearrangement" indicates that the symbols are rearranged after the arrangement of the symbols is dismissed. The term "arrangement" indicates a state in which the symbols are visually recognizable by an external player.

(Explanation of Function Flow Diagram)

Figure 2:
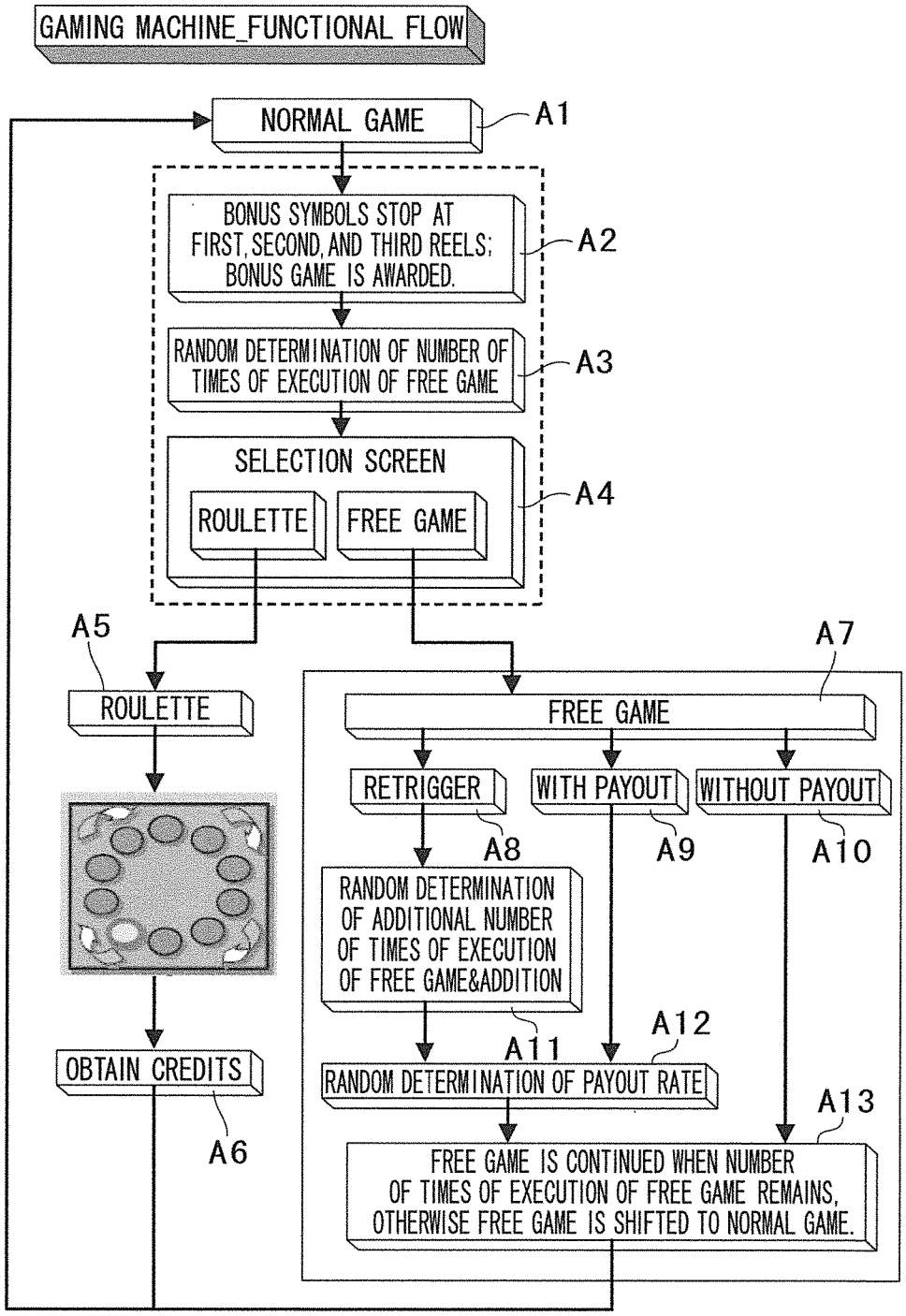
FIG. 2 is a diagram showing a function flow of the gaming machine of the present invention.

The following describes basic functions of the slot machine 10 of the present invention, with reference to FIG. 2.

(Normal Game)

To begin with, in the slot machine 10, a slot game of rearranging symbols is run as a normal game, and a benefit is awarded in accordance with the combination of the rearranged symbols (A1).

Subsequently, when in the normal game at least one symbol BONUS 167 is rearranged on a display block 28 of each of a first video reel 151, a second video reel 152, and a third video reel 153, bonus game trigger is established and a bonus game is awarded (A2).

Then the random determination of the number of times of execution of the free game is conducted for the number of times corresponding to the number of the BONUS 167 symbols in the symbol combination at the time of the establishment of the bonus game trigger (A3).

Then the player is prompted to select the execution of the free game for the awarded number of times or the execution of a roulette game in which a payout may be awarded as a result of one random determination (A4).

Figure 29:
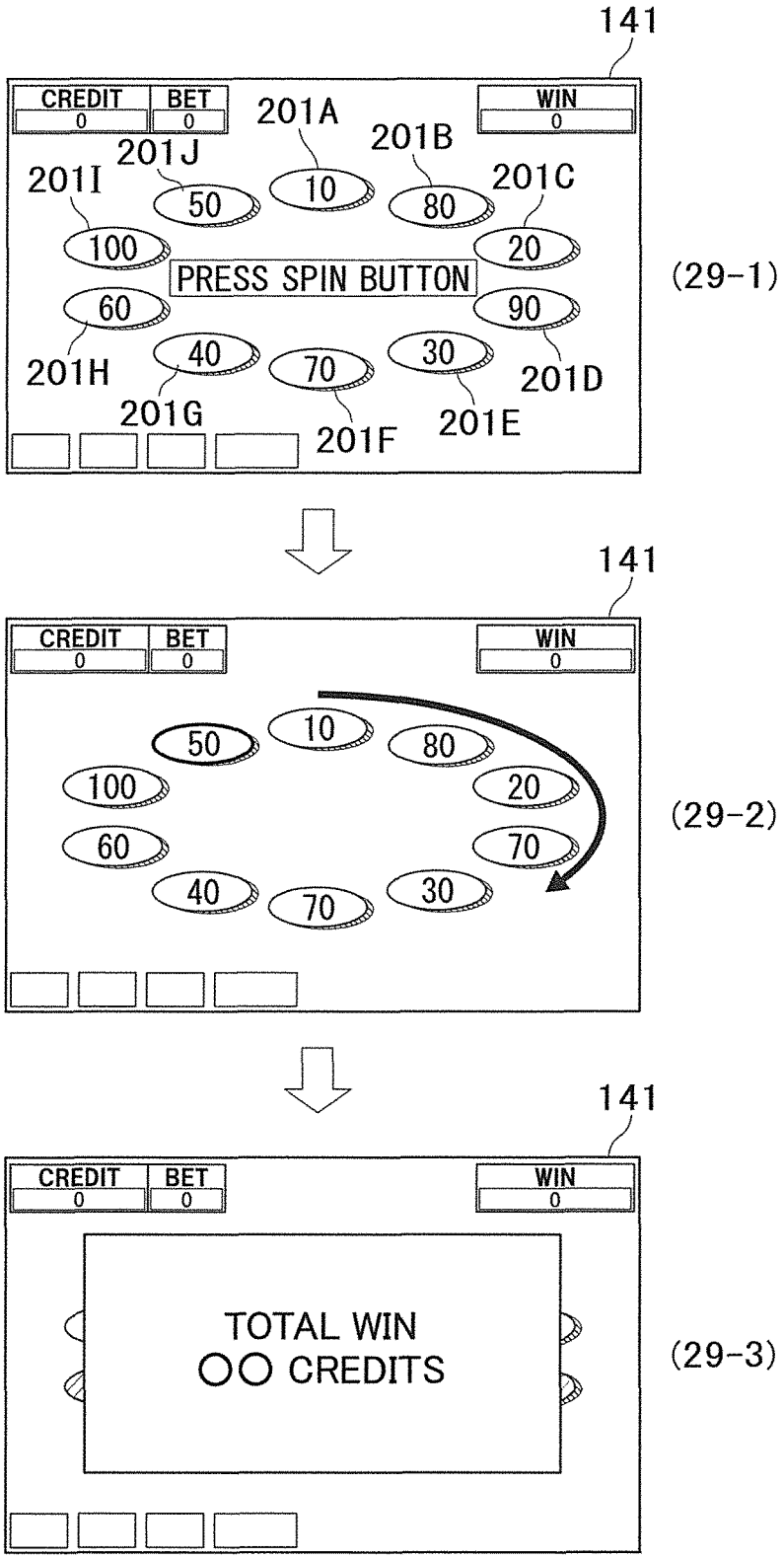
FIG. 29 shows an example of an image displayed on the lower image display panel in a roulette running process.

When the roulette game is selected in A4, as shown in FIG. 29, an effect is displayed such that a light spot rotates clockwise on targets 201A to 201J and then stops on the randomly selected one of the targets 201A to 201J after gradually slows down (A5).

A payout credit corresponding to the one of the targets 201A to 201J where the light spot stops in A5 is awarded to the player (A6). Then the process shifts to the normal game.

On the other hand, when the free game is selected in A4, the slot game is run in the same manner as in the normal game (A7). Based on the combination of the rearranged symbols, a payout is awarded if there is a payout (A9), no payout is awarded if there is no payout (A10), and the process of randomly determining and adding the additional number of times of execution of the free game is conducted (A11) if re-trigger is established (A8). When there is a payout in the free game, the payout rate of the payout is randomly determined (A12). Thereafter, when the number of times of execution of the free game is not zero, the execution of the free game is continued. When the number of times of execution of the free game is zero, the process proceeds to the normal game (A13).

First Embodiment

Structure of Slot Machine 10

Next, the following describes a gaming system including a slot machine 10 to which the gaming machine of the present invention is applied. Next, with reference to FIG. 3 and FIG. 4, the following describes an overall structure of the slot machine 10.

A coin, a bill, or electrically valuable information corresponding to these is used as a game medium in the slot machine 10. Further, in the present embodiment, a later-described ticket with a barcode is also used. It is to be noted that the game medium is not limited to these, and for example a medal, a token, electronic money or the like can be adopted.

The slot machine 10 includes a cabinet 11, a top box 12 installed on the upper side of the cabinet 11, and a main door 13 provided at the front surface of the cabinet 11.

(Structure of Slot Machine 10: Image Displayed on Lower Image Display Panel 141)

On the main door 13, a lower image display panel 141 (equivalent to a symbol display device) is provided. The lower image display panel 141 is formed of a transparent liquid crystal panel. The lower image display panel 141 is formed of a transparent liquid crystal panel. The display window 150 includes fifteen display blocks 28 which are arranged in five columns and three rows. The columns form video reels 151 to 155, each having three display blocks 28. The three display blocks 28 in each of the video reels 151 to 155 are displayed as if all the display blocks 28 are moving downward at various speed. This enables rearrangement, in a manner that symbols respectively displayed in the display blocks 28 are rotated in a longitudinal direction and stopped thereafter.

Figure 7:
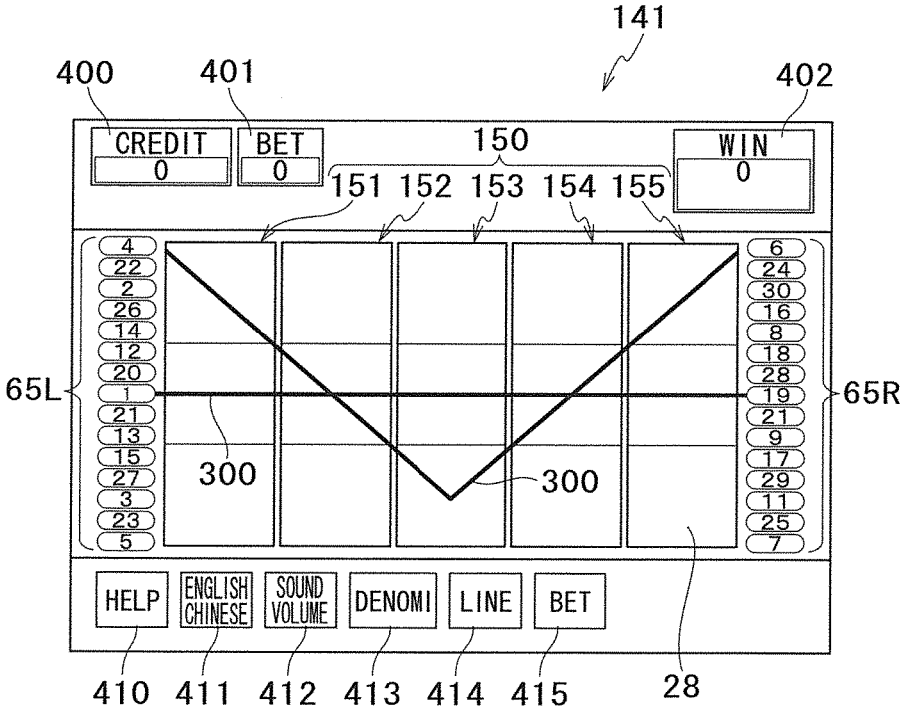
FIG. 7 is an explanatory diagram of an image displayed on a lower image display panel of the slot machine of First Embodiment.
Figure 8:
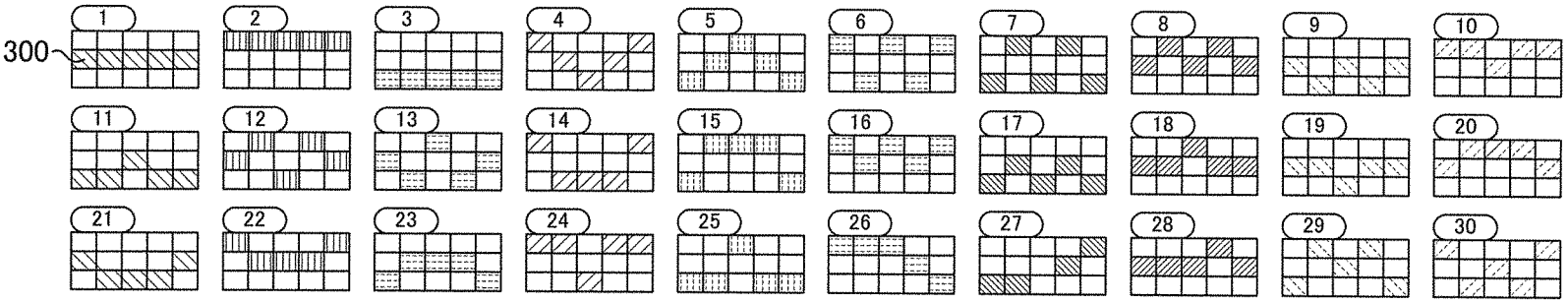
FIG. 8 is an explanatory diagram showing paylines related to First Embodiment.

In addition to the above, as shown in FIG. 7 and FIG. 8, on the left and right sides of the display window 150 displayed on the lower image display panel 141 are symmetrically arranged payline occurrence columns. The payline occurrence column on the left side for the player includes fifteen payline occurrence parts 65L (see the paylines 300 each of which is a combination of display blocks 28 in FIG. 8). On the other hand, the payline occurrence column on the right side has fifteen payline occurrence parts 65R (see the paylines 300 each of which is a combination of display blocks 28 in FIG. 8). The payline occurrence parts 65L and the payline occurrence parts 65R form a total of 30 paylines 300, as shown in FIG. 7 and FIG. 8.

The number of active paylines 300 is determined based on an operation of a 1-bet button 34, a 2-bet button 35, a 3-bet button 37, a 4-bet button 38, a 5-bet button 39, a max bet button 45, a play-2-lines button 40, a play-10-lines button 41, a play-20-lines button 42, and a play-30-lines button 43 on a later-described control panel 30. An activated payline 300 results in various types of winning for each symbol.

Above the display window 150, as shown in FIG. 7, a credit meter 400, a bet meter 401, and a win meter 402. The credit amount display unit 400 and the bet-number display unit 401 are displayed at the left edge part when viewed from the player. In the meanwhile, the win meter 402 is provided at the right edge part when viewed from the player.

The credit meter 400 displays the total number of credits. The default value is 0. The number increases or decreases in accordance with the insertion of a game value, betting, or a game result.

The bet meter 401 displays "Total Bets (=Bets×Lines)". The value is re-calculated in each game play. The win meter 402 displays the total obtained credits in an increment manner. The default value is 0. The win meter 402 switchably displays "Line XX Win XX" or "Total Win XX". The display is switched in sync with the display of payline at the time of the occurrence of winning. The content above is displayed after the occurrence of winning. The values are determined based on the payline at the occurrence of winning and the number of credits.

In the meanwhile, below the display window 150 are provided a help touch button 410, a language switching touch button 411, a sound volume switching touch button 412, a denomination button 413, a number of lines selection touch button 414, and a bet per line selection touch button 415. These buttons 410, 411, 412, 413, 414, and 415 are provided left to right when viewed from the player.

The help touch button 410 displays a help screen when touched. The help touch button 410 is darkened when it is inactivated, e.g., during the rotation of the reels. The button is displayed when the normal screen is displayed.

As the language switching touch button 411 is touched, the language is switched between English and Chinese. The language switching touch button 411 is activated only during the advertisement, and is darkened when it is invalidated, e.g., during the rotation of the reels.

The sound volume switching touch button 412 is used for switching the game sound volume at three stages. Each time the button is touched, the game sound volume is switched such that, for example, from low to middle to high to small to middle. The button is displayed when the normal screen is displayed.

The denomination button 413 displays the current denomination set in the AUDIT. This button is displayed when screens other than the AUDIT are displayed.

The number of lines selection touch button 414 is used for increasing or decreasing the number of paylines L.

The bet per line selection touch button 415 makes it possible to conduct bet per line. When the button is touched, five selection buttons corresponding to the current bet configuration appear.

Further, a touch panel 114 is disposed on a front surface of the lower image display panel 141, and a player is able to input various instructions by operating the touch panel 114. From the touch panel 114, an input signal is transmitted to the main CPU 71.

Figure 3:
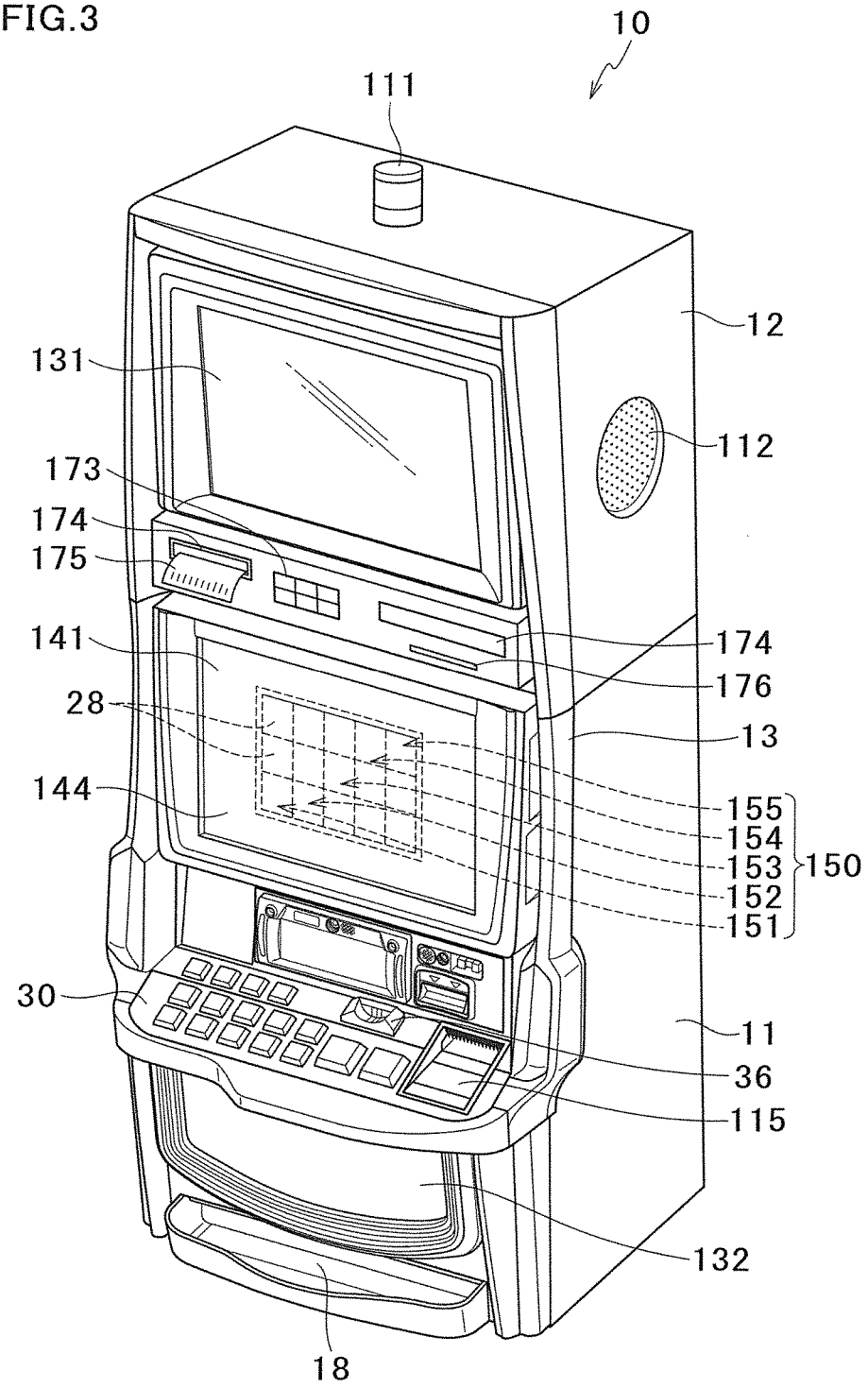
FIG. 3 shows the entire structure of the slot machine of the embodiment.
Figure 4:
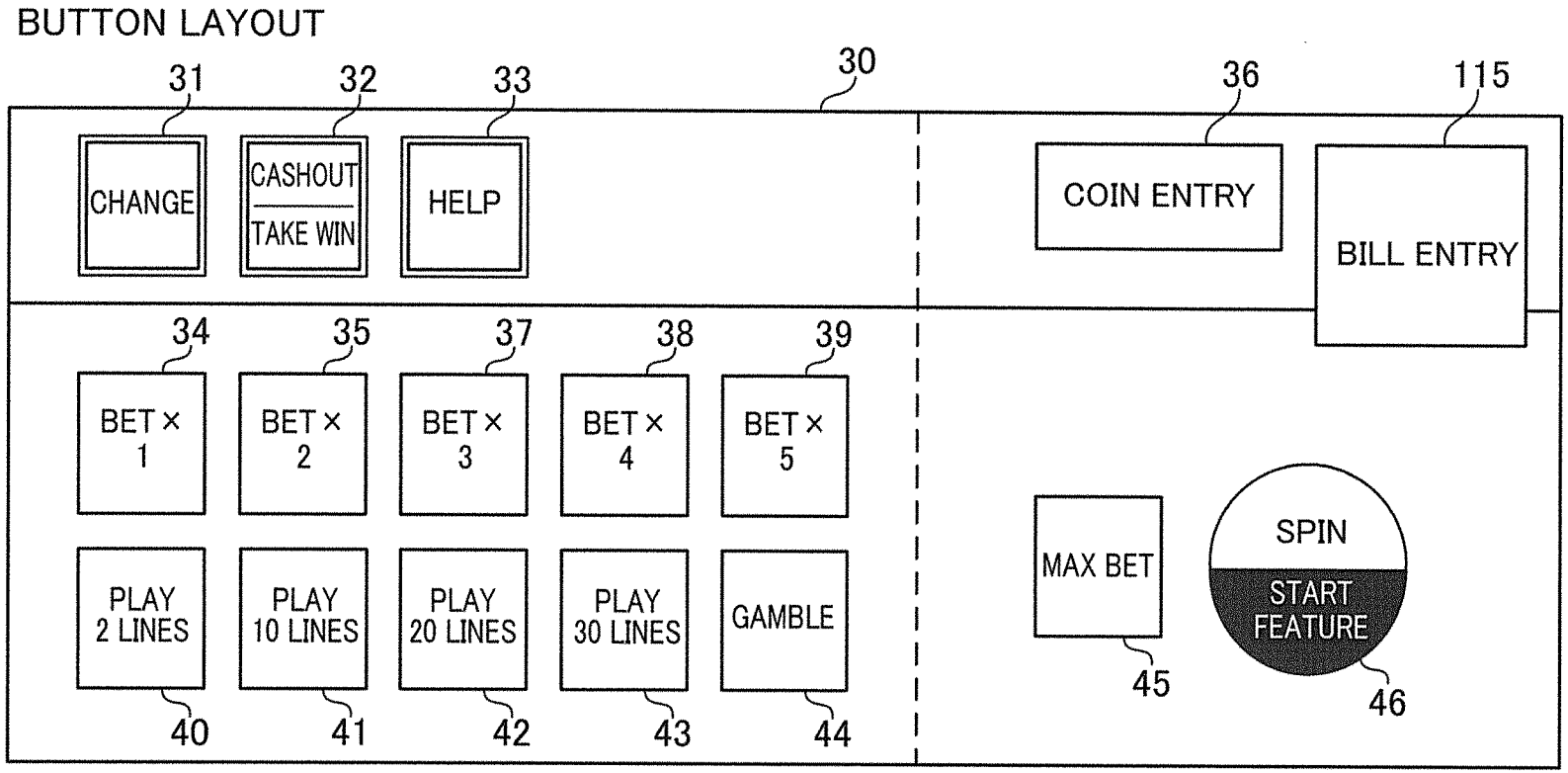
FIG. 4 shows a control panel of the slot machine of the embodiment.

As shown in FIG. 3 and FIG. 4, below the lower image display panel 141 are provided various buttons on the control panel 30 (input device), a coin entry 36 which guides coins into the cabinet 11, and a bill entry 115.

The control panel 30 includes: a change button 31, a cashout/take win button 32, and a help button 33 arranged in the left side area of the upper stage; a 1-bet button 34, a 2-bet button 35, a 3-bet button 37, a 4-bet button 38, a 5-bet button 39, a play-2-lines button 40, a play-10-lines button 41, a play-20-lines button 42, a play-30-lines button 43, and a gamble button 44 in the left side area of the lower stage. Further, a coin entry 36 and a bill entry 115 for accepting bills or the like are arranged in the right side area of the upper stage, and a max-bet button 45 and a spin button 46 are arranged in the right side area of the lower stage.

The change button 31 is an operation button to be used when temporarily leaving the seat, or when requesting a staff person of the gaming facility for an exchange. The cashout/take win button 32 is an operation button to be used for cashing out coins (credits) stored in the slot machine 10. The help button 33 is pressed when the operating method of a game is unclear. When the help button 33 is pressed, various types of help information are displayed on the upper image display panel 131 and the lower image display panel 141.

A 1-bet button 34 is arranged so that, each time the button is pressed, one gaming medium is bet on each active payline from the current credit owned by the player. A 2-bet button 35 is pressed to start a game on condition that two gaming media are bet on each active payline. A 3-bet button 37 is pressed to start a game on condition that three gaming media are bet on each active payline. A 4-bet button 38 is pressed to start a game on condition that four gaming media are bet on each active payline. A 5-bet button 39 is pressed to start a game on condition that five gaming media are bet on each active payline. A max-bet button 45 is pressed to start a game on condition that ten gaming media are bet on each active payline. Thus, the bet amount on each payline is determined by pressing of the 1-bet button 34, the 2-bet button 35, the 3-bet button 37, the 4-bet button 38, the 5-bet button 39, and the max-bet button 45.

A play-2-lines button 40 activates paylines when pressed. In this case, the number of paylines to be activated is 2. A play-10-lines button 41 activates paylines when pressed. In this case, the number of paylines to be activated is 10. A play-20-lines button 42 activates paylines when pressed. In this case, the number of paylines to be activated is 20. A play-30-lines button 43 activates paylines when pressed. In this case, the number of paylines to be activated is 30.

The gamble button 44 is an operation button used for, for example, shifting to the gamble game after the end of the bonus game or the like. The gamble game here means a game run by using credit the player has won.

The spin button 46 is a button for starting scroll of the video reels 151 to 155.

The coin entry 36 is for accepting coins into the cabinet 11. The bill entry 115 validates a bill, and accepts a valid bill into the cabinet 11.

Further, the lower front surface of the main door 13, i.e., the lower portion of the control panel 30, has a belly glass 132 on which a character of the slot machine 10 or the like is drawn, and a coin tray 18 for receiving coins output from inside the cabinet 11.

An upper image display panel 131 is provided at the front face of the top box 12. The upper image display panel 131 includes a liquid crystal panel, and forms the display. The upper image display panel 131 displays images related to effects and images showing introduction of the game contents and explanation of the game rules. Further, the top box 12 is provided with a speaker 112 and a lamp 111. The slot machine 10 produces effects by displaying images, outputting sounds, and outputting the light.

A data display 174, and a keypad 173 are provided on the lower side of the upper image display panel 131. The data display 174 includes a fluorescent display, LEDs and the like, and displays the data inputted by the player via the keypad 173, for example. The keypad 173 is for inputting data.

(Symbol Column)

Next, with reference to FIG. 6, a configuration of the symbol columns on the video reels 151-155 of the slot machine 10 is described.

The base game symbol table of FIG. 6 shows arrangements of symbols displayed on the video reels. A first video reel 151, a second video reel 152, a third video reel 153, a fourth video reel 154, and a fifth video reel 155 each is assigned with a symbol column consisting of 22 symbols that correspond to respective code numbers from "00" to "21".

As the symbols, there are "J", "Q", "9", "A", "10", "CURRENCY" 161, "DRESS" 162, "DRAGON" 163, "CASTLE" 164, "EMPEROR" 165, "WILD" 166, "BONUS" 167, and "BOX SYMBOL" 168, as shown in FIG. 6. The box symbol 168 is equivalent to a random symbol where a randomly-determined symbol is displayed in each game, as detailed later.

(Structures of Circuits Provided to Slot Machine 10)

Figure 5:
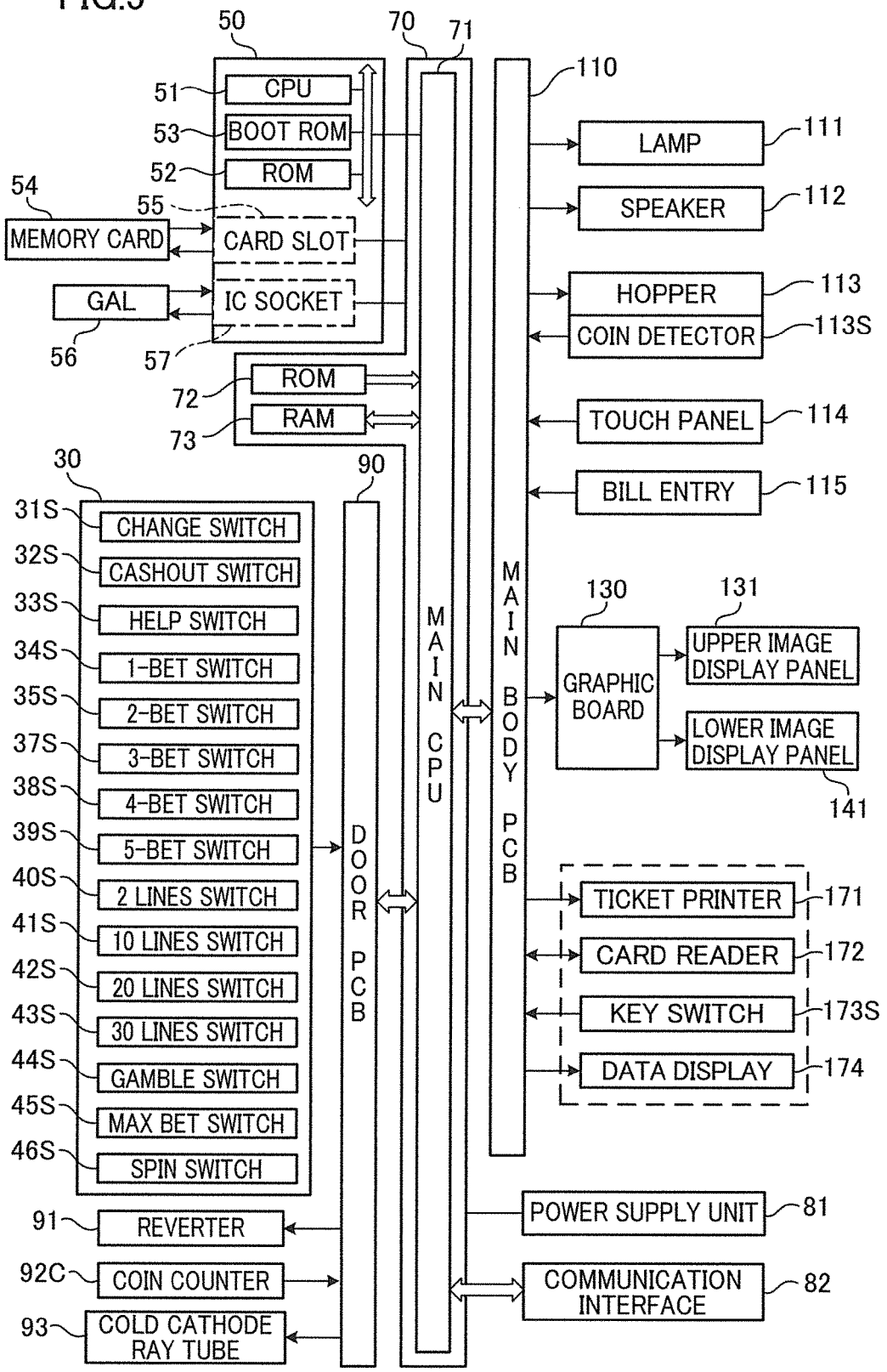
FIG. 5 is a block diagram showing an internal structure of the slot machine of the embodiment.

Next, with reference to FIG. 5, a configuration of a circuit included in the slot machine 10 is described.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a nonvolatile memory, and stores a game program and a game system program. The game program includes a program related to game progression, a random determination program, and a program for producing effects by images and sounds. The game program further includes data of a symbol table by which the arrangement of symbols on each of the video reels 151 to 155 is determined, a payout determination table 191, a bonus game number random determination table 192, and a roulette payout table 193.

The random determination program is a program for randomly determining to-be stopped symbol on the video reels 151-155. The to-be stopped symbol is data for determining three symbols to be displayed to the display window 150 out of the 22 symbols forming each symbol column. The slot machine 10 of the present embodiment determines as the to-be stopped symbol the symbols to be displayed in a predetermined area (e.g. the uppermost stage) out of the three areas provided for each of the video reels 151-155 of the display window 150.

The aforementioned random determination program includes symbol determination data. The symbol determination data is data that specifies random numbers so that each of the 22 symbols (code numbers from "00" to "21") forming the symbol column is determined at an equal probability (i.e. 1/22), for each of the video reels 151-155. The probabilities of the respective 22 symbols being determined are basically equal. However, the types of symbols included in the 22 symbols are different from one another in number, and thus the probabilities of the respective types of symbols being determined are different. It is noted that the probabilities of the respective types of symbols may include a random number.

Further, the card slot 55 is configured so that the memory card 54 can be inserted thereinto and removed therefrom, and is connected to a motherboard 70 by an IDE bus.

The GAL 56 is a type of PLD (programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents and settings of the game to be played on the slot machine 10 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like. The authentication program is a program (falsification check program) for authenticating the game program and the game system program. The pre-authentication program is a program for authenticating the aforementioned authentication program. The authentication program and the pre-authentication program are written along a procedure (authentication procedure) for proving that the program to be the subject has not been falsified.

The motherboard 70 is provided with a main CPU 71, a ROM 72 (storage device), a RAM 73 (storage device), and a communication interface 82. The motherboard 70 corresponds to the controller of the present invention.

The ROM 72 includes a memory device such as a flash memory, and stores a program such as BIOS to be executed by the main CPU 71, and permanent data. When the BIOS is executed by the main CPU 71, a process for initializing predetermined peripheral devices is executed. Further, through the gaming board 50, a process of loading the game program and the game system program stored in the memory card 54 is started.

The RAM 73 stores data and programs which are used in operation of the main CPU 71. For example, when the process of loading the aforementioned game program (including the payout determination table 191, the bonus game number random determination table 192, and roulette payout table 193), game system program or authentication program is executed, the RAM 73 can store the program.

The RAM 73 is provided with working areas used for operations in execution of these programs. Examples of the areas include: an area that stores counters for the number of games, the bet amount, the payout amount, the credit amount and the like; and an area that stores symbols (code numbers) randomly determined. In other words, the RAM 73 functions as a game counter, a bet amount counter, a payout amount counter, and a credit amount counter.

The communication interface 82 is for communicating with the external controller such as a server, through the communication line. Further, the motherboard 70 is connected with a later-described door PCB (Printed Circuit Board) 90 and a main body PCB 110 by respective USBs.

The motherboard 70 is also connected with a power unit 81. When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the main body PCB 110 are connected with input devices such as a switch and a sensor, and peripheral devices the operations of which are controlled by the main CPU 71. The door PCB 90 is connected with a control panel 30, a reverter 91, a coin counter 92C and a cold cathode tube 93.

The control panel 30 includes: a change switch 31S, a cashout switch 32S, a help switch 33S, a 1-bet switch 34S, a 2-bet switch 35S, a 3-bet switch 37S, a 4-bet switch 38S, a 5-bet switch 39S, a play-2-lines switch 40S, a play-10-lines switch 41S, a play-20-lines switch 42S, a play-30-lines switch 43S, a gamble switch 44S, a max-bet switch 45S, and a spin switch 46S, which correspond to the above described buttons, respectively. Each of the switches outputs a signal to the main CPU 71 upon detection of the pressing of the button corresponding thereto by the player.

Inside the coin entry 36 is provided a reverter 91 and a coin counter 92C. The reverter 91 validates the legitimacy of coins inserted into the coin entry 36, and outputs those not determined as genuine coins to the coin tray 18. The coin counter 92C detects the received genuine coins and counts the number of these coins.

The cold cathode tube 93 functions as a backlight installed on the rear face side of the upper image display panel 131 and the lower image display panel 141, and turns on based on a control signal outputted from the main CPU 71.

To the main body PCB 110 are connected the lamp 111, the speaker 112, a hopper 113, a coin detection unit 113S, the touch panel 114, the bill entry 115, a graphic board 130, a ticket printer 171, a card reader 172, a key switch 173S and the data display 174.

The lamp 111 turns on based on a control signal outputted from the main CPU 71. The speaker 112 outputs sounds such as BGM, based on a control signal outputted from the main CPU 71.

The hopper 113 operates based on a control signal outputted from the main CPU 71, and pays out a designated number of coins to the coin tray 18. The coin detection unit 113S outputs a signal to the main CPU 71 upon detection of coins paid out by the hopper 113.

The touch panel 114 detects a place on the lower image display panel 141 touched by the player's finger or the like, and outputs to the main CPU 71 a signal corresponding to the detected place. Upon acceptance of a valid bill, the bill entry 115 outputs to the main CPU 71 a signal corresponding to the face amount of the bill.

The graphic board 130 controls image display executed by the respective upper image display panel 131 and lower image display panel 141, based on a control signal outputted from the main CPU 71. The display window 150 of the lower image display panel 141 displays the five video reels 151-155 by which the scrolling and stop motions of the symbol columns included in the respective video reels 151-155 are displayed. The graphic board 130 is provided with a VDP generating image data, a video RAM temporarily storing the image data generated by the VDP, and the like.

The graphic board 130 is provided with the VDP (Video Display Processor) generating image data based on a control signal outputted from the main CPU 71, the video RAM temporarily storing the image data generated by the VDP, and the like. It is to be noted that the image data used in generation of image data by the VDP is included in the game program that has been read from the memory card 54 and stored into the RAM 73.

Based on a control signal outputted from the main CPU 71, the ticket printer 171 prints on a ticket a barcode representing encoded data of the credit amount stored in the RAM 73, date and time, the identification number of the slot machine 10, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided in the keypad 173, and outputs a predetermined signal to the main CPU 71 when the keypad 173 has been operated by the player.

The data display 174 displays data read by the card reader 172 and data inputted by the player through the keypad 173, based on a control signal outputted from the main CPU 71.

(Payout Determination Table)

Next, the following describes a payout determination table, with reference to FIG. 9.

The payout determination table 191 indicates a relation between a credit amount paid out and the type of and the number of symbols rearranged on an active payline 300. Note that the payout determination table 191 is read out and referred to in a later mentioned program. In the present embodiment, rearrangement of three or more of at least one of the following types of symbols on an active payline 300 is determined as a winning: "J", "Q", "9", "A", "10", "CURRENCY", "DRESS", "DRAGON", "CASTLE", "EMPEROR", and "WILD".

As detailed later, when at least one symbol "BONUS 167" (equivalent to the bonus symbol) which is a trigger symbol of the bonus game is arranged in the display block 28 of each of the first video reel 151, the second video reel 152, and the third video reel 153, "bonus game trigger" (equivalent to the right to run the bonus game) is achieved as a winning combination, and the process proceeds to the bonus game.

(Bonus Game Number Random Determination Table)

Now, referring to FIG. 10, the bonus game number random determination table 192 will be described.

The bonus game number random determination table 192 is a random determination table which is read and referred to during a later-described bonus game process, and indicates winning probabilities of the obtained numbers of times of execution of the free game (see the columns in the bonus game number random determination table 192 shown in FIG. 10) corresponding to the numbers of the bonus symbols 167 displayed on the display window 150 (see the rows in the bonus game number random determination table 192 shown in FIG. 10) when bonus game trigger is established during a later-described main control process. For example, when the bonus game trigger is established in the main control process and three bonus symbols 167 are displayed in the display window 150 in total, a "Very_Low" random determination table in the bonus game number random determination table 192 is referred to in the bonus game process. In this case, the number of times of execution of the free game "three times" is awarded at a probability of 50/100, "six times" is awarded at a probability of 30/100, "nine times" is awarded at a probability of 10/100, "twelve times" is awarded at a probability of 7/100, "fifteen times" is awarded at a probability of 2/100, and "thirty times" is awarded at a probability of 1/100. In the present embodiment, as indicated by the bonus game number random determination table 192 shown in FIG. 10, the winning probabilities are set so that, when the bonus game trigger is established in the main control process, the awarded number of times of running the free game increases as the number of the bonus symbols 167 displayed in the display window 150 increases. More specifically, six random determination tables "Very_Low", "Low", "Middle", "High", "Very- _High", and "EXTRA" are set in accordance with the numbers of the bonus symbols 167 displayed in the display window 150, and hence the player's expectation on the number of times of running the free game to be awarded increases in accordance with the increase in the number of the bonus symbols 167 displayed in the display window 150.

(Roulette Payout Table)

Now, referring to FIG. 11, the roulette payout table 193 will be described.

The roulette payout table 193 is payout data read out and referred to during a later-described roulette running process, and shows winning probabilities of the payout corresponding to targets 201A to 201J which are displayed during the later-described roulette running process, as shown in FIG. 29.

More specifically, as shown in FIG. 11, the target 201A is associated with a payout of "10 credits" and the winning probability thereof is set at 10/71. The target 201B is associated with a payout of "80 credits" and the winning probability thereof is set at 4/71. The target 201C is associated with a payout of "20 credits" and the winning probability thereof is set at 10/71. The target 201D is associated with a payout of "90 credits" and the winning probability thereof is set at 3/71. The target 201E is associated with a payout of "30 credits" and the winning probability thereof is set at 10/71. The target 201F is associated with a payout of "70 credits" and the winning probability thereof is set at 4/71. The target 201G is associated with a payout of "40 credits" and the winning probability thereof is set at 10/71. The target 201H is associated with a payout of "60 credits" and the winning probability thereof is set at 6/71. The target 201I is associated with a payout of "100 credits" and the winning probability thereof is set at 5/71. The target 201J is associated with a payout of "50 credits" and the winning probability thereof is set at 9/71.

(Contents of Program)

Next, the program to be executed by the slot machine 10 is described.

(Main Control Process)

Figure 12:
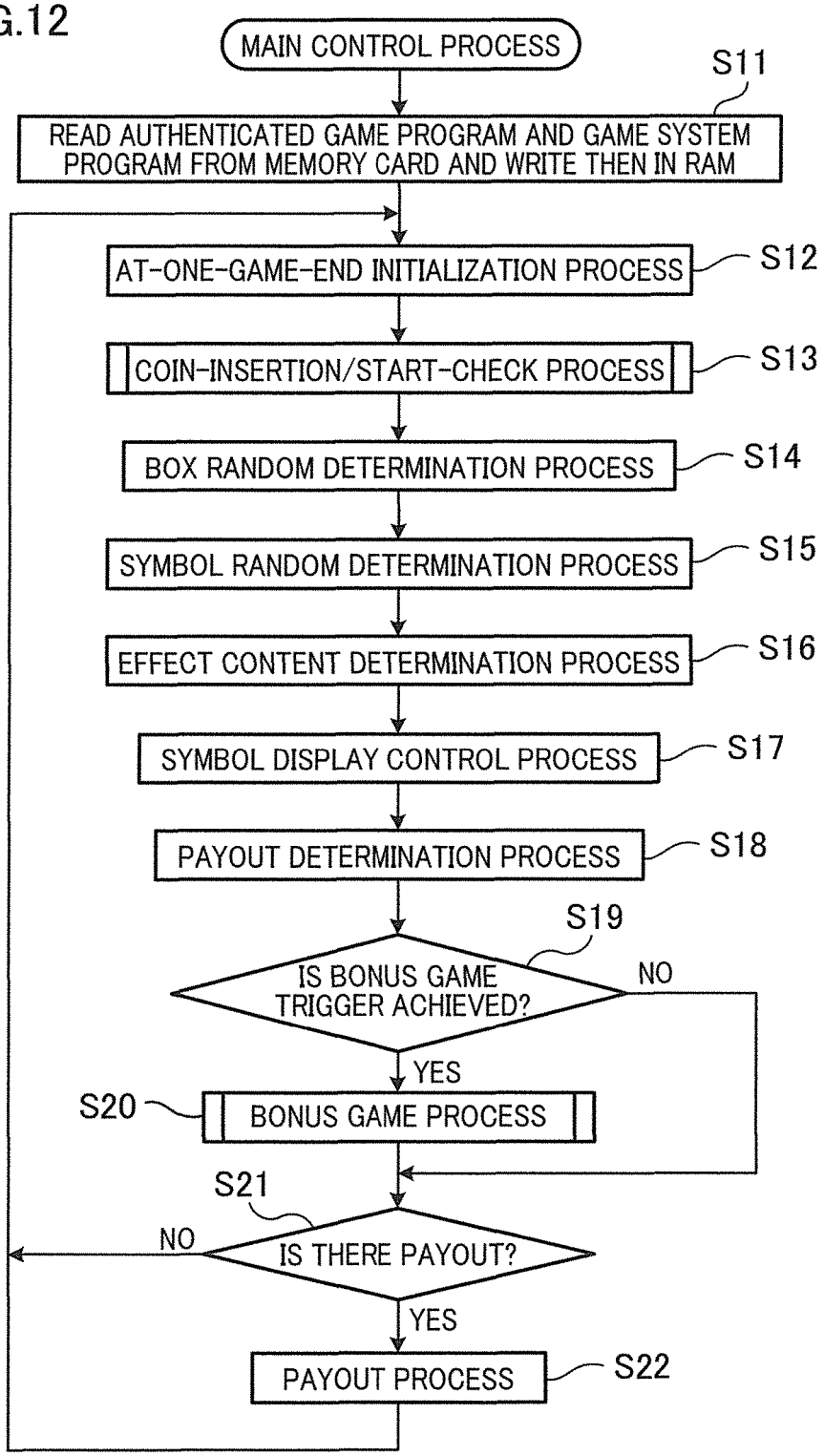
FIG. 12 is a flowchart of a main control process of the slot machine of First Embodiment.

First, with reference to FIG. 12, a main control process is described.

First, when the slot machine 10 is powered on, the main CPU 71 reads the authenticated game program and game system program from the memory card 54 through the gaming board 50, and writes the programs into the RAM 73 (S11).

Next, the main CPU 71 executes at-one-game-end initialization process (S12). For example, data that becomes unnecessary after each game in the working areas of the RAM 73, such as the bet amount and the symbols randomly determined, is cleared.

The main CPU 71 executes a coin-insertion/start-check process which is described later with reference to FIG. 13 (S13). In this process, an input check or the like is executed for the 1-bet switch 34S, the 2-bet switch 35S, the 3-bet switch 37S, the 4-bet switch 38S, the 5-bet switch 39S, the max-bet switch 45S, the play-2-lines switch 40S, the play-10-lines switch 41S, the play-20-lines switch 42S, the play-30-lines switch 43S, the spin switch 46S, or the like.

Figure 18:
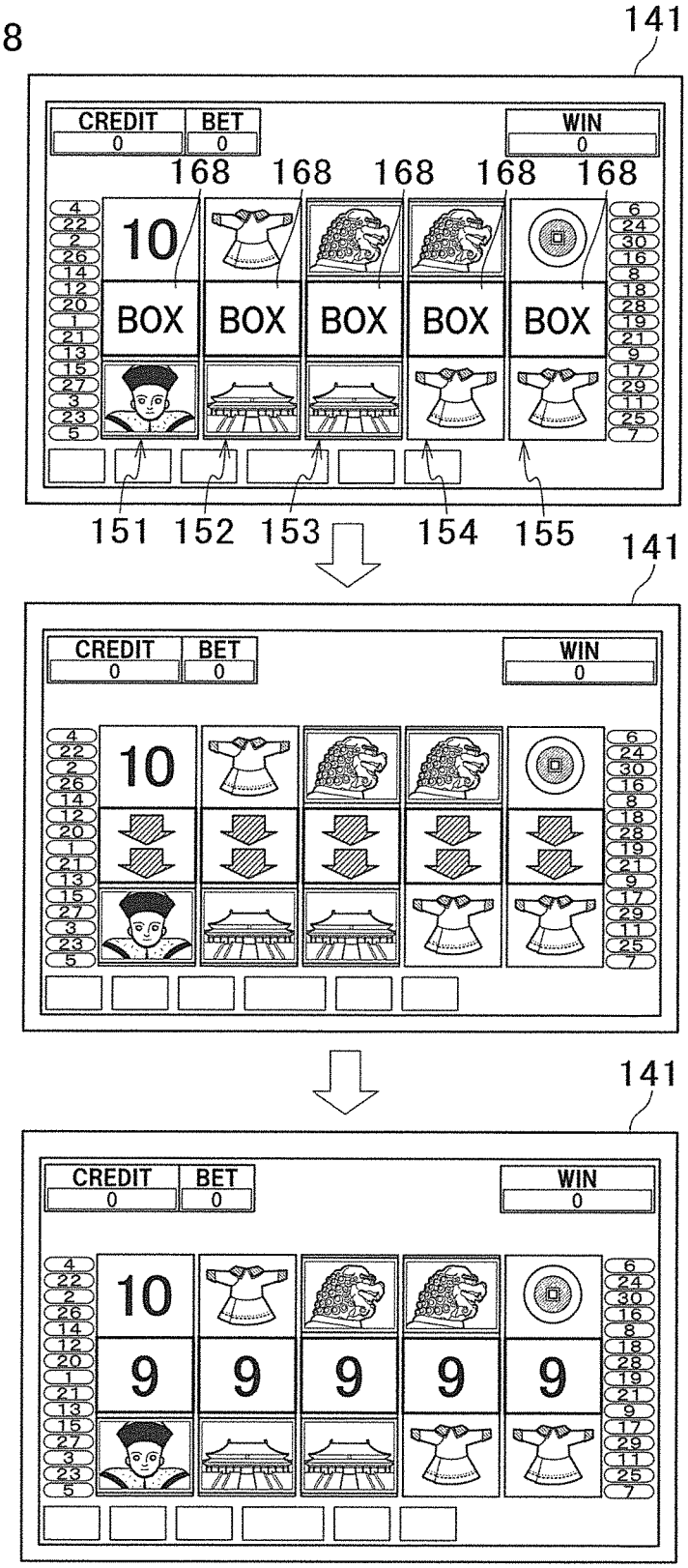
FIG. 18 shows an example of an image displayed on a lower image display panel in a main control process.

The main CPU 71 then executes box random determination process (S14). In this box random determination process, symbols displayed on box symbols 168 which are provided in each of the first video reel 151, the second video reel 152, the third video reel 153, the fourth video reel 154, and the fifth video reel 155 are randomly determined (see FIG. 18). In this regard, each of the randomly-determined symbols displayed on all box symbols 168 is one of "J", "Q", "9", "A", "10", "CURRENCY 161", "DRESS 162", "DRAGON 163", "CASTLE 164", "EMPEROR 165", "WILD 166", and "BONUS 167". More specifically, as shown in FIG. 18, when the box symbols 168 are displayed, the symbols "J", "9", "A", "10", "CURRENCY 161", "DRESS 162", "DRAGON 163", "CASTLE 164", "EMPEROR 165", "WILD 166", and "BONUS 167" scroll downward in each of these box symbols 168. Then the scroll stops and a symbol is displayed on each of the box symbol 168 ("9" is displayed in the example of FIG. 18). While in the present embodiment only one type of symbol is displayed on all box symbols 168 after the random determination, differently symbols may be displayed in the respective box symbols 168 after the random determination.

The main CPU 71 then executes a symbol random determination process (S15). In the process, to-be stopped symbol is determined based on the random numbers for symbol determination.

Specifically, the main CPU 71 first samples random numbers for symbol determination. The main CPU 71 then randomly determines to-be stopped symbol for the video reels 151-155. The main CPU 71 executes random determination for each of the video reels 151-155, and determines any one of the 22 symbols as the to-be stopped symbol.

The main CPU 71 then executes an effect contents determination process (S16). The main CPU 71 samples a random value for effect, and randomly selects any of the effect contents from the preset plurality of effect contents.

Figure 19:
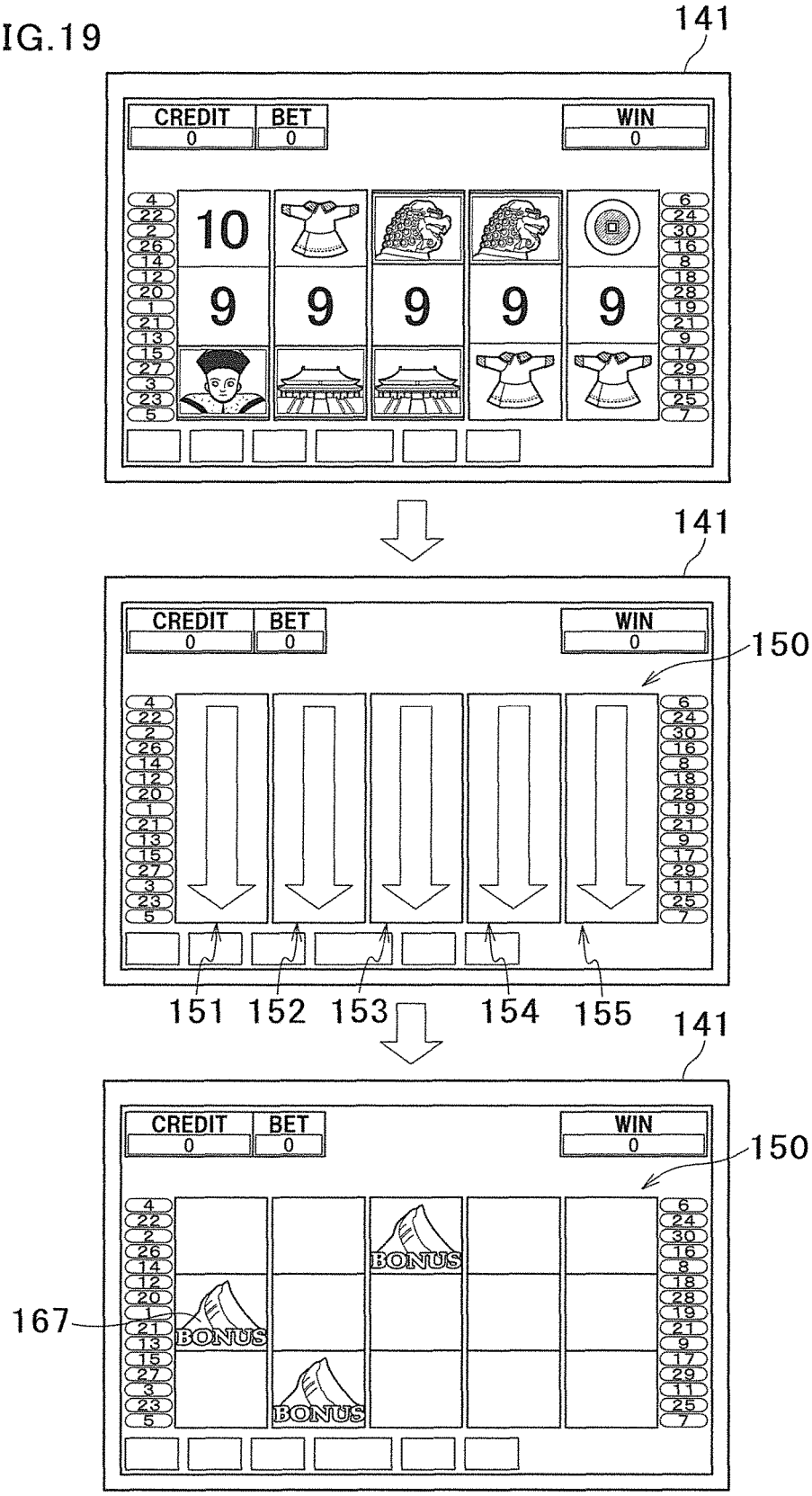
FIG. 19 shows an example of an image displayed on the lower image display panel in the main control process.

Next, the main CPU 71 executes the symbol display control process (S17). In the process, the scroll of the symbol column of each video reel 151-155 is started, and the to-be stopped symbol determined in the symbol random determination process of S14 is stopped at a predetermined position (e.g. the upper area in the display window 150), as shown in FIG. 19. That is, fifteen symbols including the to-be stopped symbol are displayed in the display window 150.

The main CPU 71 then executes the payout determination process (S18). In this process, the payout determination table 191 in the RAM 73 is referred to, and the payout amount is determined based on a combination of the symbols displayed on an active payline 300, and the payout amount thus determined is stored in the payout amount storage area in the RAM 73.

Next, the main CPU 71 determines whether or not bonus game trigger is met (S19). As shown in FIG. 19, a trigger of the shifting to the bonus game in the present embodiment is rearrangement of at least one symbol BONUS 167 in the display block 28 of each of the first video reel 151, the second video reel 152, and the third video reel 153. When the bonus game trigger has been met (S19: YES), the main CPU 71 executes the later-described bonus game process (S20).

Thereafter, after the step S20 or when it is determined in the step S19 that the bonus game trigger is not established (S19: NO), the main CPU 71 determines whether there is a payout (S21). That is to say, whether a payout has been awarded in S18 or S21 is determined. When there is a payout (S21: YES), a payout process is executed (step S22). The main CPU 71 adds the value stored in the payout amount storage area to the value stored in the credit amount storage area provided in the RAM 73. Alternatively, the hopper 113 may be driven based on an input to the collect switch 32S, and coins are discharged to the coin tray 18 according to the value stored in the payout amount storage area. After this process or when it is determined in S21 that there is no payout (S21: NO), the process proceeds to the step S12.

(Coin-Insertion/Start-Check Process)

Figure 13:
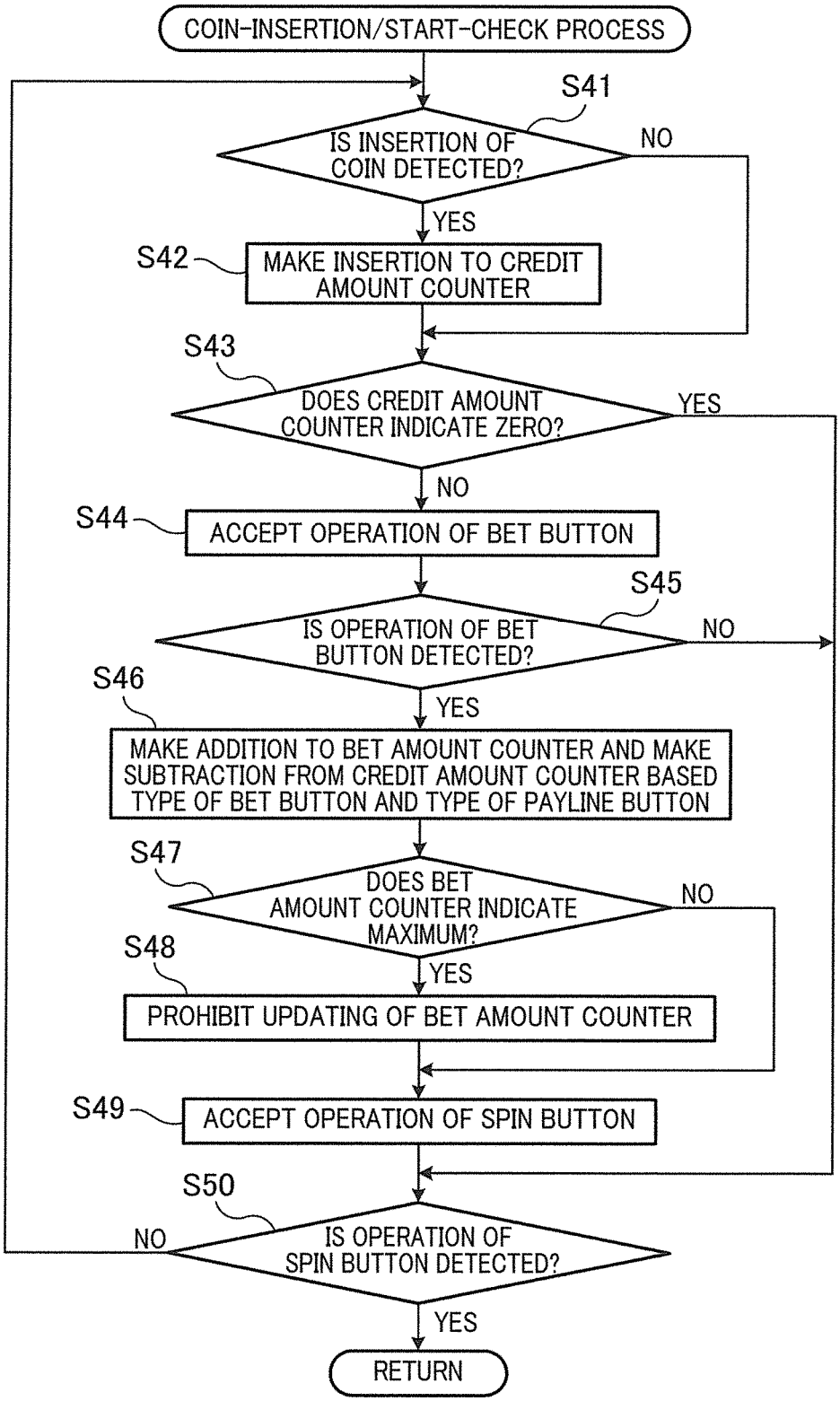
FIG. 13 is a flowchart of a coin-insertion/start-check process of the slot machine of First Embodiment.

Next, with reference to FIG. 13, the coin-insertion/start-check process is described.

First, the main CPU 71 determines whether or not insertion of a coin has been detected by the coin counter 92C (S41). When determining that the insertion of a coin has been detected by the coin counter 92C, the main CPU 71 makes addition to the value stored in the credit amount storage area (S42). It is to be noted that the main CPU 71 may determine whether or not insertion of a bill has been detected by the bill entry 115, and when determining that the insertion of a bill has been detected, the main CPU 71 may add a value according to the bill to the value stored in the credit amount storage area.

After S42 or when determining in S41 that the insertion of a coin has not been detected, the main CPU 71 determines whether or not the value stored in the credit amount storage area is zero (S43). When the main CPU 71 determines that the value stored in the credit amount storage area is not zero, the main CPU 71 permits operation acceptance of the bet buttons (1-bet button 34, 2-bet button 35, 3-bet button 37, 4-bet button 38, 5-bet button 39, and max-bet button 45) (S44). Note that, in S44, an operation of the payline button (play-2-lines button 40, play-10-lines button 41, play-20-lines button 42, and play-30-lines button 43) is enabled. Operation of the payline button enables activation of a desirable number of paylines 300.

Next, the main CPU 71 determines whether or not operation of any of the BET buttons has been detected (S45). When the main CPU 71 determines that the bet switch (1-bet switch 34S, 2-bet switch 35S, 3-bet switch 37S, 4-bet switch 38S, 5-bet switch 39S, and max-bet switch 45S) has detected the pressing of the BET button by the player, the main CPU 71 makes addition to a value stored in a bet amount storage area provided in the RAM 73 and makes subtraction from the value stored in the credit amount storage area, based on the type of the bet button and the type of the payline button (S46).

The main CPU 71 then determines whether or not the value stored in the bet amount storage area is at its maximum (S47). The main CPU 71, when determining that the value stored in the bet amount storage area is the maximum value, prohibits updating of the value stored in the bet amount storage area (S48). After S48 or when determining in S47 that the value stored in the bet amount storage area is not at its maximum, the main CPU 71 permits operation acceptance of the start button 46 (S49).

After S49, when determining in S45 that the operation of any of the BET buttons has not been detected, or when determining in S43 that the value stored in the credit amount storage area is zero, the main CPU 71 determines whether or not operation of the start button 46 has been detected (S50). The main CPU 71 shifts the process to S41, when determining that no operation of the start button 46 is detected.

When the main CPU 71 determines that the operation of the start button 46 has been detected, the coin-insertion/start-check process is ended.

(Bonus Game Process)

Figure 14:
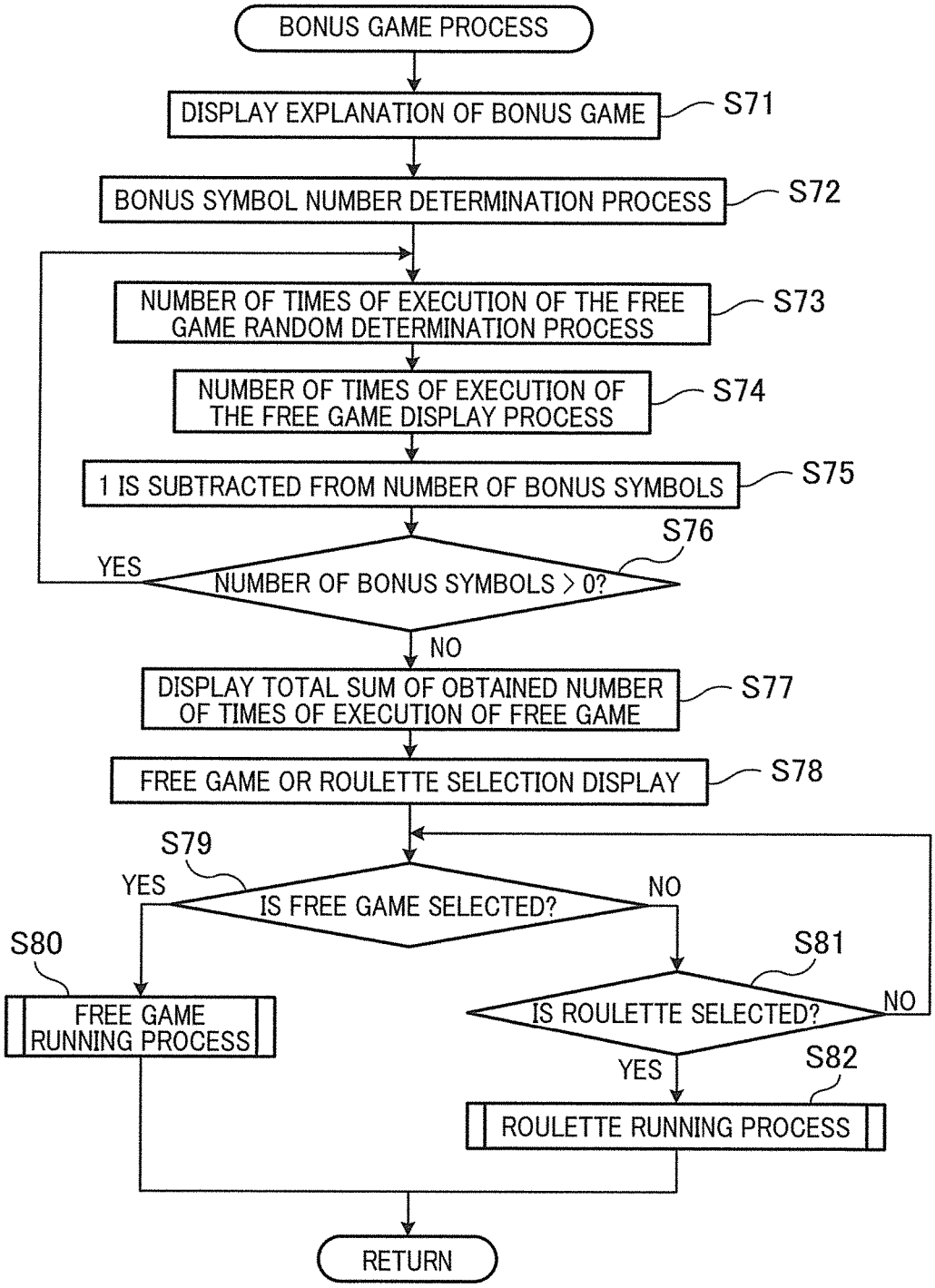
FIG. 14 is a flowchart of a bonus game process of the slot machine of First Embodiment.

Now, referring to FIG. 14, the bonus game process will be described. The bonus game process is, as shown in FIG. 12, executed on condition that the bonus game trigger is established in the main control process (see the step S20).

Figure 20:
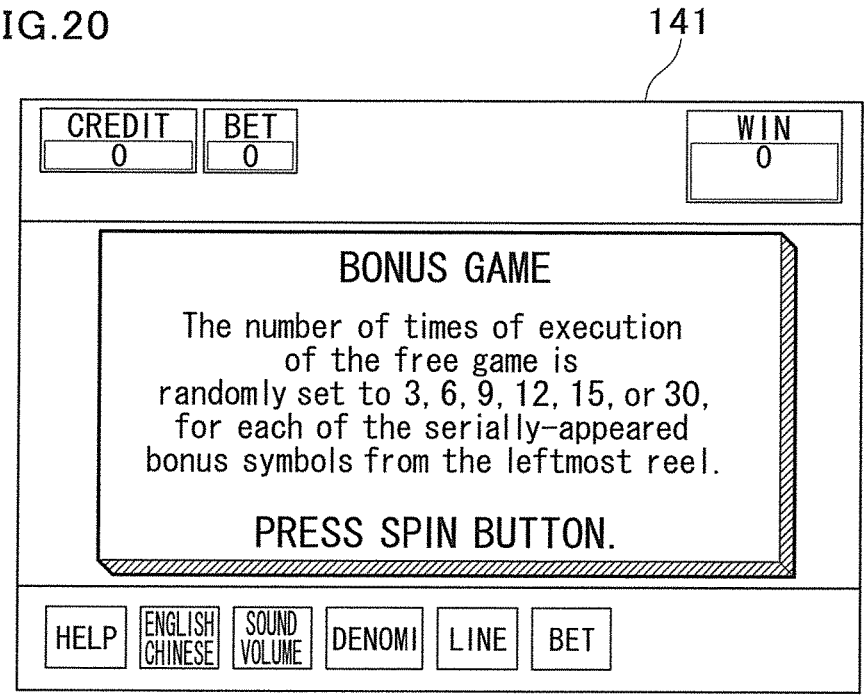
FIG. 20 shows an example of an image displayed on the lower image display panel in a bonus game process.

To begin with, as shown in FIG. 20, the main CPU 71 displays, on the lower image display panel 141, a screen describing the content of the bonus game (S71: bonus game description display). In the bonus game description display, the player is prompted to press the spin button 46.

Subsequently, the main CPU 71 executes a bonus symbol number determination process when the spin button 46 is pressed (S72). In this bonus symbol number determination process, how many symbols BONUS 167 are displayed in the display window 150 when the bonus game trigger is established is determined. In this determination, which one of the numbers, three to fifteen, the number of the symbol BONUS 167 is, is determined. For example, in the case of FIG. 19, it is determined that three symbols BONUS 167 are rearranged in the display window 150. The number of the symbols BONUS 167 determined in the bonus symbol number determination process is stored in the RAM 73.

Subsequently, the main CPU 71 executes a number of times of execution of free game random determination process to determine the number of times of execution of the free game to be awarded (S73). In the number of times of execution of free game random determination process, the number of times of execution of the free game is randomly determined based on the symbols BONUS 167 rearranged in the display window 150, serially in the order of "1" to "15" displayed in the display block 28 of the display window 150 shown in FIG. 21.

Figure 21:
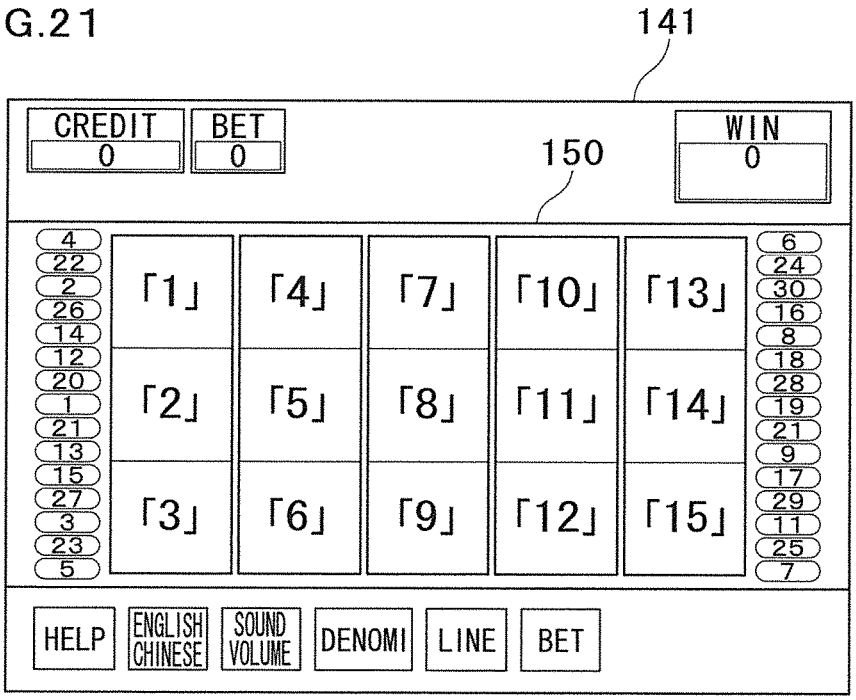
FIG. 21 is an explanatory diagram of the bonus game process.

More specifically, because in the present embodiment the symbols BONUS 167 are rearranged in the positions "2", "6", and "7" as shown in FIG. 19 and FIG. 21, the random determination of the number of times of execution of the free game is performed first for the symbol BONUS 167 at "2". In this random determination of the number of times of execution of the free game, a random determination table in the bonus game number random determination table 192, which corresponds to the number of the bonus symbols 167 determined in S72, is referred to. For example, as shown in FIG. 19, because in the present embodiment the number of the bonus symbols 167 is determined as three in S72, a "Very_Low" random determination table in the bonus game number random determination table 192 shown in FIG. 10 is referred to. As shown in FIG. 10, when in S72 the number of the bonus symbols 167 is determined as 3 to 5, the "Very_Low" random determination table in the bonus game number random determination table 192 is referred to. When the number of the bonus symbols 167 is determined as 6 to 8, a "Low" random determination table in the bonus game number random determination table 192 is referred to. When the number of the bonus symbols 167 is determined as 9 to 10, a "Middle" random determination table in the bonus game number random determination table 192 is referred to. When the number of the bonus symbols 167 is determined as 11 to 12, a "High" random determination table in the bonus game number random determination table 192 is referred to. When the number of the bonus symbols 167 is determined as 13 to 14, a "Very_High" random determination table in the bonus game number random determination table 192 is referred to. When the number of the bonus symbols 167 is determined as 15, an "EXTRA" random determination table in the bonus game number random determination table 192 is referred to.

Subsequently, the main CPU 71 executes a number of times of execution of free game display process (S74). In the number of times of execution of free game display process, the number of times of execution of the free game randomly determined in S73 is displayed on the front surface of the bonus symbol 167 as shown in (22-1) in FIG. 22 ("3" is displayed in the present embodiment). In addition to the above, in an awarded number of times of execution of the free game display window 170, the total sum of the numbers of times of execution of the free game awarded in the bonus game process is displayed. In the present embodiment, the number "3" is displayed on the display window 170 shown in (22-1) in FIG. 22.

Subsequently, the main CPU 71 updates the number of symbols BONUS 167 stored in the RAM 73 by subtracting one therefrom (S75). In the present embodiment, the number of the symbols BONUS 167 stored in the RAM 73 is updated to 2 such that 1 is subtracted from 3 which is the number having been stored as the number of symbols.

Subsequently, the main CPU 71 determines whether the number of the symbols BONUS 167 updated in S75 is larger than 0 (S76). Because in the present embodiment the number of the symbols BONUS 167 updated in S75 is 2, the result of the determination is larger than 0, and the process proceeds to S73.

In S73, the main CPU 71 again executes the number of times of execution of free game random determination process for determining the number of times of execution of the free game to be awarded (S73). In this number of times of execution of free game random determination process, in case of FIG. 19 and FIG. 21, the number of times of execution of the free game is randomly determined for the symbol BONUS 167 at "6".

Thereafter, the main CPU 71 executes the number of times of execution of free game display process as described above (S74). In the number of times of execution of free game display process, the number of times of execution of the free game awarded as a result of the random determination in S73 is displayed on the front surface of the bonus symbol 167 as shown in (22-2) in FIG. 22 ("6" is displayed in the present embodiment). In the awarded number of times of execution of the free game display window 170, the total sum of the numbers of times of execution of the free game awarded in the bonus game process is displayed. In the present embodiment, "9 (3+6)" is displayed in the display window 170 shown in (22-2) in FIG. 22.

Subsequently, the main CPU 71 updates the number of the symbols BONUS 167 stored in the RAM 73 by subtracting 1 therefrom (S75). In the present embodiment, the value "1" calculated by subtracting 1 from the number "2" of the symbols BONUS 167 stored in the RAM 73, and this value is used as an updated value of the number of the symbols BONUS 167.

Subsequently, the main CPU 71 again determines whether the number of the symbols BONUS 167 is larger than 0 (S76). In the present embodiment, because the number of the symbols BONUS 167 updated in S75 is 1, the number is larger than 0 and the process proceeds to S73.

after the shifting to S73, the main CPU 71 again executes the number of times of execution of free game random determination process for determining the number of times of execution of the free game to be awarded (S73). In this number of times of execution of free game random determination process, in cases of FIG. 19 and FIG. 21, the number of times of execution of the free game is randomly determined for the symbol BONUS 167 at "7".

Then the main CPU 71 executes, as described above, the number of times of execution of free game display process (S74). In the number of times of execution of free game display process, the number of times of execution of the free game awarded as a result of the random determination in S73 is displayed on the front surface of the bonus symbol 167 as shown in (22-3) in FIG. 22 ("3" is displayed in the present embodiment). Furthermore, in the awarded number of times of execution of the free game display window 170, the total sum of the numbers of times of execution of the free game awarded in the bonus game process is displayed. In the present embodiment, "12 (3+6+3)" is displayed in the display window 170 shown in (22-3) in FIG. 22.

Subsequently, the main CPU 71 updates the number of the symbols BONUS 167 stored in the RAM 73 by subtracting 1 therefrom (S75). In the present embodiment, a value "0" calculated by subtracting 1 from 1 which is the number of the symbols BONUS 167 stored in the RAM 73 is set as the updated number of the symbols BONUS 167.

Subsequently, the main CPU 71 again determines whether the number of the symbols BONUS 167 updated in S75 is larger than 0 (S76). In the present embodiment, the number of the symbols BONUS 167 updated in S75 is 0 and therefore the number is determined as not larger than 0 (S76: NO).

Figure 23:
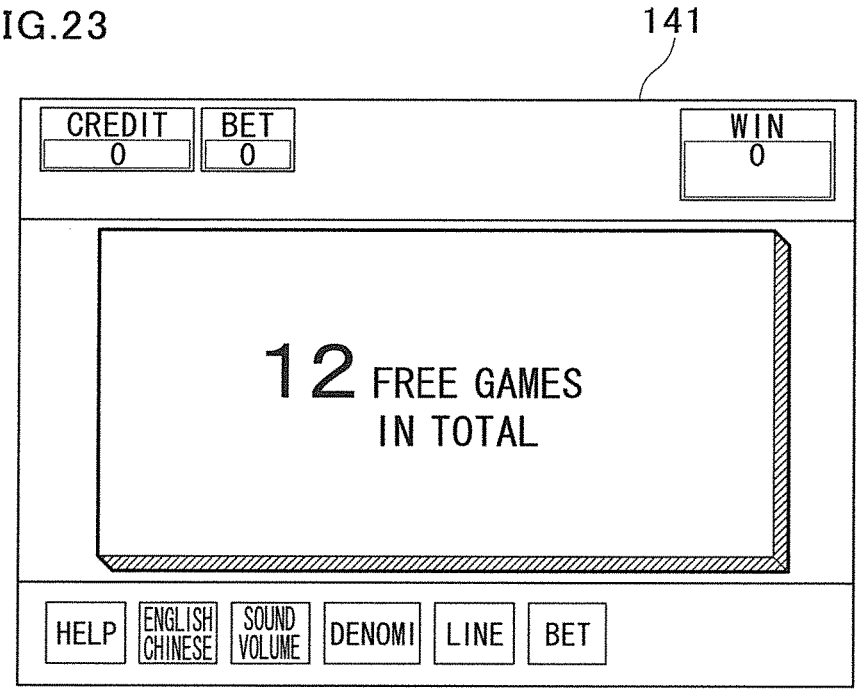
FIG. 23 shows an example of an image displayed on the lower image display panel in the bonus game process.

When the number of the symbols BONUS 167 updated in S75 is not larger than 0 (S76: NO), as shown in FIG. 23, the total sum of the numbers of times of execution of the free game awarded in the bonus game process is displayed on the front surface of the lower image display panel 141 (S77). In the present embodiment, on the front surface of the lower image display panel 141 a value "12" which is the total sum of the numbers of times of execution of the free game awarded in the bonus game process is displayed.

Figure 24:
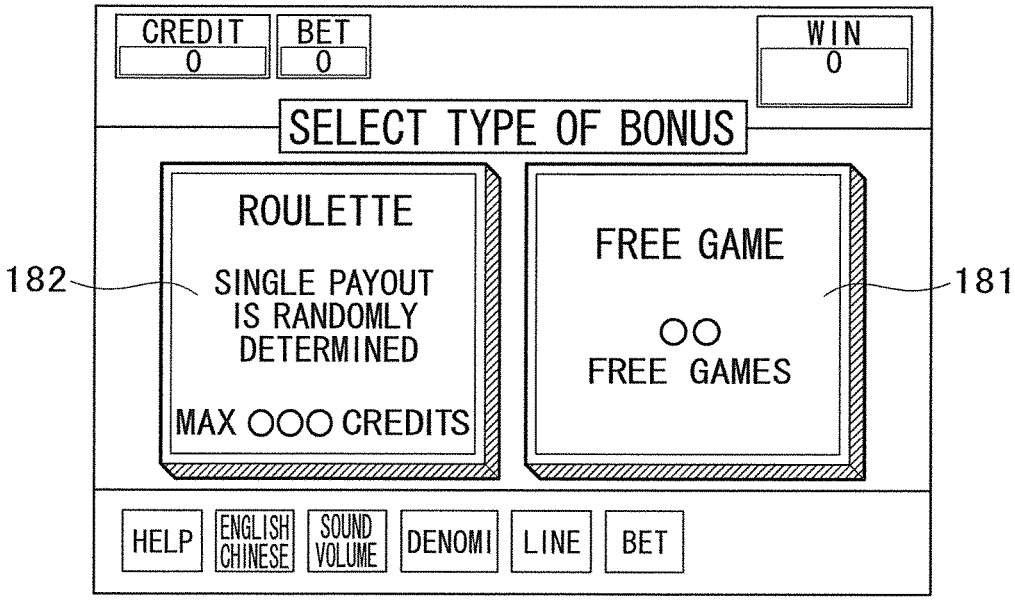
FIG. 24 shows an image displayed on the lower image display panel in the bonus game process.

Subsequently, as shown in FIG. 24, on the lower image display panel 141, a free game selection button 181 for executing the free game for the awarded number of times and a roulette selection button 182 for running a roulette game in which a payout is awarded after the execution of random determination once are displayed (S78). On the lower image display panel 141, a message encouraging the player to select one of the free game selection button 181 and the roulette selection button 182 is displayed.

Alternatively, on the lower image display panel 141, an estimated termination time which indicates when the running of the free game for the awarded number of times ends may be displayed when the free game selection button 181 and the roulette selection button 182 are displayed. For example, a value calculated by multiplying a (predetermined) time required to run the free game once by the awarded number of times of execution of the free game is converted to time and displayed.

Subsequently, the main CPU 71 determines whether the free game selection button 181 is selected (S79). When the free game selection button 181 is selected (S79: YES), a later-described free game running process is executed (S80).

In the meanwhile, when the free game selection button 181 is not selected (S79: NO), whether the roulette selection button 182 is selected is determined (S81).

When the roulette selection button 182 is not selected (S81: NO), the process goes back to S79.

When the roulette selection button 182 is selected (S81: YES), a later-described roulette running process is executed (S82).

After S80 or S82, the process is terminated.

When the awarded number of times of execution of the free game is equal to or larger than a predetermined number (which is optionally set), the free game selection button 181 for executing the free game for the awarded number of times and the roulette selection button 182 for running a roulette game in which a payout is awarded after the execution of random determination once may be displayed on the lower image display panel 141.

(Free Game Running Process)

Figure 15:
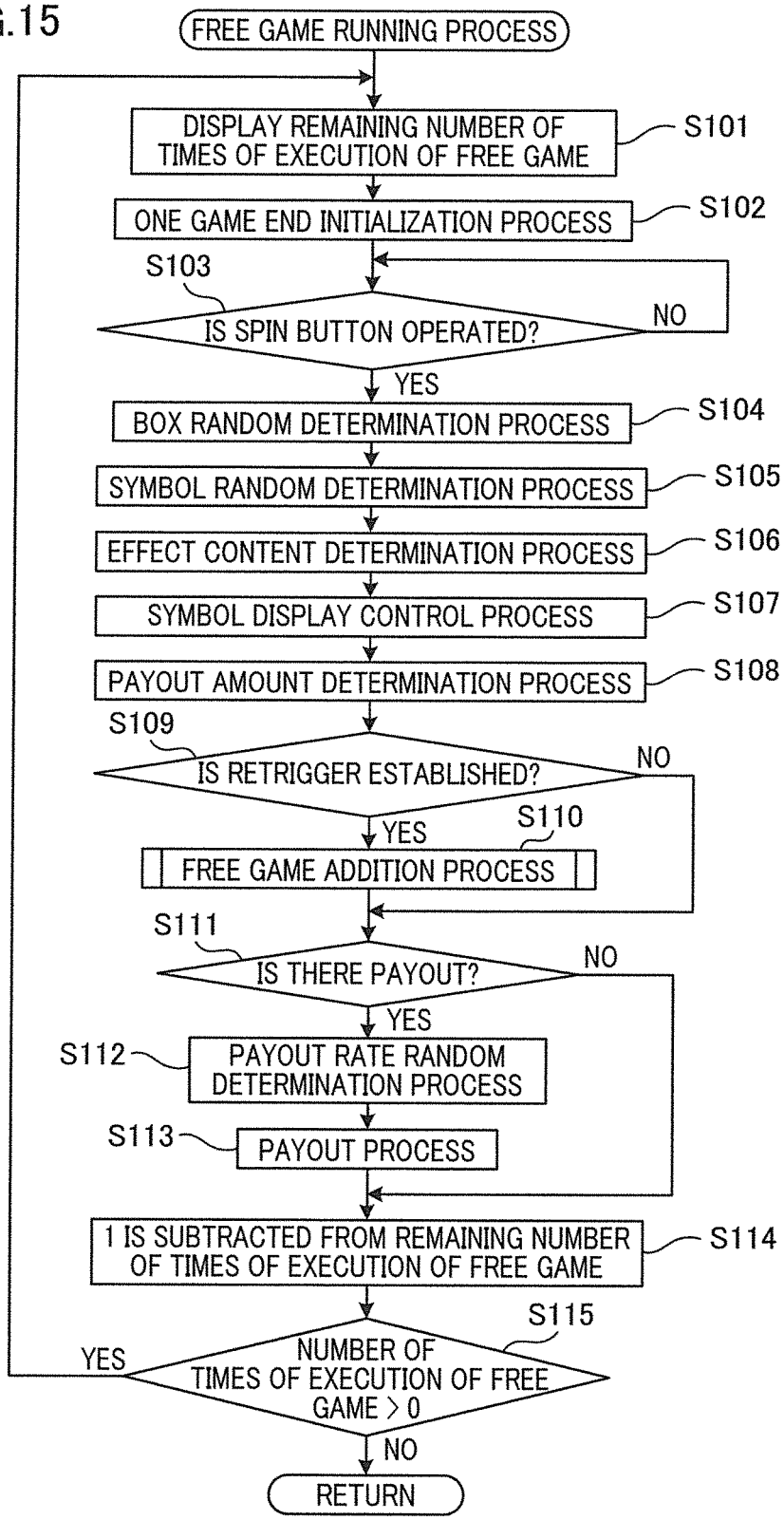
FIG. 15 is a flowchart of a free game running process of the slot machine of First Embodiment.

Now, the free game running process will be described with reference to FIG. 15. As shown in FIG. 14, the free game running process is executed when the free game selection button 181 is selected in the bonus game process (see the step S80). In the free game (equivalent to the bonus game) in the present embodiment, a slot game is run in the same manner as in the normal game.

Figure 25:
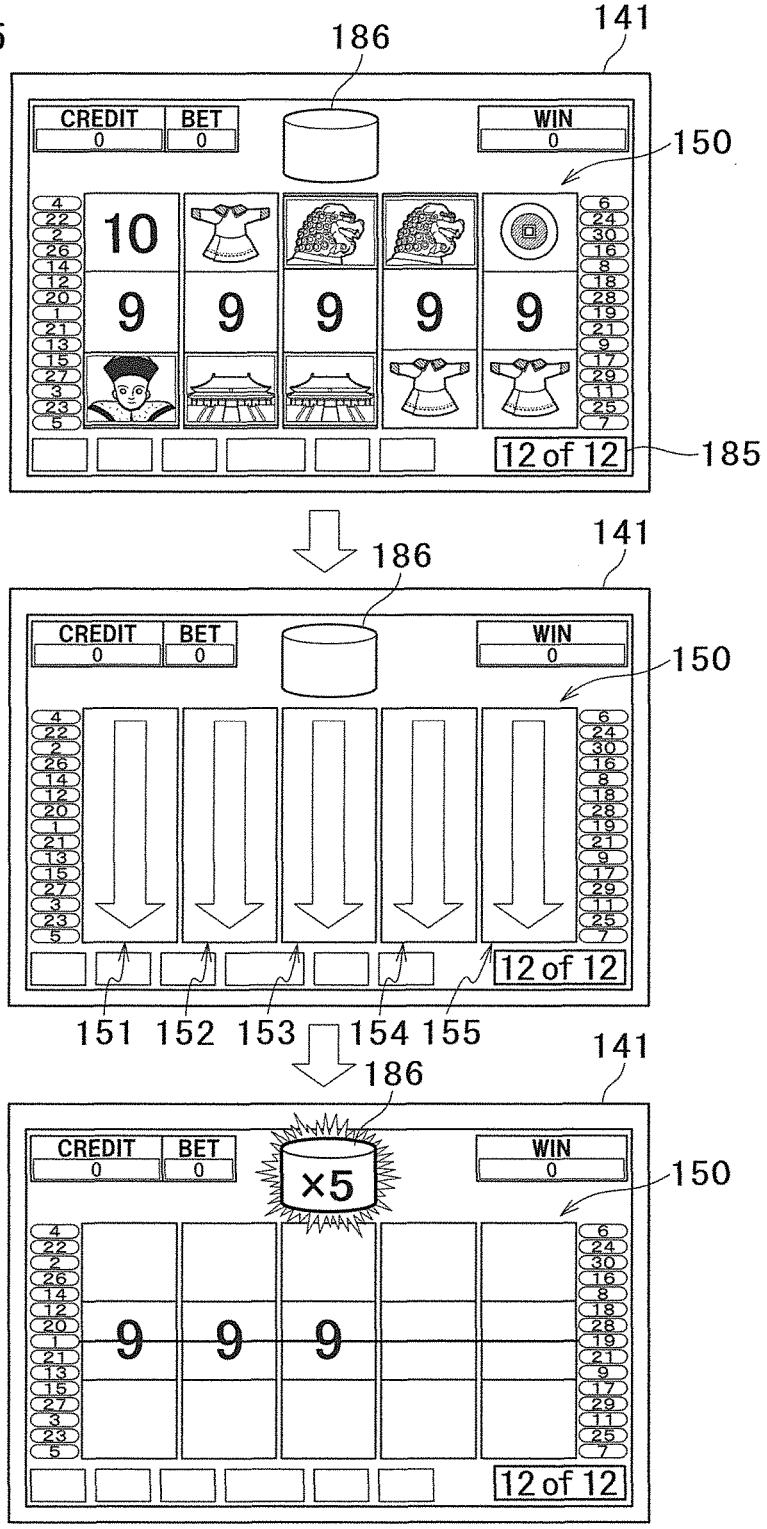
FIG. 25 shows an example of an image displayed on the lower image display panel in a free game running process.

To begin with, as shown in FIG. 25, the number of times of execution of the free game obtained in the bonus game process is displayed on a remaining number of times of execution of the free game display window 185 (S101). In the present embodiment, as shown in FIG. 23, "12 of 12" is displayed on the remaining number of times of execution of the free game display window 185 because the awarded number of times of execution of the free game is twelve as shown in FIG. 23. The remaining number of times of execution of the free game is stored in the RAM 73.

Subsequently, the main CPU 71 executes a one game end initialization process (step S102). For example, a set of data which becomes redundant in the working area of the RAM 73 such as randomly-selected symbols each time a game is executed is deleted.

Subsequently, the main CPU 71 determines whether the spin button 46 is pressed (S103). When the spin button 46 is not pressed (S103: NO), the process becomes on standby.

In the meanwhile, when the spin button 46 is pressed (S103: YES), the main CPU 71 executes a box random determination process (S104). This box random determination process is identical with the process executed in S14 of the main control process described above. The random determination table of the symbols displayed in the box symbol 168 may be different from the table which is referred to in the main control process.

Subsequently, the main CPU 71 executes a symbol random determination (S105). In this process, the to-be stopped symbol is determined based on a symbol determination random number.

More specifically, to begin with, the main CPU 71 samples a random number for determining symbols. Subsequently, the main CPU 71 randomly selects to-be stopped symbol for each of the video reels 151 to 155. The main CPU 71 performs random determination for each of the video reels 151 to 155, and one of 22 symbols is selected as the to-be stopped symbol.

Subsequently, the main CPU 71 executes an effect content determination process (step S106). The main CPU 71 samples an effect-use random number and randomly selects one of predetermined effect contents.

Subsequently, the main CPU 71 executes a symbol display control process (step S107). In this process, as shown in FIG. 25, the symbol column of each of the video reels 151 to 155 starts to scroll, and the symbols of the to-be stopped symbol selected in the symbol random determination in step S105 stops at a predetermined position (e.g., at the upper row in the display window 150). In other words, 15 symbols including the to-be stopped symbol are displayed in the display window 150.

Subsequently, the main CPU 71 executes a payout amount determination process (step S108). In this process, the payout amount is determined based on the combination of the symbols displayed on the display window 150, and the determined amount is stored in a payout amount storage area in the RAM 73.

Figure 26:
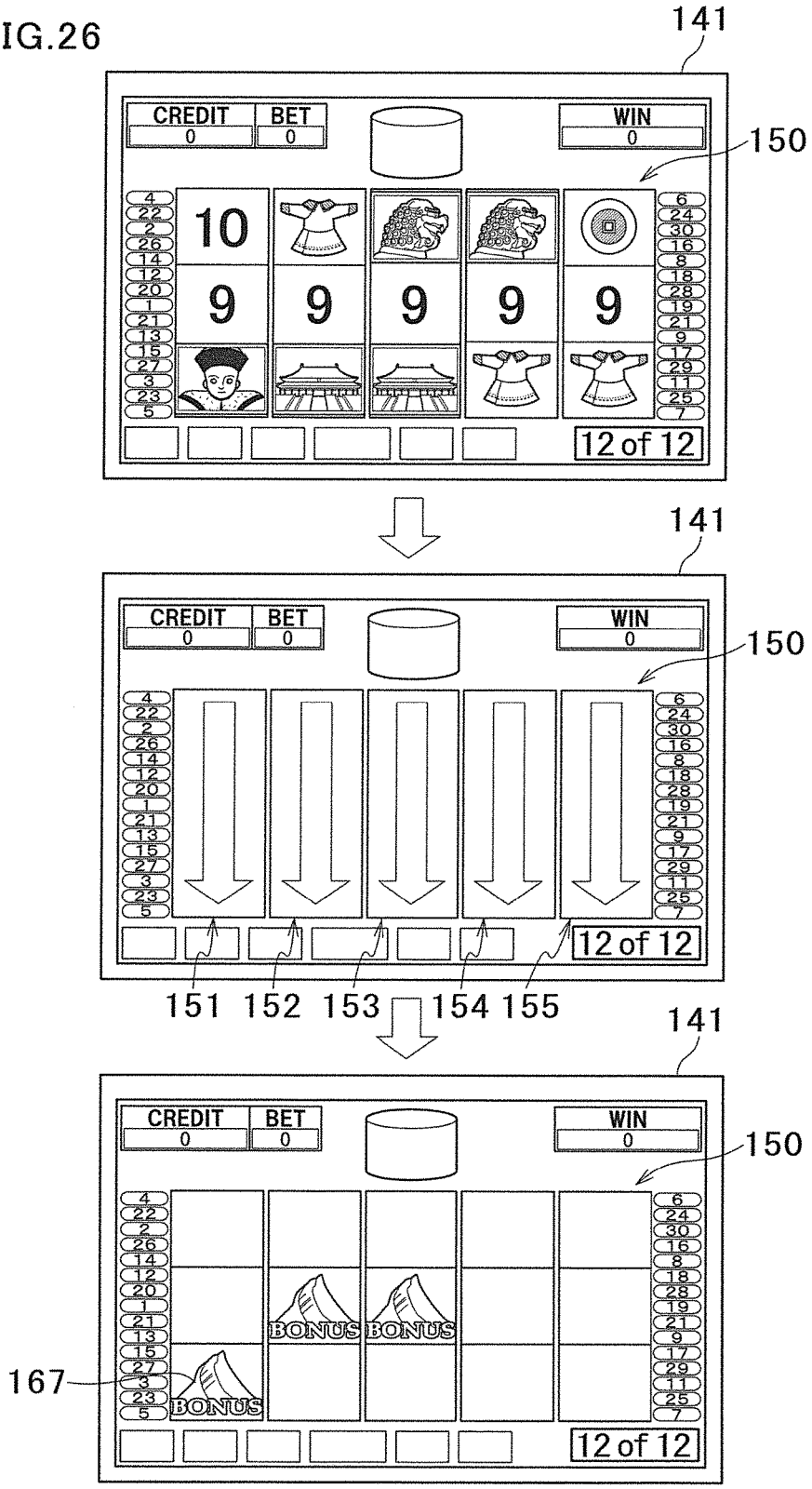
FIG. 26 shows an example of an image displayed on the lower image display panel in the free game running process.

Subsequently, the main CPU 71 determines whether re-trigger is established (step S109). As shown in FIG. 26, the re-trigger with which the number of times of execution of the free game is increased in the present embodiment indicates that at least one symbol BONUS 167 is rearranged in each of the display blocks 28 of the first video reel 151, the second video reel 152, and the third video reel 153. When the re-trigger is established (S109: YES), the main CPU 71 executes a later-described free game addition process (step S110).

Subsequently, after S110 or when it is determined in the step S109 that the re-trigger is not established (S109: NO), the main CPU 71 determines whether a payout is necessary (S111). In other words, whether a payout has been awarded in S108 is determined. When there is a payout (S111: YES), a payout rate random determination process is executed so that the payout rate of the payout is randomly determined (S112).

In this payout rate random determination process, the main CPU 71 randomly sets the payout rate of the payout to one of "×2", "×3", "×4", and "×5". As shown in FIG. 25, the selected payout rate is displayed on a payout rate display window 186 ("×5" is displayed in FIG. 25).

Then a payout process is executed (S113). In this payout process, a value calculated by multiplying the payout determined in S108 by the payout rate determined in S112 is awarded to the player as a final payout. For example, when the payout determined in S108 is 100 credits and the payout rate determined in S112 is "×5", 500 credits (100×5=500) are awarded to the player as the final payout.

Subsequently, after S113 or when there is on payout in S111 (S111: NO), the main CPU 71 updates the remaining number of times of execution of the free game stored in the RAM 73 by subtracting 1 therefrom (S114). For example, when the remaining number of times of execution of the free game stored in RAM 73 is "12", the remaining number of times of execution of the free game is updated to "11" as 1 is subtracted from 12.

Subsequently, the main CPU 71 determines whether the remaining number of times of execution of the free game updated in S114 is larger than 0 (S115). When the remaining number of times of execution of the free game is larger than 0 (S115: YES), the process proceeds to S101.

In the meanwhile, when the remaining number of times of execution of the free game is not larger than 0 (S115: NO), the process is terminated.

(Free Game Addition Process)

Figure 16:
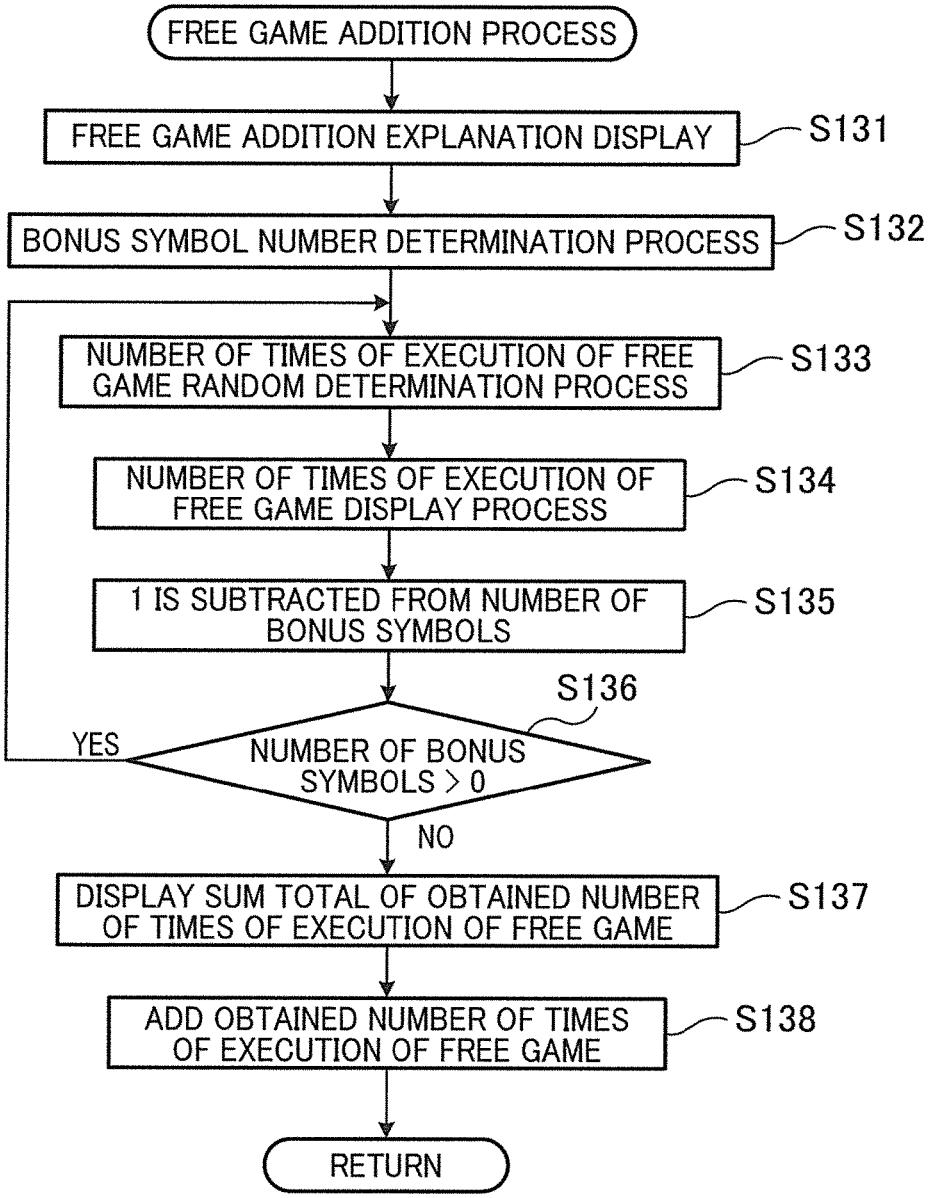
FIG. 16 is a flowchart of a free game addition process of the slot machine of First Embodiment.

Now, a free game addition process will be described with reference to FIG. 16. As shown in FIG. 15, the free game addition process is executed when the re-trigger is established in the free game running process (see the step S110).

To begin with, the main CPU 71 displays, on the lower image display panel 141, a screen explaining the addition to the free game (S131: free game addition explanation display). In the free game addition explanation display, the player is prompted to press the spin button 46.

Subsequently, when the spin button 46 is pressed, the main CPU 71 executes a bonus symbol number determination process (S132). In this bonus symbol number determination process, how many symbols BONUS 167 are rearranged on the display window 150 when the re-trigger is established is determined. In this connection, the number of the symbols BONUS 167 falls within the range of 3 to 15. For example, in FIG. 26, it is determined that three symbols BONUS 167 are rearranged in the display window 150. The number of the symbols BONUS 167 determined in the bonus symbol number determination process is stored in the RAM 73.

Subsequently, the main CPU 71 executes a number of times of execution of free game random determination process of determining the number of times of execution of the free game to be added (S133). In the number of times of execution of free game random determination process, the number of times of execution of the free game for the symbols BONUS 167 rearranged on the display window 150 is randomly determined serially in the order of "1" to "15" displayed in the display block 28 of the display window 150 shown in FIG. 21.

More specifically, in the present embodiment, as the symbols BONUS 167 are provided at "3", "5", and "8" in FIG. 26 and FIG. 21, the random determination of the number of times of execution of the free game is performed first for the symbol BONUS 167 at "3". In this random determination of the number of times of execution of the free game, a random determination table of the bonus game number random determination table 192 which corresponds to the number of the bonus symbols 167 determined in S132 is used. For example, in the present embodiment, as shown in FIG. 26, because the number of the bonus symbols 167 is determined as three in S132, a "Very_Low" random determination table in the bonus game number random determination table 192 shown in FIG. 10 is referred to.

Figure 27:
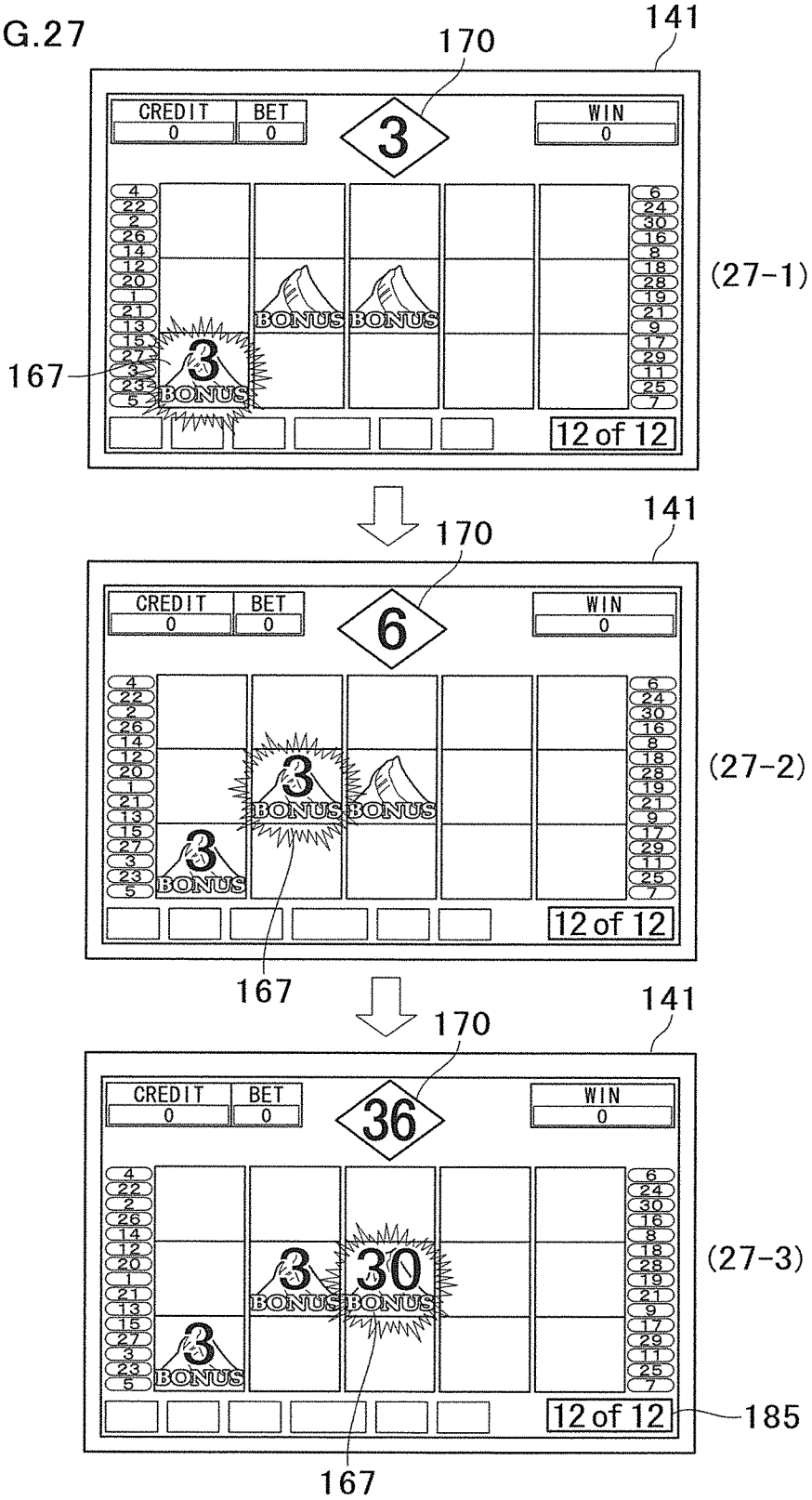
FIG. 27 shows an example of an image displayed on the lower image display panel in a free game addition process.

Subsequently, the main CPU 71 executes a number of times of execution of free game display process (S134). In the number of times of execution of free game display process, the number of times of execution of the free game awarded as a result of the random determination in S133 is displayed on the front surface of the bonus symbol 167 as shown in (27-1) in FIG. 27 ("3" is displayed in the present embodiment). In the awarded number of times of execution of the free game display window 170, the total sum of the numbers of times of execution of the free game awarded in the free game addition process is displayed. In the present embodiment, "3" is displayed in the display window 170 shown in (27-1) of FIG. 27.

Subsequently, the main CPU 71 updates the number of the symbols BONUS 167 stored in the RAM 73 by subtracting 1 therefrom (S135). In the present embodiment, the number of the symbols BONUS 167 stored in the RAM 73 is updated to 2 by subtracting 1 from 3.

Subsequently, the main CPU 71 determines whether the number of the symbols BONUS 167 updated in S135 is larger than 0 (S136). In the present embodiment, because the number of the symbols BONUS 167 updated in S135 is 2, the number is determined as larger than 0 and the process proceeds to S133.

Subsequently, after the shifting to S133, the main CPU 71 again executes the number of times of execution of free game random determination process of determining the number of times of execution of the free game to be awarded (S133). In this number of times of execution of free game random determination process, in case of FIG. 26 and FIG. 21, the number of times of execution of the free game is randomly determined for the symbol BONUS 167 at "5".

Thereafter, as described above, the main CPU 71 executes the number of times of execution of free game display process (S134). In the number of times of execution of free game display process, the number of times of execution of the free game awarded as a result of the random determination in S133 is displayed on the front surface of the bonus symbol 167 as shown in (27-2) in FIG. 27 ("3" is displayed in the present embodiment). Furthermore, on the awarded number of times of execution of the free game display window 170, the total sum of the numbers of times of execution of the free game awarded in the free game addition process is displayed. In the present embodiment, "6 (3+3)" is displayed on the display window 170 shown in (27-2) in FIG. 27.

Subsequently, the main CPU 71 updates the number of the symbols BONUS 167 stored in the RAM 73 by subtracting 1 therefrom (S135). In the present embodiment, the number of the symbols BONUS 167 stored in the RAM 73 is updated to 1 by subtracting 1 from 2.

Subsequently, the main CPU 71 again determines whether the number of the symbols BONUS 167 updated in S135 is larger than 0 (S136). In the present embodiment, because the number of the symbols BONUS 167 updated in S135 is 1, it is determined that the number is larger than 0 and the process proceeds to S133.

After the shifting to S133, the main CPU 71 again executes the number of times of execution of free game random determination process of determining the number of times of execution of the free game to be awarded (S133). In this number of times of execution of free game random determination process, in cases of FIG. 26 and FIG. 21, the number of times of execution of the free game is randomly determined for the symbol BONUS 167 at "8".

Then the main CPU 71 executes the number of times of execution of free game display process as described above (S134). In the number of times of execution of free game display process, the number of times of execution of the free game awarded as a result of the random determination in S133 is displayed on the front surface of the bonus symbol 167 as shown in (27-3) in FIG. 27 ("30" is displayed in the present embodiment). Furthermore, on the awarded number of times of execution of the free game display window 170, the total sum of the numbers of times of execution of the free game awarded in the free game addition process is displayed. In the present embodiment, "36 (3+3+30)" is displayed on the display window 170 shown in (27-3) in FIG. 27.

Subsequently, the main CPU 71 updates the number of the symbols BONUS 167 stored in the RAM 73 by subtracting 1 therefrom (S135). In the present embodiment, the number of the symbols BONUS 167 stored in the RAM 73 is updated to 0 as 1 is subtracted from 1.

Thereafter, the main CPU 71 again determines whether the number of the symbols BONUS 167 updated in S135 is larger than 0 (S136). In the present embodiment, because the number of the symbols BONUS 167 updated in S135 is 0, it is determined that the number of not larger than 0 (S136: NO).

Figure 28:
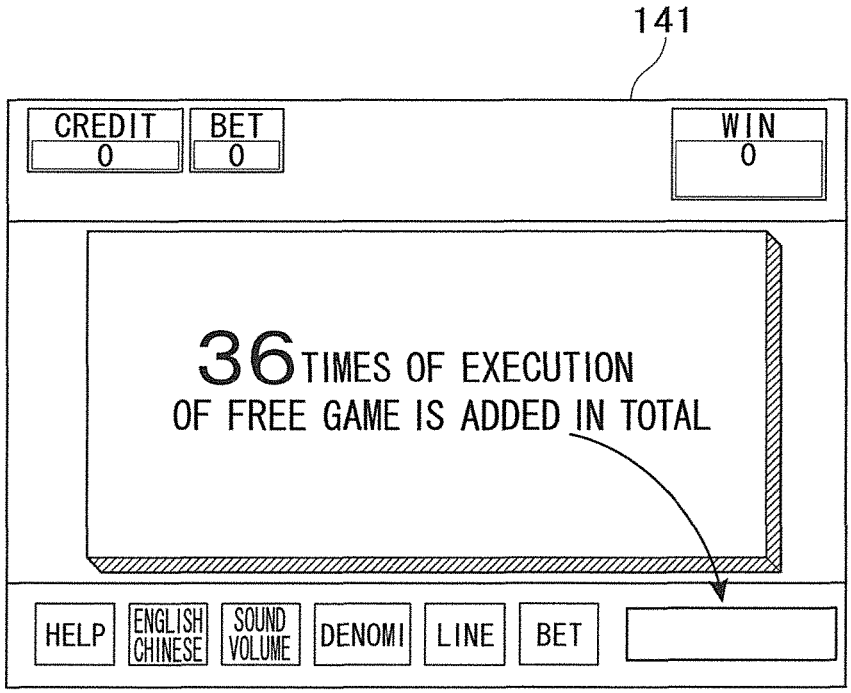
FIG. 28 shows an example of an image displayed on the lower image display panel in the free game addition process.

When the number of the symbols BONUS 167 updated in S135 is not larger than 0 (S136: NO), as shown in FIG. 28, the total sum of the numbers of times of execution of the free game awarded in the free game addition process is displayed on the front surface of the lower image display panel 141 (S137). In the present embodiment, the front surface of the lower image display panel 141 displays "36" which is the number of times of execution of the free game awarded in the free game addition process. Then the value "36" indicating the total sum of the number of times of execution of the free game awarded in the free game addition process is added to the remaining number of times of execution of the free game, and displayed on the remaining number of times of execution of the free game display window 185 (S138). The process is terminated after S138.

(Roulette Running Process)

Figure 17:
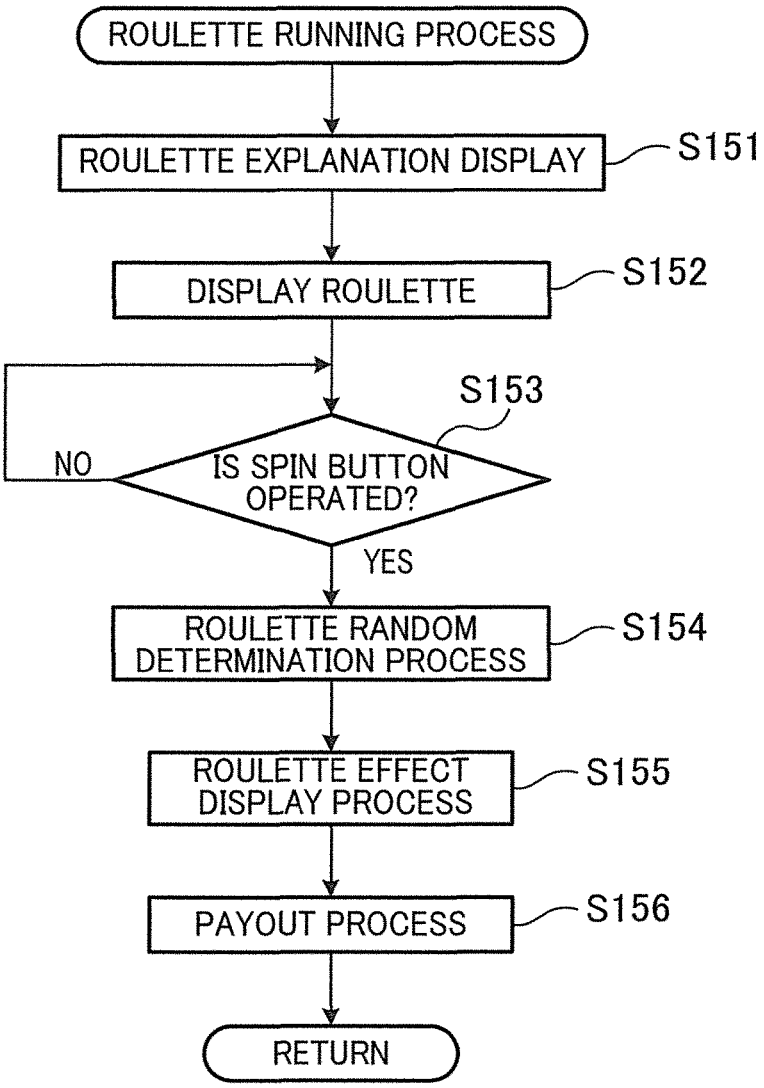
FIG. 17 is a flowchart of a roulette running process of the slot machine of First Embodiment.

Now, referring to FIG. 17, a roulette running process will be described. The roulette running process is, as shown in FIG. 14, executed when the roulette selection button 182 is selected in the bonus game process (see the step S82). While in the present embodiment the roulette game is executed as one-time game, the roulette game may be a different type of game on condition that benefit is awarded as a result of random determination once.

To begin with, the main CPU 71 displays, on the lower image display panel 141, a screen explaining the content of the roulette game (S151: roulette explanation display).

Subsequently, as shown in (29-1) in FIG. 29, on the lower image display panel 141, 10 targets 201A to 201J are displayed in a wheel-shaped manner (S152: roulette display). On each of these targets 201A to 201J, as described above, a payout credit is displayed. In the present embodiment, "10 credits" is displayed on the target 201A, "80 credits" is displayed on the target 201B, "20 credits" is displayed on the target 201C, "90 credits" is displayed on the target 201D, "30 credits" is displayed on the target 201E, "70 credits" is displayed on the target 201F, "40 credits" is displayed on the target 201G, "60 credits" is displayed on the target 201H, "100 credits" is displayed on the target 201I, and "50 credits" is displayed on the target 201J. In S152, a message prompting the player to press the spin button 46 is displayed on the lower image display panel 141.

Subsequently, the main CPU 71 determines whether the spin button 46 is pressed (S153). When the spin button 46 is not pressed (S153: NO), the process becomes on standby.

In the meanwhile, when the spin button 46 is pressed (S153: YES), the main CPU 71 executes a roulette random determination process (S154). In this process, with reference to a roulette payout table 193 (see FIG. 11), one of targets 201A to 201J is randomly selected based on a random number.

Subsequently, the main CPU 71 executes a roulette effect display process (step S155). In this process, as shown in (29-1) in FIG. 29, an effect is executed in such a way that, a light spot rotates on the targets 201A to 201J clockwise, and the light spot gradually slows down and stops at one of the targets 201A to 201J selected in the roulette random determination process in S154.

Subsequently, the main CPU 71 executes a payout process (step S156). In this process, a payout credit corresponding to one of the targets 201A to 201J selected in the roulette random determination process in S154 is multiplied by the total sum of the numbers of times of execution of the free game awarded in the bonus game process (see S77) and the bet amount (1-BET button 34, 2-BET button 35, 3-BET button 37, 4-BET button 38, 5-BET button 39, max bet button 45) received in the step S44, and the resultant payout is awarded to the player. The payout is stored in the payout amount storage area in the RAM 73. For example, when the target selected in the roulette random determination process in S154 is the target 201J, the total sum of the numbers of times of execution of the free game awarded in the bonus game process is 120 games, and the bet amount received in the step S44 is 3, the result of multiplying the payout "50 credits" corresponding to the target 201J by "120 games" and "3 bets" is 1800, and therefore 1800 credits are awarded to the player as the payout.

Furthermore, in S156, as shown in (29-3) in FIG. 29, the payout credit calculated in S156 is displayed on the lower image display panel 141. After S156, the roulette running process is terminated.

In S156 above, the expectation value of a payout awarded when the roulette game is selected may be set to a value calculated by multiplying an expectation value of a benefit awarded in response to the execution of the free game once by the awarded number of times of execution of the free game.

(Gamble Game)

Figure 30:
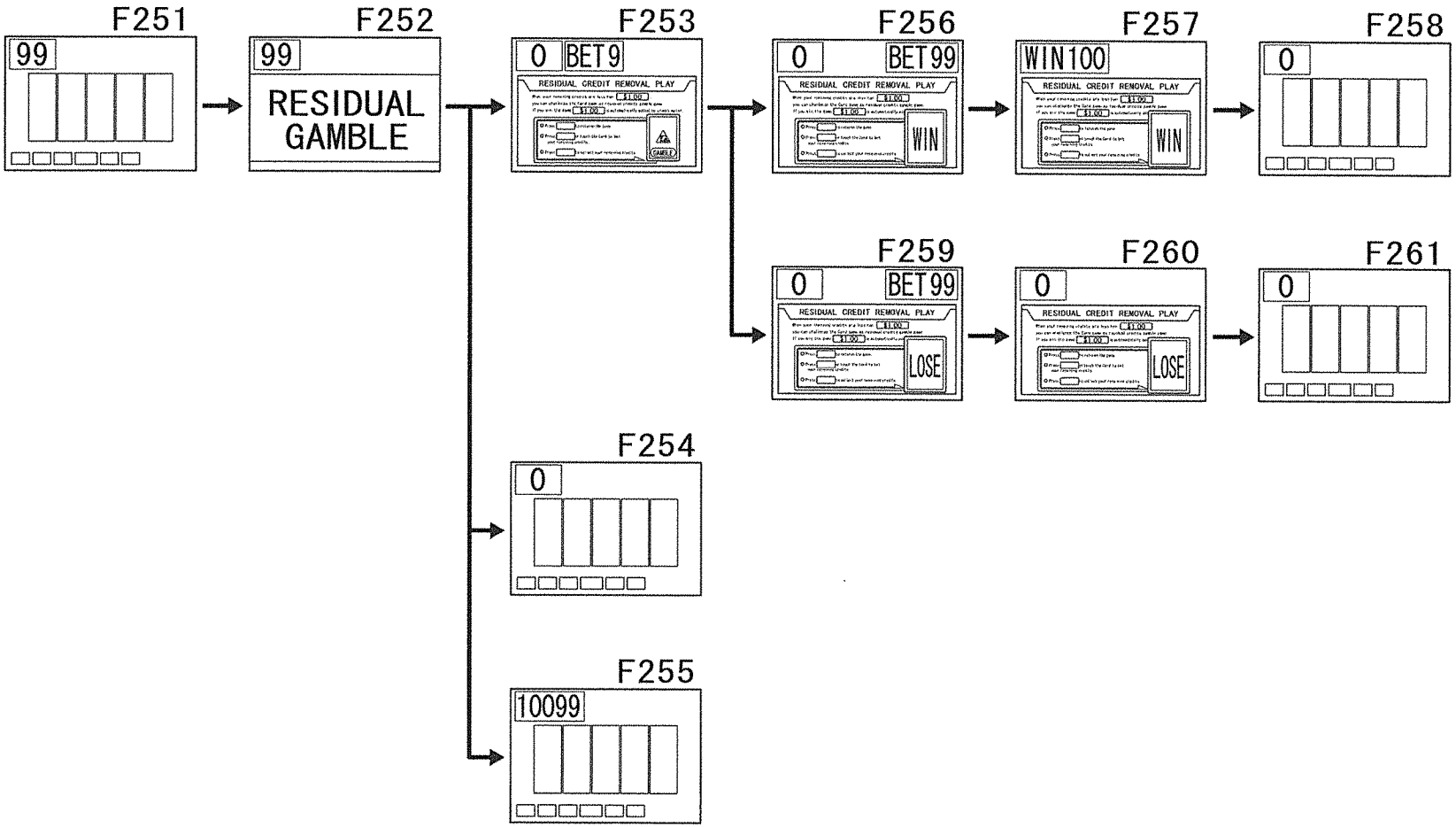
FIG. 30 is a flowchart of a gamble game.

As shown in FIG. 30, when the money is lower than the processable value such as one dollar, a "RESIDUAL GAMBLE" screen is displayed if a gamble start condition such as the pressing of a collect button is satisfied (F253). When the gamble button 44 is pressed, Gamble starts. On the other hand, when the collect button is pressed, Call Attendant is displayed (F254). When the spin button 46 is pressed, the screen of the normal game comes back (F255).

When "WIN" is achieved in Gamble (F256), a predetermined amount of money such as one cent is awarded and a token is paid out through the hopper. In addition to the above, the addition to the credit meter is executed (F257). Thereafter, after a predetermined time such as two seconds elapses, the screen of the normal game comes back (F258). On the other hand, when "LOSE" appears in Gamble (F259), a LOSE screen is displayed (F260). Thereafter, after a predetermined time such as two seconds elapses, the screen of the normal game comes back (F261).

The roles of the buttons in the progress of the gamble game will be described. In the cashout button 32, GAMBLE ON corresponds to "TAKE WIN" and GAMBLE OFF corresponds to "TAKE WIN". In the gamble button 44, GAMBLE ON corresponds to "Gamble Start" and GAMBLE OFF corresponds to "–". In the maximum BET button 45, GAMBLE ON corresponds to "Invalidated" and GAMBLE OFF corresponds to "Gamble Start". In the spin button 46, GAMBLE ON corresponds to "To Normal Game" and GAMBLE OFF corresponds to "To Normal Game".

Figure 31:
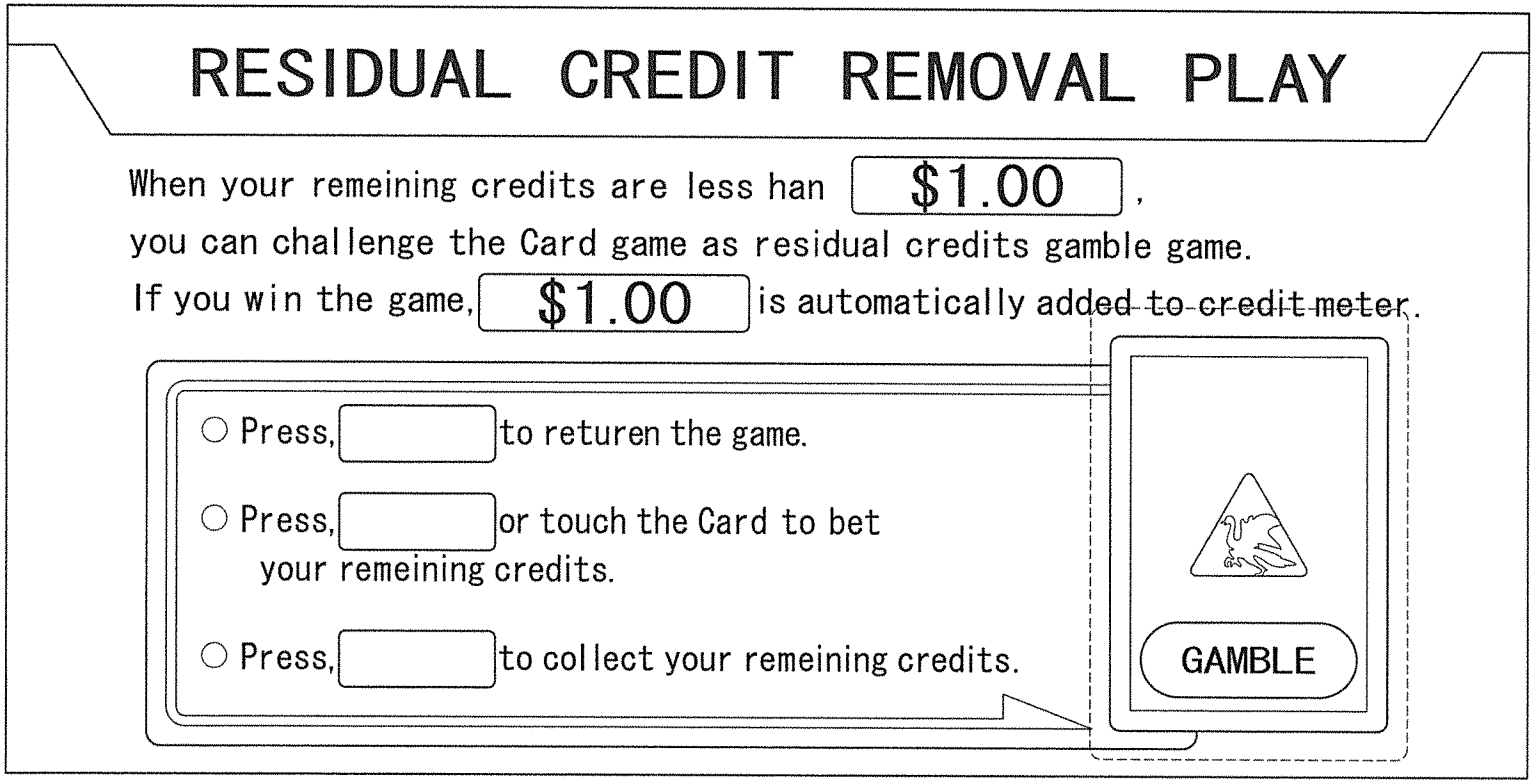
FIG. 31 illustrates a screen in a gamble game.

As shown in FIG. 31, the "RESIDUAL GAMBLE" screen has a card display area, a navigation area, and a meter area. In the card area is displayed a card image. The entirety of the card area has a touch sensor function. On the navigation area, various navigation texts are displayed.

The limit of the value winnable in Gamble is set in the AUDIT. The maximum number of times of Gamble is also set in the AUDIT. For example, the maximum number of times is set at five and the number of times of Gamble is set so as to be five or lower. Whether the touch panel can be used is switchable in some countries.

Figure 32:
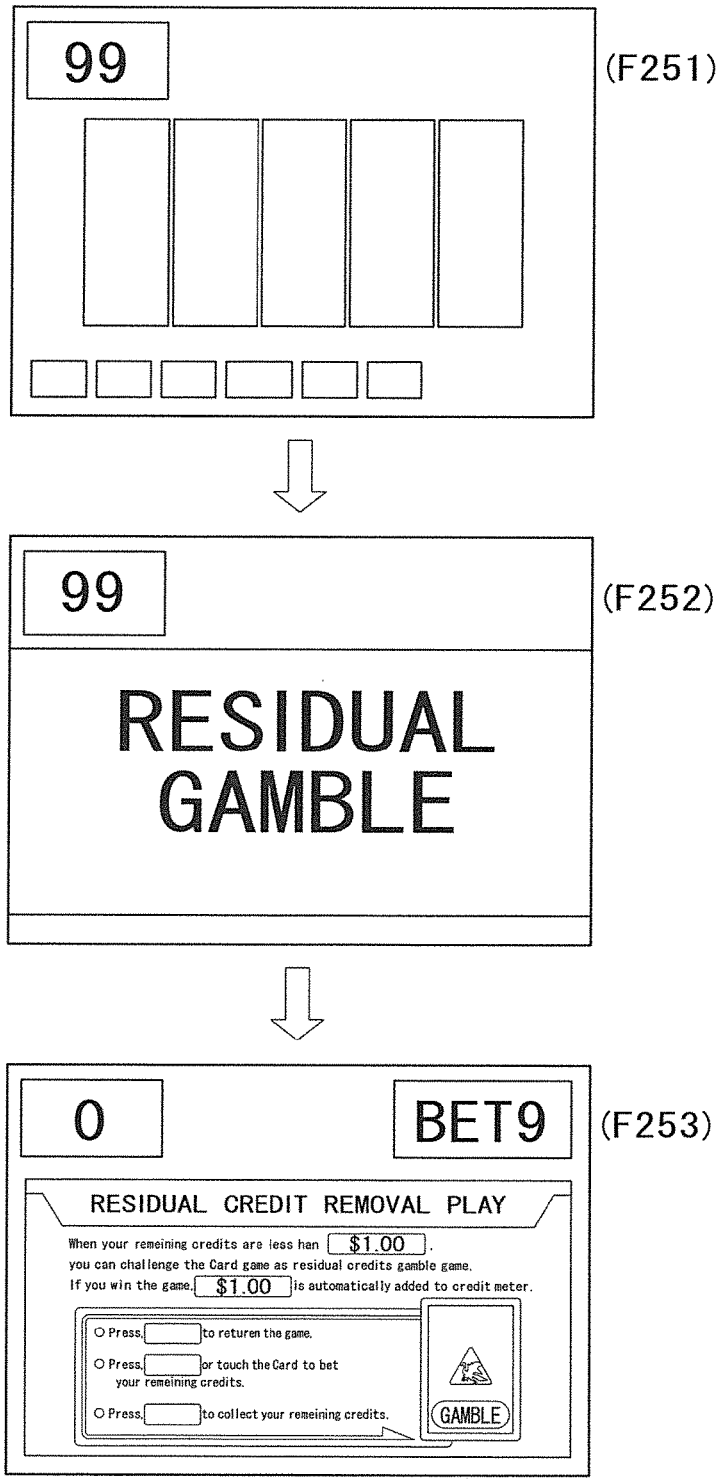
FIG. 32 illustrates operation steps of the gamble game.

As shown in FIG. 32, when the shifting to the gamble game occurs, the message "PLAY ON, GAMBLE or TAKE WIN RED" disappears. Immediately after the clearance of the RAM, the card history is empty until the gamble game is played. A message "SELECT RED OR BLACK OR TAKE WIN" is displayed. In the gamble screen, a heart-shaped red button and a spade-shaped black button are turned on and a TAKE WIN button at the center is turned on. The other buttons are turned off.

Figure 33:
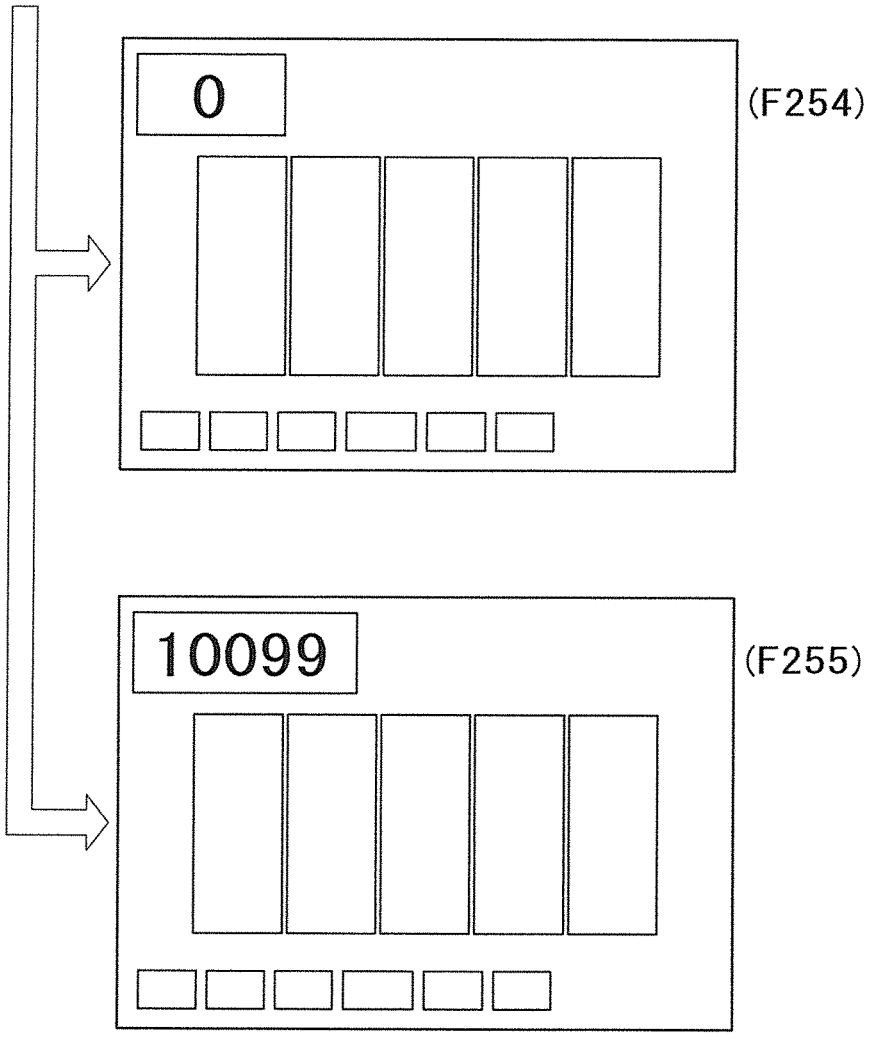
FIG. 33 illustrates operation steps of the gamble game.

Subsequently, as shown in FIG. 33, the amount bet on "GAMBLE AMOUNT" is displayed. Then one of the heart-shaped red button, the spade-shaped black button, and the TAKE WIN button at the center on the gamble screen is selected. When the TAKE WIN button is selected, the amount of WIN is added to the credits at once and the idle state comes back.

Figure 34:
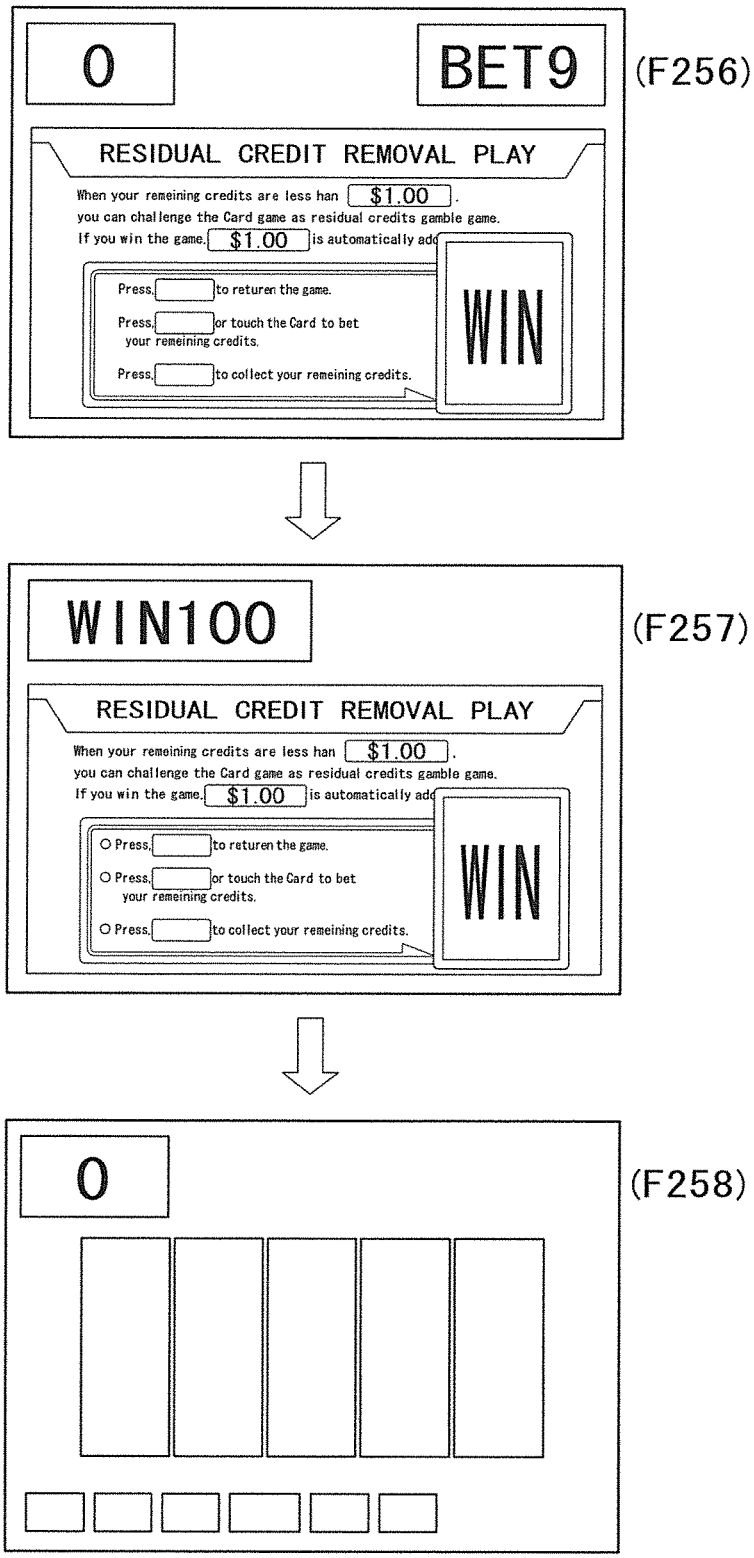
FIG. 34 illustrates operation steps of the gamble game.

In case of Miss in Gamble, as shown in FIG. 34, non-selected options are darkened. At the left edge of the gamble history field, the card history is displayed at once. The preceding card history moves right. The trace of the movement is not illustrated in animation, and hence the history is rewritten at once. The central card result is displayed at once. At this stage, there are no changes in the win meter and the gamble meter. Sound indicating hard luck is output and the shifting to the normal game occurs after several seconds.

Figure 35:
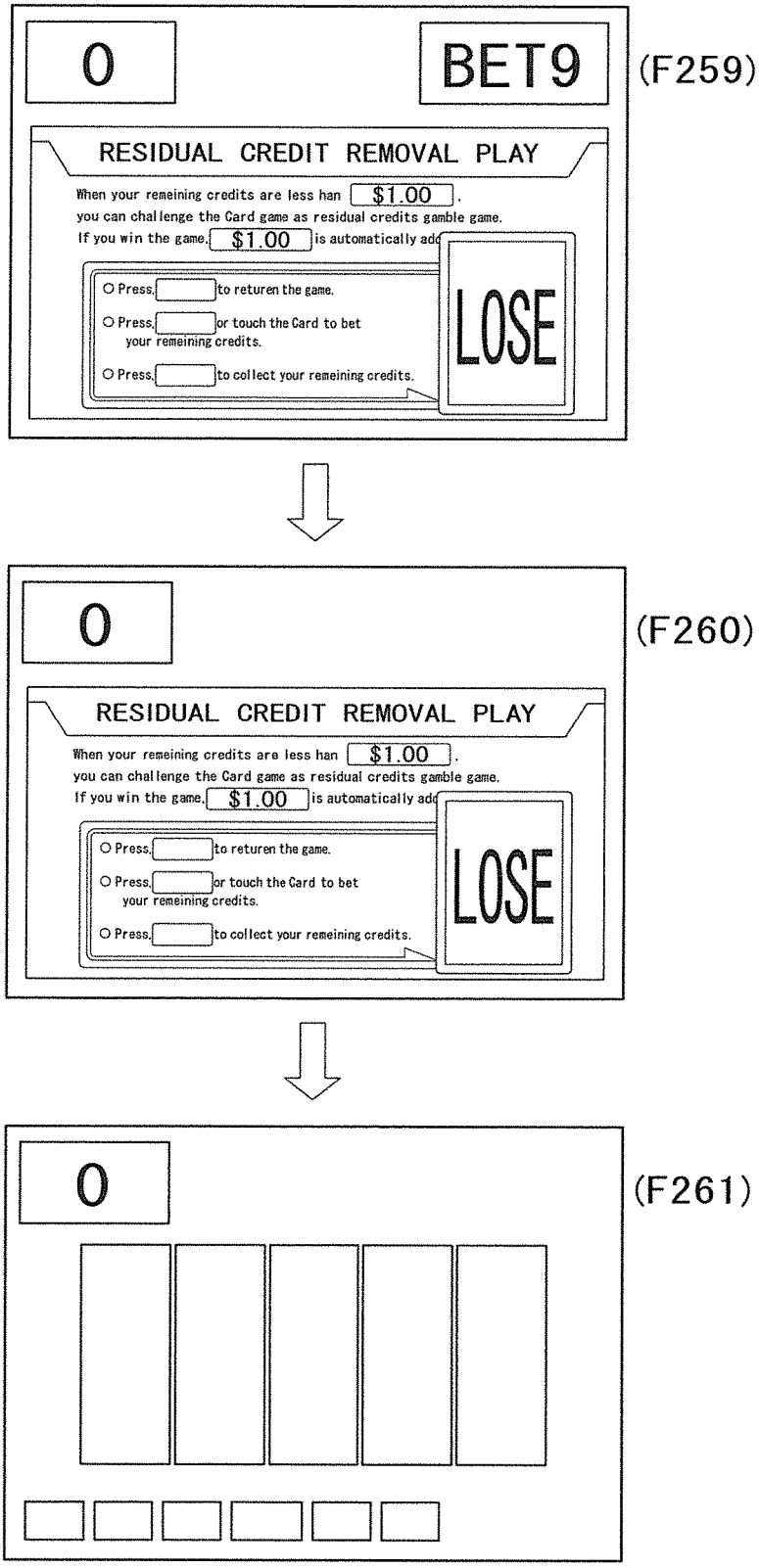
FIG. 35 illustrates operation steps of the gamble game.

In case of Success in Gamble, as shown in FIG. 35, non-selected options are darkened. At the left edge of the gamble history field, the card history is displayed at once. The preceding card history moves right. The trace of the movement is not illustrated in animation, and hence the history is rewritten at once. On the central card, a normal card and a card with a WIN text are alternately displayed at intervals of one frame, and success sound is output for a predetermined time. To the win meter, the value increase as a result of Gamble is added at once. When the player plays the gamble game until reaching the maximum number to times, the value won is added to the credits at once and the idle state comes back. As shown in FIG. 35, when the player has not played the gamble game until reaching the maximum number to times, a card is turned inside out and the gamble game is continued.

(Spin Button Prereading Function)

In addition to the above, the slot machine 10 may have a spin button prereading function with which, in a normal game, an input from the spin button 46 instructing to start the next game in the same conditions (the bet amount and the number of paylines) becomes receivable immediately after the end of the scroll of the symbol columns of the video reels 151 to 155. This function is performed to smoothly start the next game.

Figure 36:
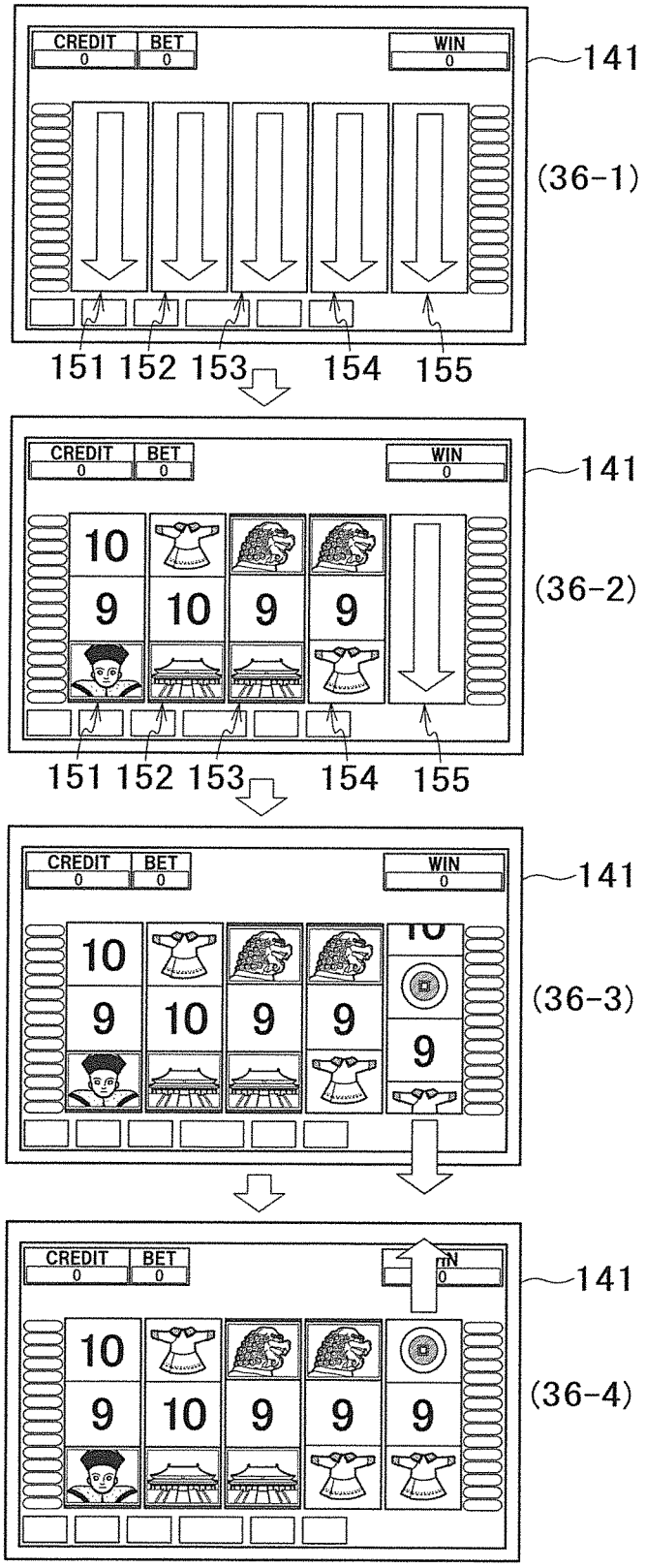
FIG. 36 is an explanatory diagram of a spin button prereading function.

More specifically, as shown in (36-1) in FIG. 36, in the symbol display control process of the main control process, the scroll of the symbol column of each of the video reels 151 to 155 starts. After a while, as shown in (36-2) in FIG. 36, the video reels 151 to 154 stop one by one, and only the fifth video reel 155 is still rotating. Thereafter, as shown in (36-3) in FIG. 36, an effect is performed such that the rotation of the fifth video reel 155 slows down and the symbol to be stopped sinks. Then, as shown in (36-4) in FIG. 36, an effect is performed such that the symbol to be stopped rises to the surface and stops (a bounding effect).

In the series of effects in the symbol display control process, a period during with the rotation of the fifth video reel 155 slows down, the symbol to be stopped sinks at the maximum, and then the symbol rises to the surface and stops is set as a spin button prereading period. In this period, an input instructing to start the next game in the same conditions is receivable from the spin button 46. When an input from the spin button 46 is received during the spin button prereading period, the next game starts immediately after the fifth video reel 155 stops.

In the spin button prereading function, the next game immediately starts but other effects and processes are not skipped. Furthermore, the spin button prereading function is available only when there is no payout based on a combination of symbols displayed on a payline 300. Furthermore, the spin button prereading function is available only when the remaining credit amount is sufficient to start the next game. Furthermore, when the spin button prereading function is available, an LED in the spin button 46 may be turned on.

When the slot machine 10 has a function of skipping the effect of scrolling and stopping the video reels 151 to 155, for example, the skip function is available until the video reels 151 to 154 stop and the skip function becomes not available after the stop of the fourth video reel 154. As such, the skip function and the spin button prereading function may coexist. In such a case, when the skip function is executed, the spin button prereading function is set to invalid. With this arrangement, even if the spin button 46 is mistakenly pressed twice to execute only the skip function, the next game does not unexpectedly starts due to the execution of the spin button prereading function.

According to the arrangement above, in the normal game, when symbols are rearranged on the lower image display panel 141 and a benefit corresponding to the combination of the rearranged symbols is bonus game trigger, how many symbols BONUS 167 are included in the rearranged symbols is determined. The random determination is executed based on the bonus game number random determination table 192 for the number of times corresponding to the number of the symbols BONUS 167, and the number of times of execution of the free game is awarded to the player as a result of the random determination.

On this account, when the bonus game trigger is established, the more the symbols BONUS 167 are included in the rearranged symbols, the more times the random determination of the number of times of execution of the free game is executed. This encourages the player to be interested in the number of rearranged symbols. Furthermore, because the random determination of the total number of times of execution of the free game is executed for the number of times corresponding to the number of the symbols BONUS 167, the player enjoys the random determination for that number of times.

Furthermore, according to the arrangement above, based on the number of the symbols BONUS 167 rearranged when the bonus game trigger is established, the winning probability of the number of times of execution of the free game obtained by the random determination based on the bonus game number random determination table 192 varies. In the present embodiment, the more the number of the bonus symbols 167 displayed in the display window 150, the higher the expectation value of the number of times of execution of the free game to be awarded is. The player is therefore advantageous as the number of the symbols BONUS 167 rearranged when the bonus game trigger is established is large.

Figure 22:
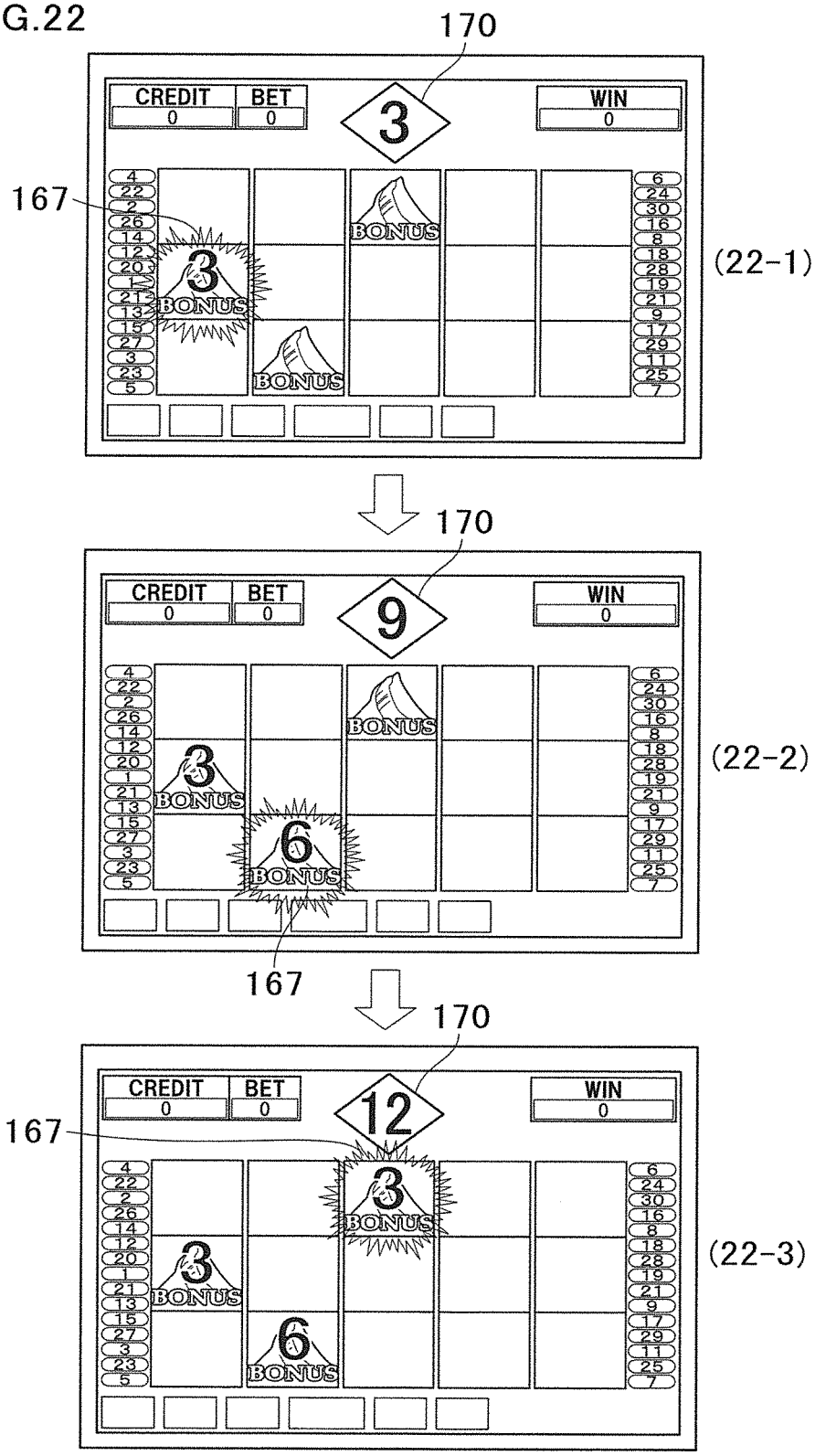
FIG. 22 shows an example of an image displayed on the lower image display panel in the bonus game process.

In addition to the above, according to the arrangement above, in S73, random determination is executed based on the bonus game number random determination table 192, and a result of the random determination of each time is displayed on the front surface of the bonus symbol 167 as shown in (22-1) to (22-3) in FIG. 22.

This allows the player to be interested in the awarded number of times of execution of the free game each time the random determination is executed.

According to the arrangement above, the player is allowed to choose the execution of the free game for the awarded number of times or the execution of the roulette game with which a benefit is awarded as a result of the random determination once.

With this arrangement, when, for example, the awarded total number of times of execution of the free game is large and it takes time to execute the free game for that number of times, the player may select the roulette game with which a benefit is awarded as a result of the random determination once, in order to shorten the time to run the free game for the awarded number of times.

In addition to the above, according to the arrangement above, because the expectation value of the payout awarded when the roulette game is selected is arranged to be equal to a value calculated by multiplying the expectation value of the benefit awarded by executing the free game once by the awarded number of times of execution of the free game, the payout to be awarded is mathematically identical between the case where the free game is executed for the awarded number of times and the case where the roulette game is selected. With this, no matter whether the execution of the free game is selected or the execution of the roulette game is selected, the player enjoys the game with the same expectation of the payout.

According to the arrangement above, furthermore, the player is able to know an estimated termination time which indicates when the running of the free game for the awarded number of times ends. This allows the player to choose the execution of the free game for the awarded number of times or the execution of the roulette game, in consideration of the notified estimated termination time.

According to the arrangement above, furthermore, a box symbol 168 (random symbol) is displayed on the video reels 151 to 155, and a symbol displayed in the box symbol 168 is randomly determined before the start of the game.

With this, a combination of symbols which is likely to be achieved varies in each game. In other words, as a payout which is likely to be awarded is different each time the game is run, the game play is diversified and becomes more entertaining for the player.

According to the arrangement above, when bonus game trigger with which the awarded number of times of execution of the free game may be 100 or more is achieved, the player is allowed to select either the execution of the free game for the awarded number of times or the execution of the roulette game with which a benefit is awarded as a result of random determination once.

According to this arrangement, when, for example, the awarded total number of times of execution of the free game is large and it takes time to execute the free game for that number of times, the player may select the roulette game with which a benefit is awarded as a result of the random determination once, in order to shorten the time to run the free game for the awarded number of times.

According to the arrangement above, furthermore, when the awarded number of times of execution of the free game is equal to or larger than a predetermined number, the player is allowed to select the execution of the free game for the awarded number of times or the roulette game with which a payout is awarded as a result of the random determination once.

With this arrangement, when, for example, the awarded total number of times of execution of the free game is large and it takes time to execute the free game for that number of times, the player may select the roulette game with which a benefit is awarded as a result of the random determination once, in order to shorten the time to run the free game for the awarded number of times.

(Second Embodiment)

Now, a slot machine (gaming machine) of Second Embodiment will be described. While in the slot machine 10 of First Embodiment the display window 150 is constituted by 15 display blocks 28 arranged in five columns and three rows, a slot machine of Second Embodiment is arranged so that a display window 250 is constituted by 20 display blocks 228 arranged in five columns and four rows as shown in FIG. 47 to FIG. 56. Except this, the slot machine is identical with the slot machine 10 of First Embodiment.

Figure 37:
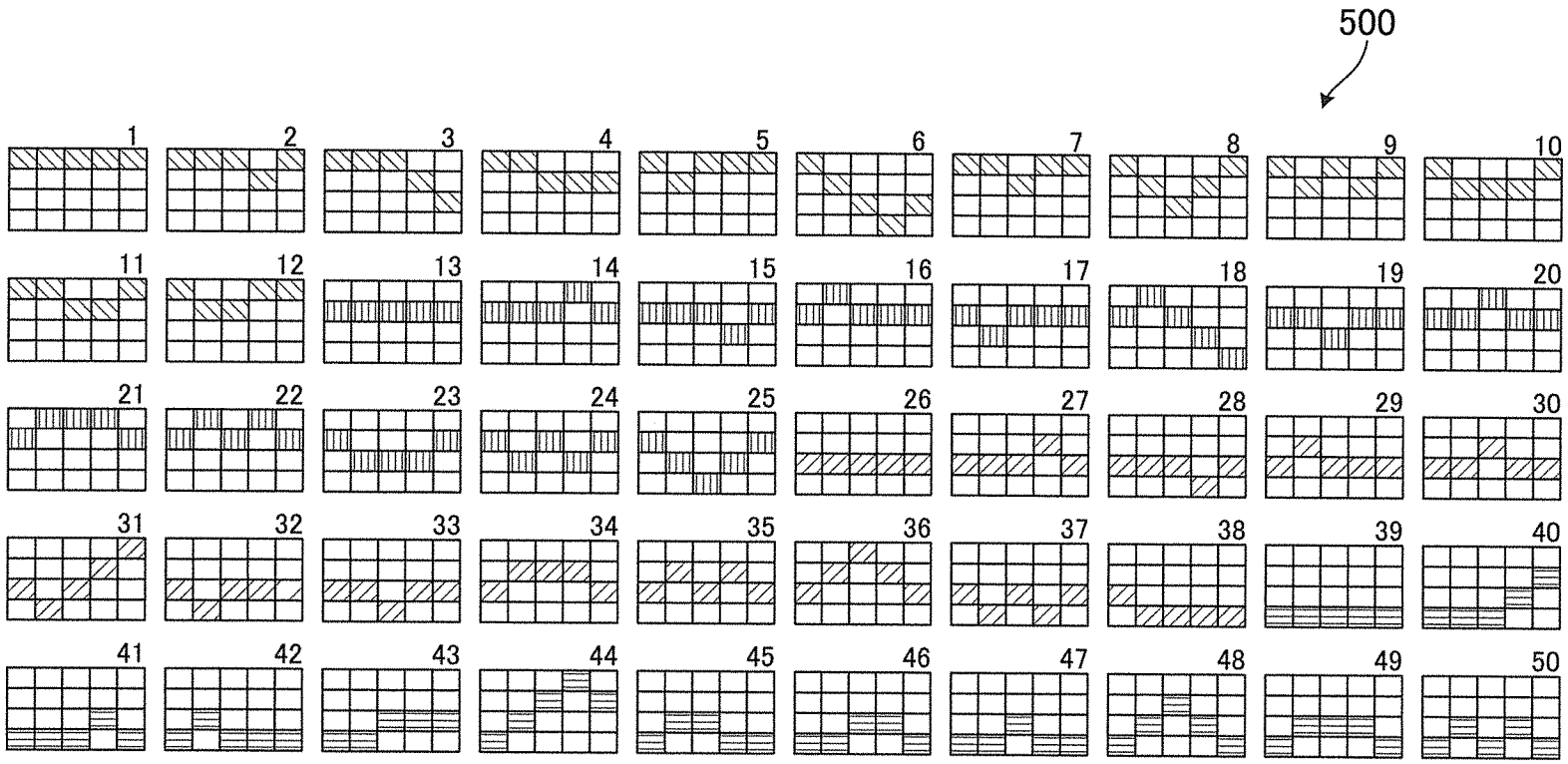
FIG. 37 is an explanatory diagram showing paylines related to Second Embodiment.

In addition to the above, because the display window 250 is constituted by 20 display blocks 228 arranged in five columns and four rows, 50 paylines 500 are formed in total as shown in FIG. 37. The payout determination table 191 is used also in Second Embodiment. In Second Embodiment, winning is achieved when three or more symbols of one of types "J", "Q", "9", "A", "10", "CURRENCY", "DRESS", "DRAGON", "CASTLE", "EMPEROR", and "WILD" are rearranged on an activated payline 500.

In the same manner as in First Embodiment, when at least one symbol "BONUS 267" (equivalent to the bonus symbol) which is a trigger symbol of the bonus game is rearranged on the display blocks 228 of a first video reel 251, a second video reel 252, and a third video reel 253, "bonus game trigger" (equivalent to the right to run the bonus game) is achieved as a winning combination and the shifting to the bonus game is performed.

In the slot machine of Second Embodiment, the RAM 73 stores a level setting table 290 (see FIG. 38), three bonus game number random determination tables 291, 292, and 293 (see FIG. 39 to FIG. 41), and a table selection random determination table 294 (see FIG. 42).

(Level Setting Table 290)

As detailed below, the level setting table 290 shown in FIG. 38 is a table for determining the level (rank of payout) corresponding to the number of bonus symbols 267 displayed in the display window 250, when the "bonus game trigger" is achieved as a winning combination in the main process (normal game). More specifically, when the number of the bonus symbols 267 is 3 or 20, the level is set at EXTRA. When the number of the bonus symbols 267 is 4, the level is set at Very_High. When the number of the bonus symbols 267 is 5, the level is set at High. When the number of the bonus symbols 267 is 6, the level is set at Middle. When the number of the bonus symbols 267 is 7, the level is set at Low. When the number of the bonus symbols 267 is 8 to 19, the level is set at Very_Low. The level determined based on the level setting table 290 is referred to when later-described random determination based on bonus game number random determination tables 291, 292, and 293 is performed.

(Bonus Game Number Random Determination Tables 291, 292, and 293)

In the slot machine of Second Embodiment, as shown in FIG. 39 to FIG. 41, three bonus game number random determination tables 291, 292, and 293 (table A, table B, and table C) are used. In the bonus game number random determination tables 291, 292, and 293, when the number of times of execution of the bonus game to be awarded is associated with the level determined by the level setting table 290 (the level corresponding to the number of the bonus symbols 267 displayed in the display window 250 when the "bonus game trigger" is achieved as a winning combination) and a random number (winning probability).

(Table A: Bonus Game Number Random Determination Table 291)

In the bonus game number random determination table 291 (table A) shown in FIG. 39, when, for example, the level is "Low", the number of times of execution of the free game of "once" is awarded at a probability of 60/100, "twice" is awarded at a probability of 33/100, "three times" is awarded at a probability of 4/100, "five times" is awarded at a probability of 1/100, "seven times" is awarded at a probability of 1/100, and "ten times" is awarded at a probability of 1/100.

In Second Embodiment, as indicated by the bonus game number random determination table 291 shown in FIG. 39, the winning probabilities (random numbers) are set so that the awarded number of times of execution of the free game increases as the level rises (the level rises in the ascending order: "Very_Low", "Low", "Middle", "High", "Very_High", and "EXTRA"). In other words, the expectation value of the number of times of execution of the free game to be awarded increases as the level rises. In Second Embodiment, as indicated by the level setting table 290 shown in FIG. 38, the level rises as the number of the bonus symbols 267 displayed in the display window 250 decreases (except the case where the number is 20), when the "bonus game trigger" is achieved as a winning combination. In other words, the bonus game number random determination table 291 defines that the expectation value of the number of times of execution of the free game to be awarded increases as the number of the bonus symbols 267 decreases.

In Second Embodiment, the number of the bonus symbols 267 displayed in the display window 250 when the "bonus game trigger" is achieved as a winning combination is at least 3 and at most 20. When the number of the bonus symbols 267 displayed in the display window 250 when the "bonus game trigger" is achieved as a winning combination is 3 or 20, the level is set at the highest "EXTRA". In other words, the expectation value of the number of times of execution of the free game to be awarded is highest when the number of the bonus symbols 267 is the smallest 3 or the largest 20.

(Table B: Bonus Game Number Random Determination Table 292)

In the bonus game number random determination table 292 (table B) shown in FIG. 40, when for example, the level is "Low", the number of times of execution of the free game "once" is awarded at a probability of 30/100, "twice" is awarded at a probability of 35/100, "three times" is awarded at a probability of 22/100, "five times" is awarded at a probability of 10/100, "seven times" is awarded at a probability of 2/100, and "ten times" is awarded at a probability of 1/100.

In a similar manner as in the bonus game number random determination table 291 (table A), the winning probabilities (random numbers) are set so that the number of times of execution of the free game to be awarded increases as the level rises in the bonus game number random determination table 292 (table B) shown in FIG. 40. In a similar manner as in the bonus game number random determination table 291, the bonus game number random determination table 292 defines that the expectation value of the number of times of execution of the free game to be awarded increases as the number of the bonus symbols 267 decreases (except in a case where the number of the bonus symbols 267 is 20).

Furthermore, in a similar manner as in the bonus game number random determination table 291 (table A), the bonus game number random determination table 292 (table B) shown in FIG. 40 defines that the expectation value of the number of times of execution of the free game to be awarded is highest when the number of the bonus symbols 267 is the smallest 3 or the largest 20.

(Table C: Bonus Game Number Random Determination Table 293)

In the bonus game number random determination table 293 (table C) shown in FIG. 41, when, for example, the level is "Low", the number of times of execution of the free game "once" is awarded at a probability of 10/100, "twice" is awarded at a probability of 20/100, "three times" is awarded at a probability of 30/100, "five times" is awarded at a probability of 20/100, "seven times" is awarded at a probability of 10/100, and "ten times" is awarded at a probability of 10/100.

In a similar manner as in the bonus game number random determination table 291 (table A), the winning probabilities (random numbers) are set so that the number of times of execution of the free game to be awarded increases as the level rises in the bonus game number random determination table 293 (table C) shown in FIG. 41. In a similar manner as in the bonus game number random determination table 291, the bonus game number random determination table 293 defines that the expectation value of the number of times of execution of the free game to be awarded increases as the number of the bonus symbols 267 decreases (except in a case where the number of the bonus symbols 267 is 20).

Furthermore, in a similar manner as in the bonus game number random determination table 291 (table A), the bonus game number random determination table 293 (table C) shown in FIG. 41 defines that the expectation value of the number of times of execution of the free game to be awarded is highest when the number of the bonus symbols 267 is the smallest 3 or the largest 20.

The three bonus game number random determination table 291, 292, and 293 are different from one another in the expectation value of the number of times of execution of the free game to be awarded. For example, when the level is "Low", the expectation value of the number of times of execution of the free game to be awarded in the bonus game number random determination table 291 is "1.6", the expectation value of the number of times of execution of the free game to be awarded in the bonus game number random determination table 292 is "2.4", and the expectation value of the number of times of execution of the free game to be awarded in the bonus game number random determination table 293 is "4.1". As such, the three bonus game number random determination tables 291, 292, and 293 are different from one another in the expectation value of the number of times of execution of the free game to be awarded even if the level is identically "Low". In Second Embodiment, the expectation value of the number of times of execution of the free game to be awarded is lowest in the bonus game number random determination table 291, is middle in the bonus game number random determination table 292, and is highest in the bonus game number random determination table 293.

(Table Selection Random Determination Table 294)

In a table selection random determination table 294 shown in FIG. 42, the three bonus game number random determination tables 291, 292, and 293 (table A, table B, and table C) are associated with random numbers (winning probabilities). More specifically, the bonus game number random determination table 291 (table A) is associated with a winning probability of 1/3, the bonus game number random determination table 292 (table B) is associated with a winning probability of 1/3, and the bonus game number random determination table 293 (table C) is associated with a winning probability of 1/3.

(Program in Second Embodiment)

Next, the program to be executed by the slot machine 10 of Second Embodiment is described. The matters identical with those of First Embodiment will not be described.

(Main Control Process)

Figure 43:
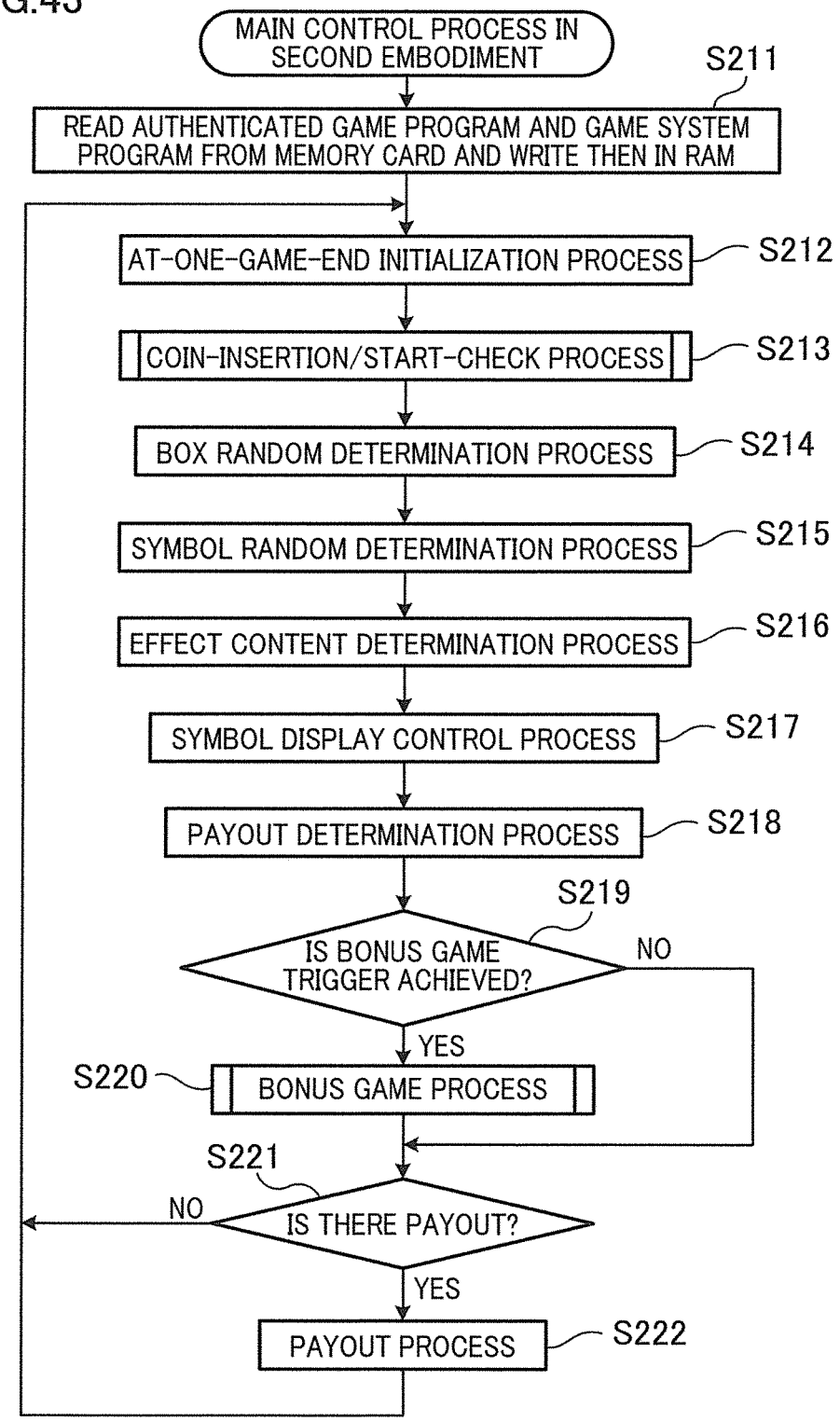
FIG. 43 is a flowchart of a main control process of the slot machine of Second Embodiment.

First, with reference to FIG. 43, a main control process of Second Embodiment is described.

First, when the power is supplied to the slot machine 10, the main CPU 71 reads the authenticated game program and game system program from the memory card 54 through the gaming board 50, and writes the programs into the RAM 73 (S211).

Next, the main CPU 71 executes at-one-game-end initialization process (S212).

The main CPU 71 executes coin-insertion/start-check process which in the same manner as in First Embodiment (S213).

Figure 47:
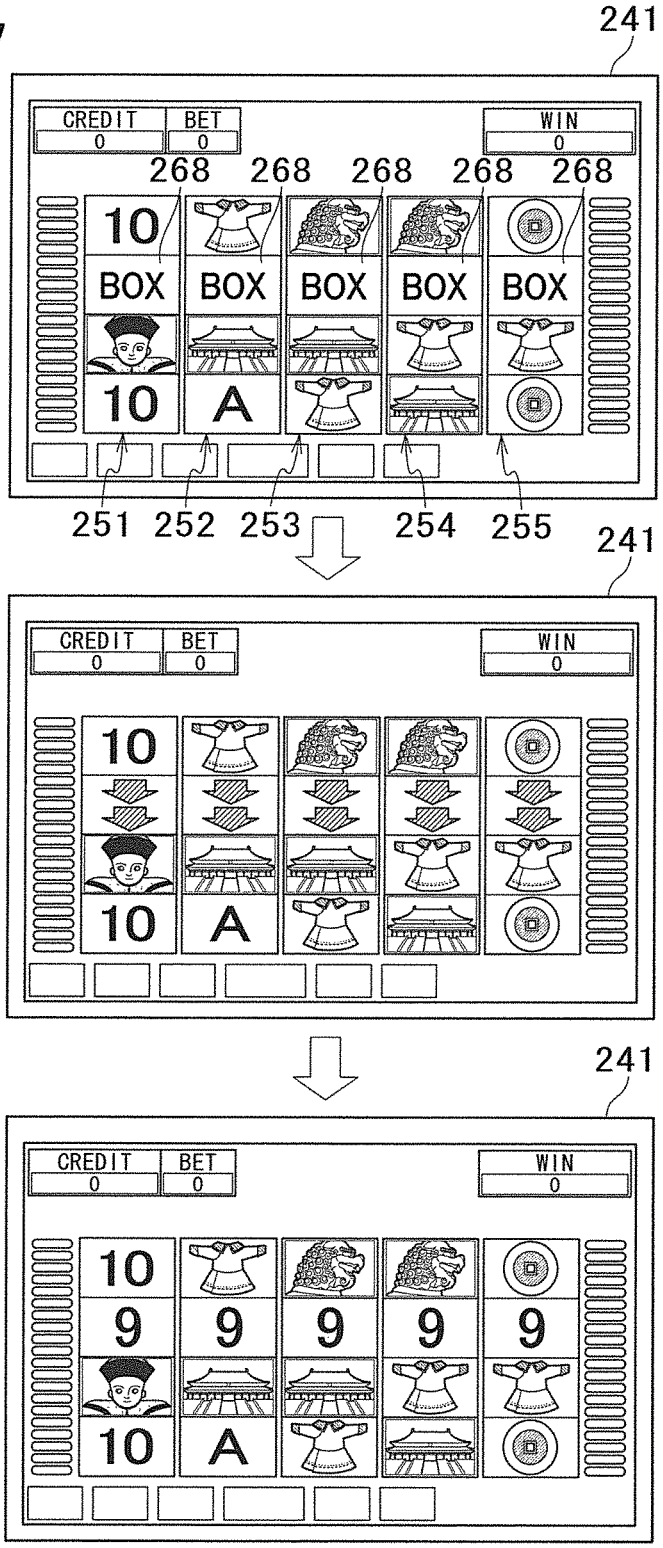
FIG. 47 shows an example of an image displayed on the lower image display panel in a main control process of the Second Embodiment.

The main CPU 71 then executes box random determination process (S214). In this box random determination process, symbols to be displayed in box symbols 268 provided on each of a first video reel 251, a second video reel 252, a third video reel 253, a fourth video reel 254, and fifth video reel 255 are randomly determined (see FIG. 47). Each of the randomly-determined symbols displayed in all box symbols 268 is one of "J", "Q", "9", "A", "10", "CURRENCY 161", "DRESS 162", "DRAGON 163", "CASTLE 164", "EMPEROR 165", "WILD 166", and "BONUS 267". More specifically, as shown in FIG. 47, after the box symbols 268 are displayed, the symbols "J", "Q", "9", "A", "10", "CURRENCY 161", "DRESS 162", "DRAGON 163", "CASTLE 164", "EMPEROR 165", "WILD 166", and "BONUS 267" scroll downward in each box symbol 268, and a symbol is displayed in the box symbol 268 after the scroll stops (a symbol "9" is displayed in the case of FIG. 47). While in the present embodiment only one type of symbol is displayed in all box symbols 268 as a result of random determination, the box symbols 268 may display different types of symbols as a result of random determination.

The main CPU 71 then executes symbol random determination process (S215). In the process, to-be stopped symbol is determined based on the random numbers for symbol determination.

Specifically, the main CPU 71 first samples random numbers for symbol determination. The main CPU 71 then randomly determines the to-be stopped symbol for the video reels 151-155. The main CPU 71 executes random determination for each of the video reels 251-255, and determines any of the 22 symbols as the to-be stopped symbol.

The main CPU 71 executes an effect contents determination process (S216). The main CPU 71 extracts a random value for effect, and randomly determines any of the effect contents from the preset plurality of effect contents.

Figure 48:
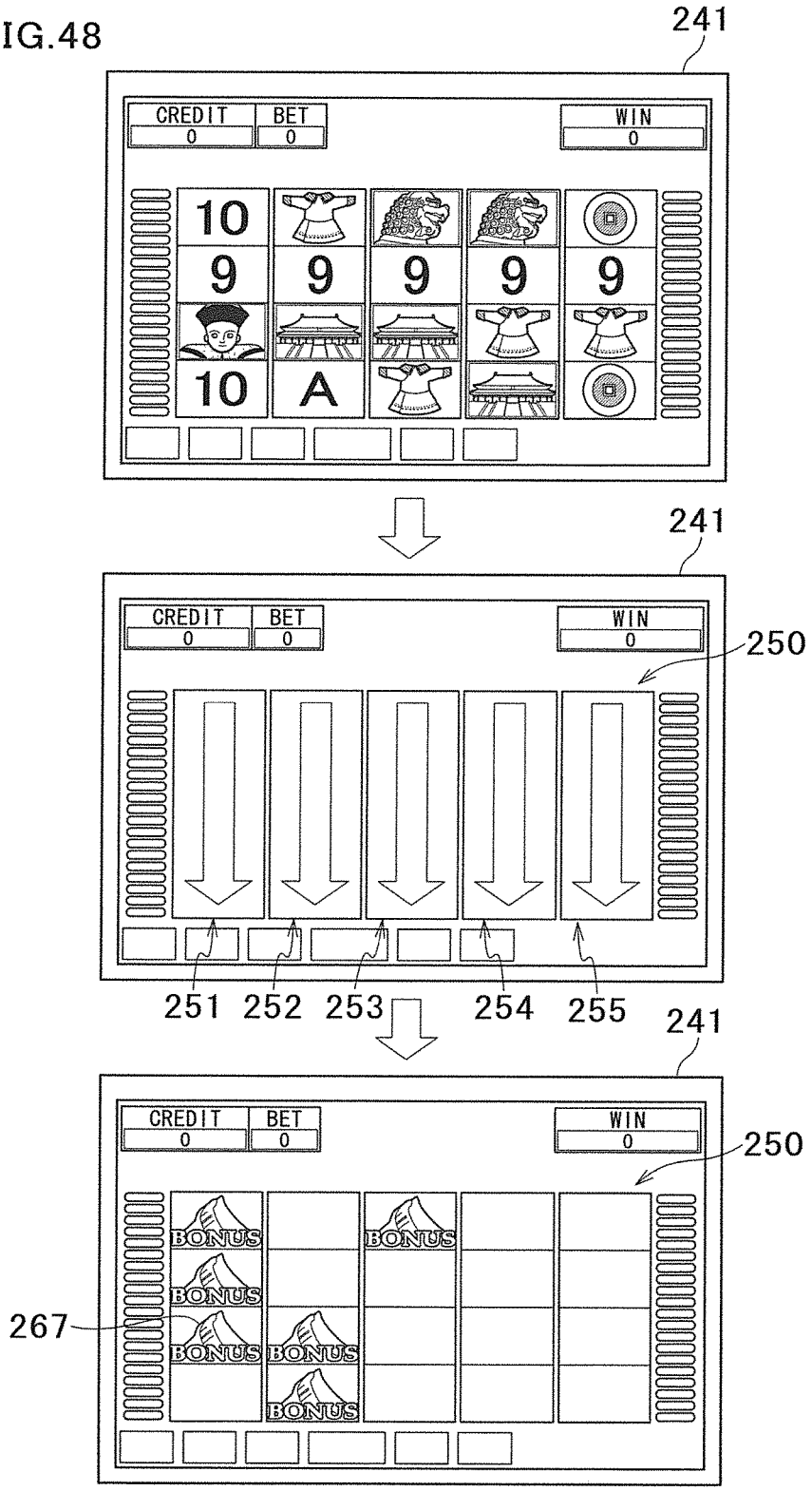
FIG. 48 shows an example of an image displayed on the lower image display panel in the main control process of Second Embodiment.

Next, the main CPU 71 executes the symbol display control process (S217). In the process, the scroll of the symbol column of each video reel 251-255 is started, and the to-be stopped symbol determined in the symbol random determination process of S215 is stopped at a predetermined position (e.g. the upper area in the display window 250), as shown in FIG. 48. That is, twenty symbols including the to-be stopped symbol are displayed in the display window 250.

The main CPU 71 then executes the payout determination process (S218). In this process, the payout determination table 191 in the RAM 73 is referred to, and the payout amount is determined based on a combination of the symbols displayed on an active payline 500, and the payout amount thus determined is stored in the payout amount storage area in the RAM 73.

Next, the main CPU 71 determines whether or not a bonus game trigger is met (S219). As shown in FIG. 48, in the present embodiment the shifting to the bonus game is triggered when at least one BONUS symbol 267 is rearranged in the display blocks 228 of the first video reel 251, the second video reel 252, and the third video reel 253. When the bonus game trigger is established (S219: YES), the main CPU 71 executes a later-described bonus game process (step S220).

After the step S220 or when the bonus game trigger is not established in the step S219 (S219: NO), the main CPU 71 determines whether there is a payout (S221). In other words, whether a payout has been awarded in S218 or S221 is determined. When there is a payout (S221: YES), a payout process is executed (step S222). The main CPU 71 adds the value stored in the payout amount storage area to the value stored in the credit amount storage area provided in the RAM 73. Note that the hopper 113 may be driven based on an input to the collect switch 32S, and coins may be output to the coin tray 18 according to the value stored in the payout amount storage area. After this process or when there is no payout in S221 (S221: NO), the process proceeds to the step S212.

(Bonus Game Process)

Figure 44:
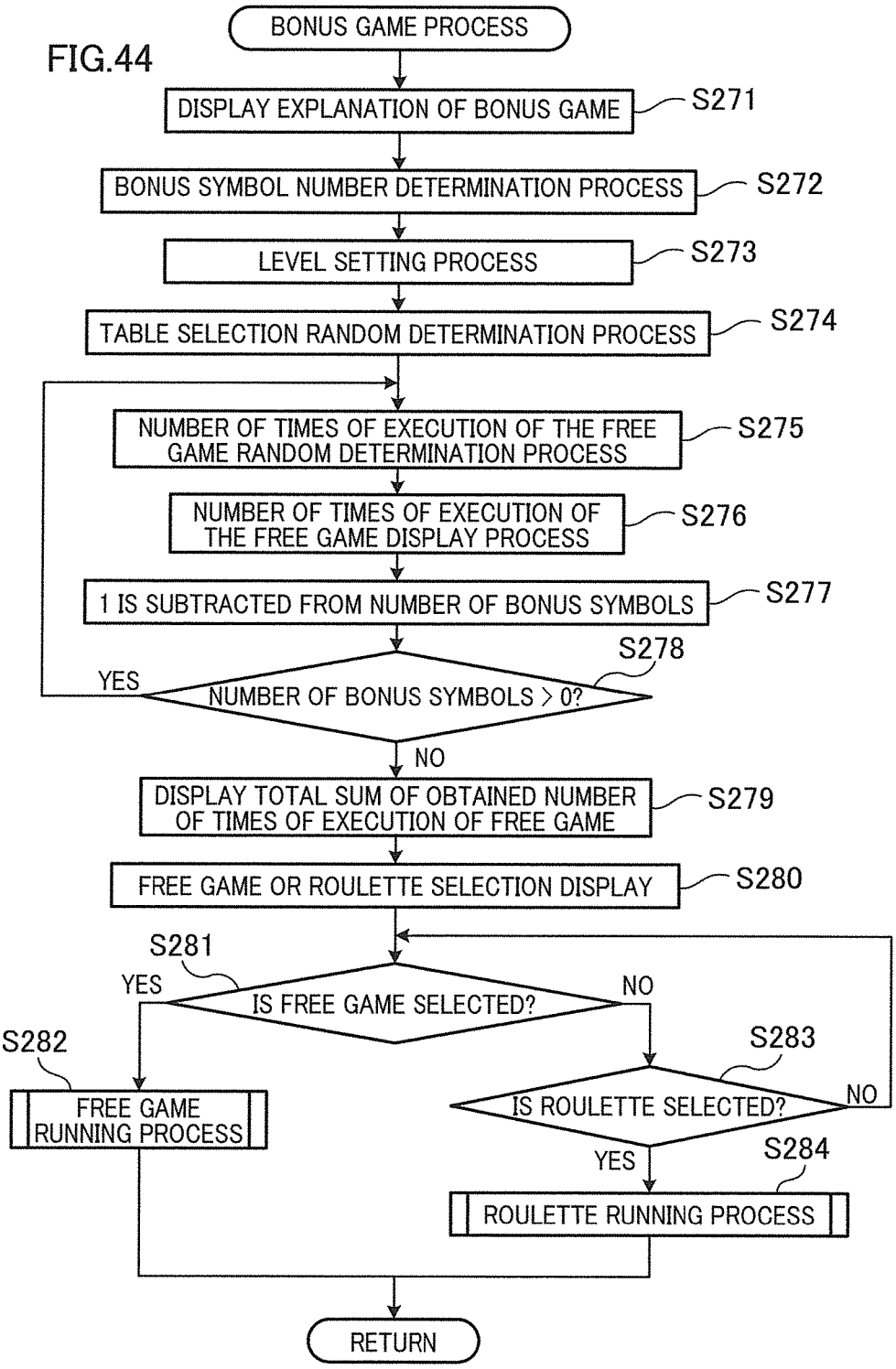
FIG. 44 is a flowchart of a bonus game process of the slot machine of Second Embodiment.

Now, referring to FIG. 44, a bonus game process of Second Embodiment will be described. As shown in FIG. 43, the bonus game process is executed when the bonus game trigger is established in the main control process (see the step S220).

Figure 49:
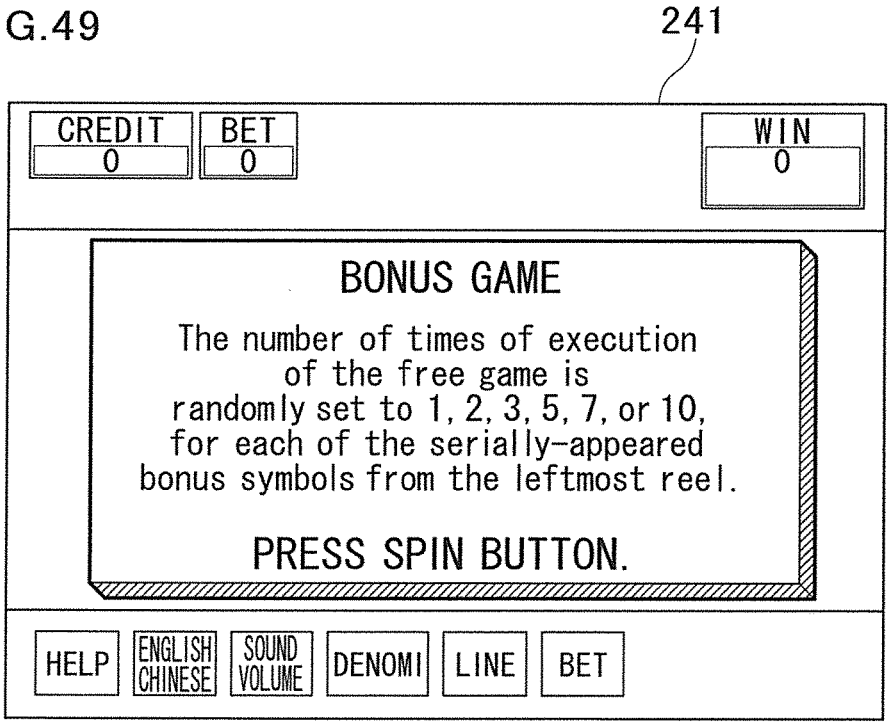
FIG. 49 shows an example of an image displayed on the lower image display panel in a bonus game process of Second Embodiment.

To begin with, as shown in FIG. 49, the main CPU 71 displays a screen explaining the content of the bonus game on the lower image display panel 141 (S271: bonus game description display). In the bonus game description display, the player is prompted to press the spin button 46.

Subsequently, when the spin button 46 is pressed, the main CPU 71 executes a bonus symbol number determination process (S272). In this bonus symbol number determination process, how many bonus symbols 267 are rearranged in the display window 250 after the bonus game trigger is established is determined. In the determination, the number of the bonus symbols 267 falls within the range of 3 to 20. For example, in the case of FIG. 48, the number of the bonus symbols 267 rearranged in the display window 250 is 6. The number of the bonus symbols 267 determined in the bonus symbol number determination process is stored in the RAM 73.

Subsequently, the main CPU 71 executes a level setting process (S273). In the level setting process, with reference to the number of the bonus symbols 267 determined in S272 and a level setting table 290, a level (rank of payout) corresponding to the number of the bonus symbols 267 displayed in the display window 250 when the "bonus game trigger" is achieved as a winning combination is determined. For example, when, as shown in FIG. 48, 6 bonus symbols 267 are rearranged in the display window 250, the level is set at "Middle" with reference to the level setting table 290 shown in FIG. 38. The level set in the level setting process is stored in the RAM 73.

Subsequently, the main CPU 71 executes a table selection random determination process (S274). In the table selection random determination process, a random number is randomly selected with reference to a table selection random determination table 294 shown in FIG. 42, so that one of the three bonus game number random determination tables 291, 292, and 293 (table A, table B, and table C) is selected. In Second Embodiment, as shown in FIG. 42, the winning probability of each of the bonus game number random determination table 291 (table A), the bonus game number random determination table 292 (table B), and the bonus game number random determination table 293 (table C) is set at 1/3.

After the bonus game number random determination table used in the process is selected in S274*b*, "which bonus game number random determination table is selected in S274" may be notified to the player. The notification is made by, for example, displaying a message on the upper image display panel 131 or the lower image display panel 141 or performing a sound effect.

Subsequently, the main CPU 71 executes a number of times of execution of free game random determination process of determining the number of times of execution of the free game to be awarded (S275). In the number of times of execution of free game random determination process, the number of times of execution of the free game is randomly determined for the bonus symbols 267 rearranged in the display window 250, in the order of "1" to "20" displayed in the display blocks 228 of the display window 250 shown in FIG. 50. In this number of times of execution of free game random determination process, the number of times of execution of the free game to be awarded is randomly determined based on the level determined in the level setting process in S273 and the bonus game number random determination table selected in the table selection random determination process in S274.

For example, when the level determined in the level setting process in S273 is "Middle" and the bonus game number random determination table selected in the table selection random determination process in S274 is the bonus game number random determination table 291 (table A), winning probabilities corresponding to the "Middle" in the bonus game number random determination table 291 (table A) shown in FIG. 39 are used. More specifically, the number of times of execution of the free game "once" is awarded at a probability of 50/100, "twice" is awarded at a probability of 30/100, "three times" is awarded at a probability of 10/100, "five time" is awarded at a probability of 8/100, "seven times" is awarded at a probability of 1/100, and "ten times" is awarded at a probability of 1/100.

Figure 50:
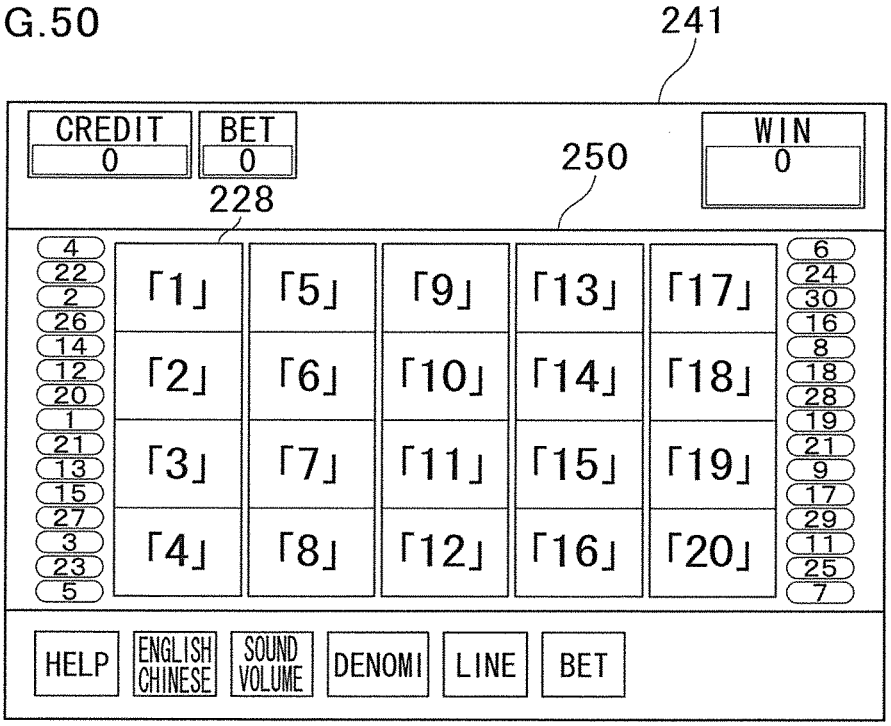
FIG. 50 is an explanatory diagram showing the bonus game process of Second Embodiment.

According to FIG. 48 and FIG. 50, the bonus symbols 267 are rearranged in the positions "1", "2", "3", "7", "8", and "9". The number of times of execution of the free game is therefore randomly determined first for the bonus symbol 267 at "1". This random determination of the number of times of execution of the free game is, as described above, executed based on the winning probabilities corresponding to the "Middle" in the bonus game number random determination table 291 (table A).

Subsequently, the main CPU 71 executes a number of times of execution of free game display process (S276). In the number of times of execution of free game display process, the number of times of execution of the free game awarded as a result of the random determination in S275 is displayed on the front surface of the bonus symbol 267 as shown in (51-1) in FIG. 51 ("1" is displayed in the present embodiment because the number of times of execution of the free game to be awarded is "1"). Furthermore, in the awarded number of times of execution of the free game display window 170, the total sum of the numbers of times of execution of the free game awarded in the bonus game process is displayed. In the present embodiment, "1" is displayed in the display window 170 shown in (51-1) in FIG. 51.

Subsequently, the main CPU 71 updates the number of the bonus symbols 267 stored in the RAM 73 by subtracting 1 therefrom (S277). In the present embodiment, "6" which is the number of the bonus symbols 267 stored in the RAM 73 is updated to "5" by subtracting 1 from 6.

Subsequently, the main CPU 71 determines whether the number of the bonus symbols 267 updated in S277 is larger than 0 (S278). As the number of the bonus symbols 267 updated in S277 is "5" in the present embodiment, it is determined that the number of larger than 0 and therefore the process proceeds to S275 (S278: YES).

Subsequently, after the shifting to S275, the main CPU 71 again executes the number of times of execution of free game random determination process for determining the number of times of execution of the free game to be awarded (S275). In this number of times of execution of free game random determination process, in case of FIG. 48 and FIG. 50, the number of times of execution of the free game is randomly determined for the bonus symbol 267 at "2". As described above, this random determination of the number of times of execution of the free game is executed based on the winning probabilities corresponding to the "Middle" in the bonus game number random determination table 291 (table A). While in the present embodiment the bonus game number random determination table 291 (table A) selected in the table selection random determination process in S274 is used again, the table selection random determination process may be executed in each number of times of execution of free game random determination process to select the bonus game number random determination table.

As described above, the main CPU 71 executes the number of times of execution of free game display process (S276). In the number of times of execution of free game display process, the number of times of execution of the free game awarded as a result of the random determination in S275 is, as shown in (51-2) in FIG. 51, displayed on the front surface of the bonus symbol 267 ("2" is displayed in the present embodiment). Furthermore, on the awarded number of times of execution of the free game display window 170, the total sum of the numbers of times of execution of the free game awarded in the bonus game process is displayed. In the present embodiment, "3" (1+2) is displayed on the display window 170 shown in (51-2) in FIG. 51.

Subsequently, the main CPU 71 updates the number of the bonus symbols 267 stored in the RAM 73 by subtracting "1" therefrom (S277). In the present embodiment, the number of the bonus symbols 267 stored in the RAM 73 is updated to "4" as "1" is subtracted from the number "5" of the bonus symbols 267.

Subsequently, the main CPU 71 again determines whether the number of the bonus symbols 267 updated in S277 is larger than "0" (S278). In the present embodiment, because the number of the bonus symbols 267 updated in S277 is "4", the number is determined to be larger than "0" and the process proceeds to S275 (S278: YES).

Subsequently, after the shifting to S275, the main CPU 71 again executes the number of times of execution of free game random determination process for determining the number of times of execution of the free game to be awarded (S275). In this number of times of execution of free game random determination process, in case of FIG. 48 and FIG. 50, the number of times of execution of the free game is randomly determined for the bonus symbol 267 at "3". This random determination of the number of times of execution of the free game is, as described above, executed based on the winning probabilities in "Middle" of the bonus game number random determination table 291 (table A).

Then the main CPU 71 executes the number of times of execution of free game display process as described above (S276). In the number of times of execution of free game display process, the number of times of execution of the free game awarded as a result of the process in S275 is displayed on the front surface of the bonus symbol 267 ("1" is displayed in the present embodiment). Furthermore, the awarded number of times of execution of the free game display window 170 displays the total sum of the numbers of times of execution of the free game awarded in the bonus game process. In the present embodiment, "4" (1+2+1) is displayed on the display window 170.

Subsequently, the main CPU 71 updates the number of the bonus symbols 267 stored in the RAM 73 by subtracting "1" therefrom (S277). In the present embodiment, the number of the bonus symbols 267 stored in the RAM 73 is updated to "3" by subtracting "1" from "4".

Subsequently, the main CPU 71 again determines whether the number of the bonus symbols 267 updated in S277 is larger than "0" (S278). In the present embodiment, because the number of the bonus symbols 267 updated in S277 is "3", the number is determined to be larger than "0" and the process proceeds to S275 (S278: YES).

Subsequently, after the shifting to S275, the main CPU 71 again executes the number of times of execution of free game random determination process for determining the number of times of execution of the free game to be awarded (S275). In this number of times of execution of free game random determination process, in case of FIG. 48 and FIG. 50, the number of times of execution of the free game is randomly determined for the bonus symbol 267 at "7". This random determination of the number of times of execution of the free game is, as described above, performed based on the winning probabilities in "Middle" of the bonus game number random determination table 291 (table A).

Then the main CPU 71 executes the number of times of execution of free game display process as described above (S276). In the number of times of execution of free game display process, the number of times of execution of the free game awarded as a result of the random determination in S275 is displayed on the front surface of the bonus symbol 267 ("5" is displayed in the present embodiment). Furthermore, the awarded number of times of execution of the free game display window 170 displays the total sum of the numbers of times of execution of the free game awarded in the bonus game process. In the present embodiment, "9 (1+2+1+5)" is displayed on the display window 170.

Subsequently, the main CPU 71 updates the number of the bonus symbols 267 stored in the RAM 73 by subtracting "1" therefrom (S277). In the present embodiment, the number of the bonus symbols 267 stored in the RAM 73 is updated to "2" by subtracting "1" from "3".

Subsequently, the main CPU 71 again determines whether the number of the bonus symbols 267 updated in S277 is larger than "0" (S278). In the present embodiment, because the number of the bonus symbols 267 updated in S277 is "2", the number is determined to be larger than "0" and the process proceeds to S275 (S278: YES).

Subsequently, after the shifting to S275, the main CPU 71 again executes the number of times of execution of free game random determination process of determining the number of times of execution of the free game to be awarded (S275). In this number of times of execution of free game random determination process, in case of FIG. 48 and FIG. 50, the number of times of execution of the free game is randomly determined for the bonus symbol 267 at "8". This random determination of the number of times of execution of the free game is, as described above, executed based on the winning probabilities in "Middle" of the bonus game number random determination table 291 (table A).

The main CPU 71 then executes the number of times of execution of free game display process as described above (S276). In the number of times of execution of free game display process, the number of times of execution of the free game awarded as a result of the random determination in S275 is displayed on the front surface of the bonus symbol 267 ("1" is displayed in the present embodiment). Furthermore, the awarded number of times of execution of the free game display window 170 displays the total sum of the numbers of times of execution of the free game awarded in the bonus game process. In the present embodiment, the display window 170 displays "10 (1+2+1+5+1)".

Subsequently, the main CPU 71 updates the number of the bonus symbols 267 stored in the RAM 73 by subtracting "1" therefrom (S277). In the present embodiment, the number of the bonus symbols 267 stored in the RAM 73 is updated to "1" by subtracting "1" from "2".

Subsequently, the main CPU 71 again determines whether the number of the bonus symbols 267 updated in S277 is larger than "0" (S278). In the present embodiment, because the number of the bonus symbols 267 updated in S277 is "1", the number is determined to be larger than "0" and the process proceeds to S275 (S278: YES).

Subsequently, after the shifting to S275, the main CPU 71 again executes the number of times of execution of free game random determination process for determining the number of times of execution of the free game to be awarded (S275). In this number of times of execution of free game random determination process, in case of FIG. 48 and FIG. 50, the number of times of execution of the free game is randomly determined for the bonus symbol 267 at "9". This random determination of the number of times of execution of the free game is, as described above, performed based on the winning probabilities in "Middle" of the bonus game number random determination table 291 (table A).

Then the main CPU 71 executes the number of times of execution of free game display process as described above (S276). In the number of times of execution of free game display process, the number of times of execution of the free game awarded as a result of the random determination in S275 is, as shown in (51-3) in FIG. 51, displayed on the front surface of the bonus symbol 267 ("3" is displayed in the present embodiment). Furthermore, the awarded number of times of execution of the free game display window 170 displays the total sum of the numbers of times of execution of the free game awarded in the bonus game process. In the present embodiment, as shown in (51-3) in FIG. 51, "13" (1+2+1+5+1+3) is displayed on the display window 170.

Subsequently, the main CPU 71 updates the number of the bonus symbols 267 stored in the RAM 73 by subtracting "1" therefrom (S277). In the present embodiment, the number of the bonus symbols 267 stored in the RAM 73 is updated to "0" by subtracting "1" from "1".

Subsequently, the main CPU 71 again determines whether the number of the bonus symbols 267 updated in S277 is larger than "0" (S278). In the present embodiment, because the number of the bonus symbols 267 updated in S277 is "0", it is determined that the number is not larger than "0" (S278: NO).

As described above, as the steps S275 to S278 are repeated for the number of times corresponding to the number of the bonus symbols 267 determined in the bonus symbol number determination process, the random determination of the number of times of execution of the free game to be awarded, which is executed based on the level determined in the level setting process in S273 and the bonus game number random determination table selected in the table selection random determination process in S274, is executed for the number of times corresponding to the number of the bonus symbols 267 determined in the bonus symbol number determination process, in the order of "1" to "20" shown in the display blocks 228 of the display window 250 shown in FIG. 50. It is noted that the effects in the steps S275 to S278 may be skippable.

Figure 52:
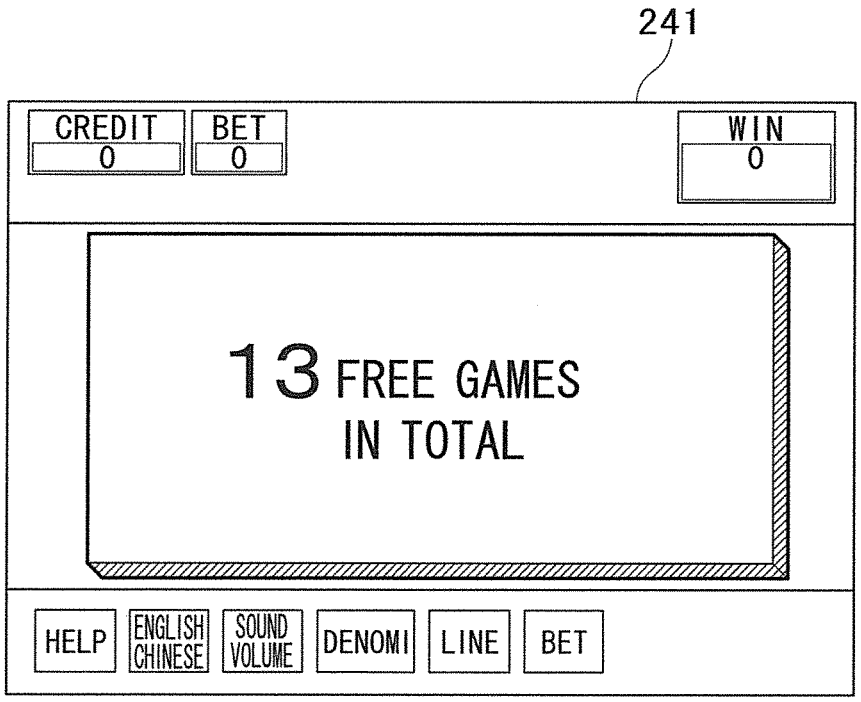
FIG. 52 shows an example of an image displayed on the lower image display panel in the bonus game process of Second Embodiment.

Subsequently, when it is determined that the number of the bonus symbols 267 updated in S278 is not larger than 0 (S278: NO), as shown in FIG. 52, the total sum of the numbers of times of execution of the free game awarded in the bonus game process is displayed on the front surface of the lower image display panel 141 (S279). In the present embodiment, the front surface of the lower image display panel 141 displays "13" which is the total sum of the numbers of times of execution of the free game awarded in the bonus game process.

Subsequently, as show in FIG. 24, the free game selection button 181 for executing the free game for the awarded number of times and the roulette selection button 182 for executing the roulette game in which a payout is awarded as a result of the execution of random determination once are displayed on the lower image display panel 141 (S280). The lower image display panel 141 displays a message prompting the user to select the free game selection button 181 or the roulette selection button 182.

On the lower image display panel 141, an estimated termination time which indicates when the running of the free game for the awarded number of times ends may be displayed when the free game selection button 181 and the roulette selection button 182 are displayed. For example, a value calculated by multiplying a (predetermined) time required to run the free game once by the awarded number of times of execution of the free game is converted to time and displayed.

Subsequently, the main CPU 71 determines whether the free game selection button 181 is selected (S281). When the free game selection button 181 is selected (S281: YES), a later-described free game running process is executed (S282).

When the free game selection button 181 is not selected (S281: NO), whether the roulette selection button 182 is selected is determined (S283).

When the roulette selection button 182 is not selected (S283: NO), the process goes back to S281.

In the meanwhile, when the roulette selection button 182 is selected (S283: YES), the above-described roulette running process is executed (S284). This roulette running process is identical with the process having been described in First Embodiment with reference to FIG. 17.

After S282 or S284, the process is terminated.

(Free Game Running Process)

Figure 45:
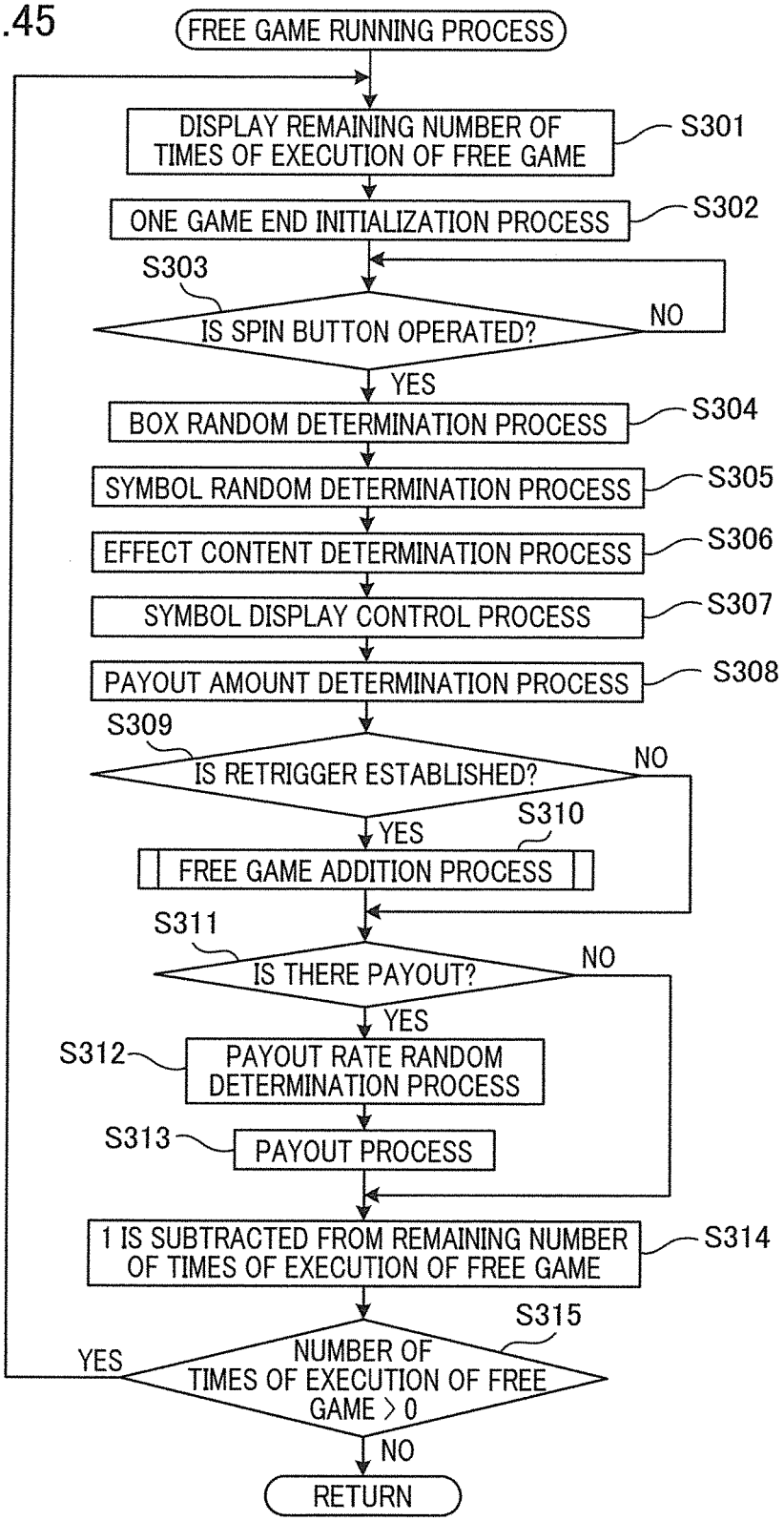
FIG. 45 is a flowchart of a free game running process of the slot machine of Second Embodiment.

Subsequently, a free game running process of Second Embodiment will be described with reference to FIG. 45. As shown in FIG. 44, the free game running process is executed when the free game selection button 181 is selected in the bonus game process (see the step S282). It is noted that, in the free game (equivalent to the bonus game) of the present embodiment, a slot game is run in the same manner as in the normal game.

Figure 51:
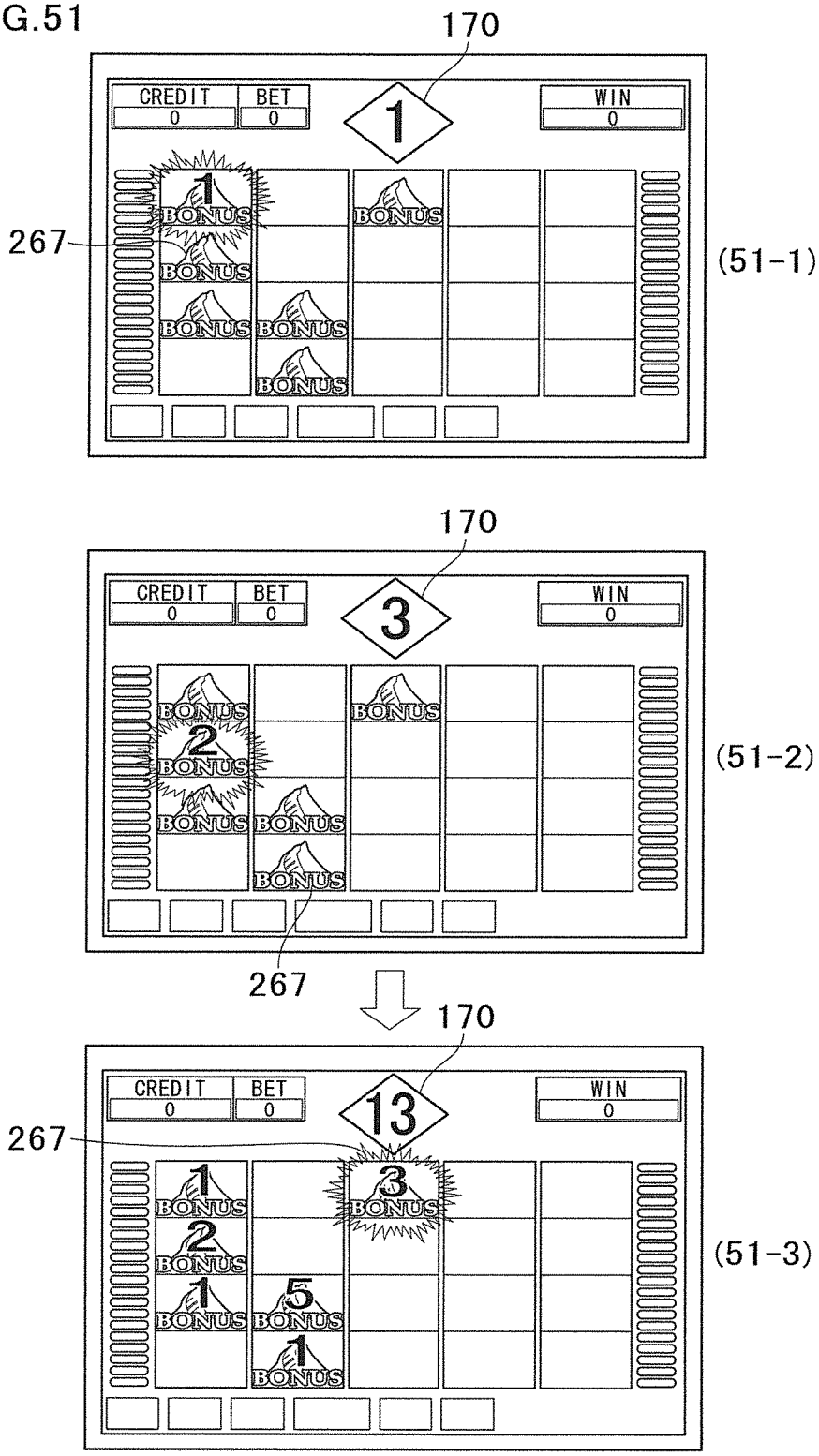
FIG. 51 shows an example of an image displayed on the lower image display panel in the bonus game process of Second Embodiment.
Figure 53:
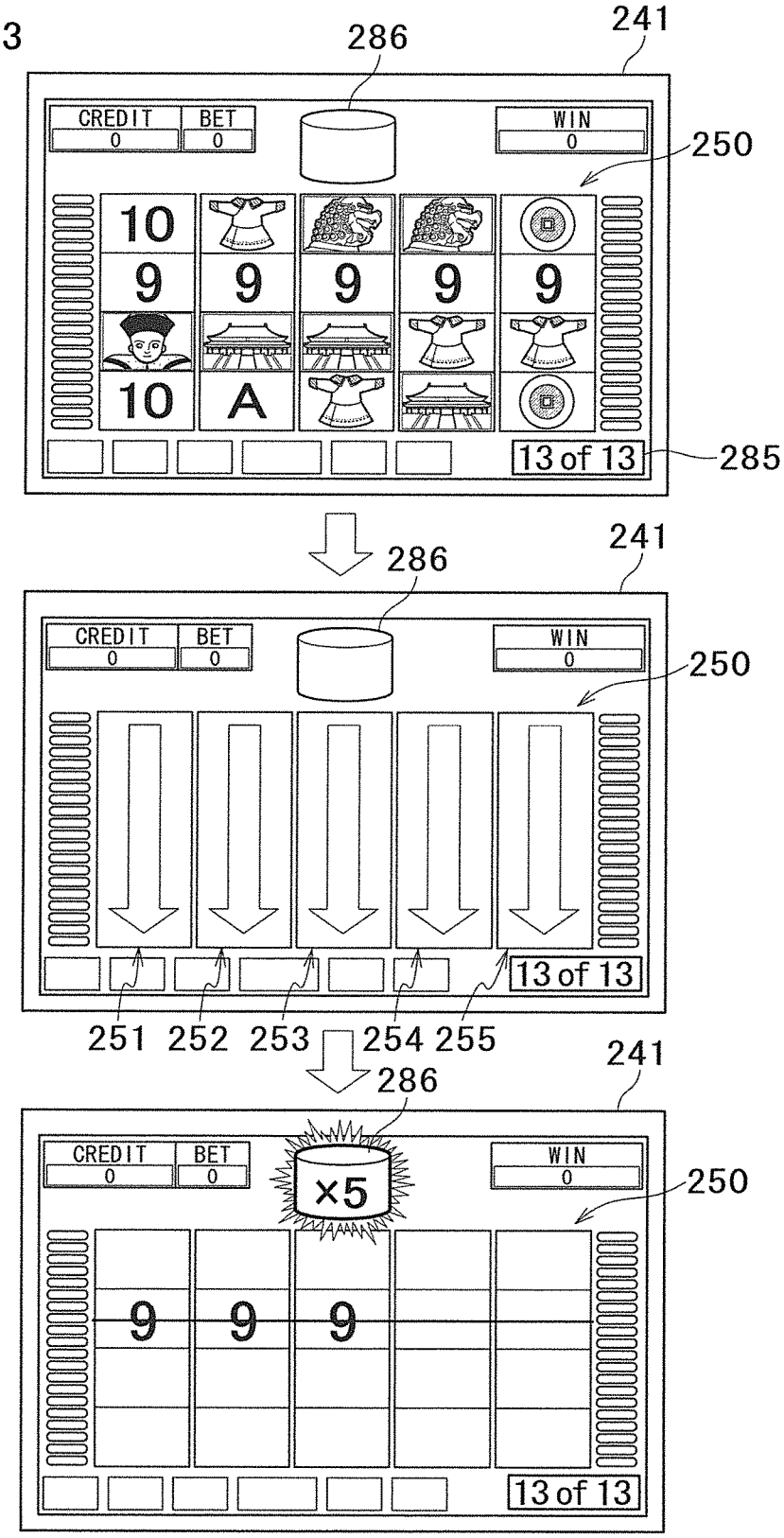
FIG. 53 shows an example of an image displayed on the lower image display panel in a free game running process of Second Embodiment.

To begin with, as shown in FIG. 53, the number of times of execution of the free game obtained in the bonus game process is displayed on a remaining number of times of execution of the free game display window 285 (S301). Because 13 times of execution of the free game is awarded in the present embodiment as shown in FIG. 51, "13 of 13" is displayed on the remaining number of times of execution of the free game display window 285. The remaining number of times of execution of the free game is stored in the RAM 73.

Subsequently, the main CPU 71 executes a one game end initialization process (step S302). For example, a set of data which becomes redundant in the working area of the RAM 73 such as randomly-selected symbols each time a game is executed is deleted.

Subsequently, the main CPU 71 determines whether the spin button 46 is pressed (S303). When the spin button 46 is not pressed (S303: NO), the process becomes on standby.

In the meanwhile, when the spin button 46 is pressed (S303: YES), the main CPU 71 executes a box random determination process (S304). This box random determination process is identical with the above-described process executed in S214 of the main control process. It is noted that the random determination table of the symbols displayed on the box symbol 268 may be different from the table which is referred in the main control process.

Subsequently, the main CPU 71 executes a symbol random determination process (S305). In this process, a to-be stopped symbol is determined based on a symbol determination random number.

More specifically, to begin with, the main CPU 71 samples a random number for determining the symbols. Subsequently, the main CPU 71 randomly determine the to-be stopped symbol for the respective video reels 251 to 255. The main CPU 71 executes the random determination for each of the video reels 251 to 255, and selects one of 22 symbols as the to-be stopped symbol.

Subsequently, the main CPU 71 executes an effect content determination process (step S306). The main CPU 71 samples an effect-use random number and randomly select one of predetermined effect contents.

Subsequently, the main CPU 71 executes a symbol display control process (step S307). In this process, as shown in FIG. 53, the scroll of the symbol column of each of the video reels 251 to 255 starts, and the to-be stopped symbol selected in the symbol random determination in step S305 stops at a predetermined position (e.g., an upper region in the display window 250). In other words, 20 symbols including the to-be stopped symbol are displayed in the display window 250.

Subsequently, the main CPU 71 executes a payout amount determination process (step S308). In this process, a payout amount is determined based on the combination of the symbols displayed on the display window 250, and the payout amount is stored in the payout amount storage area in the RAM 73.

Figure 54:
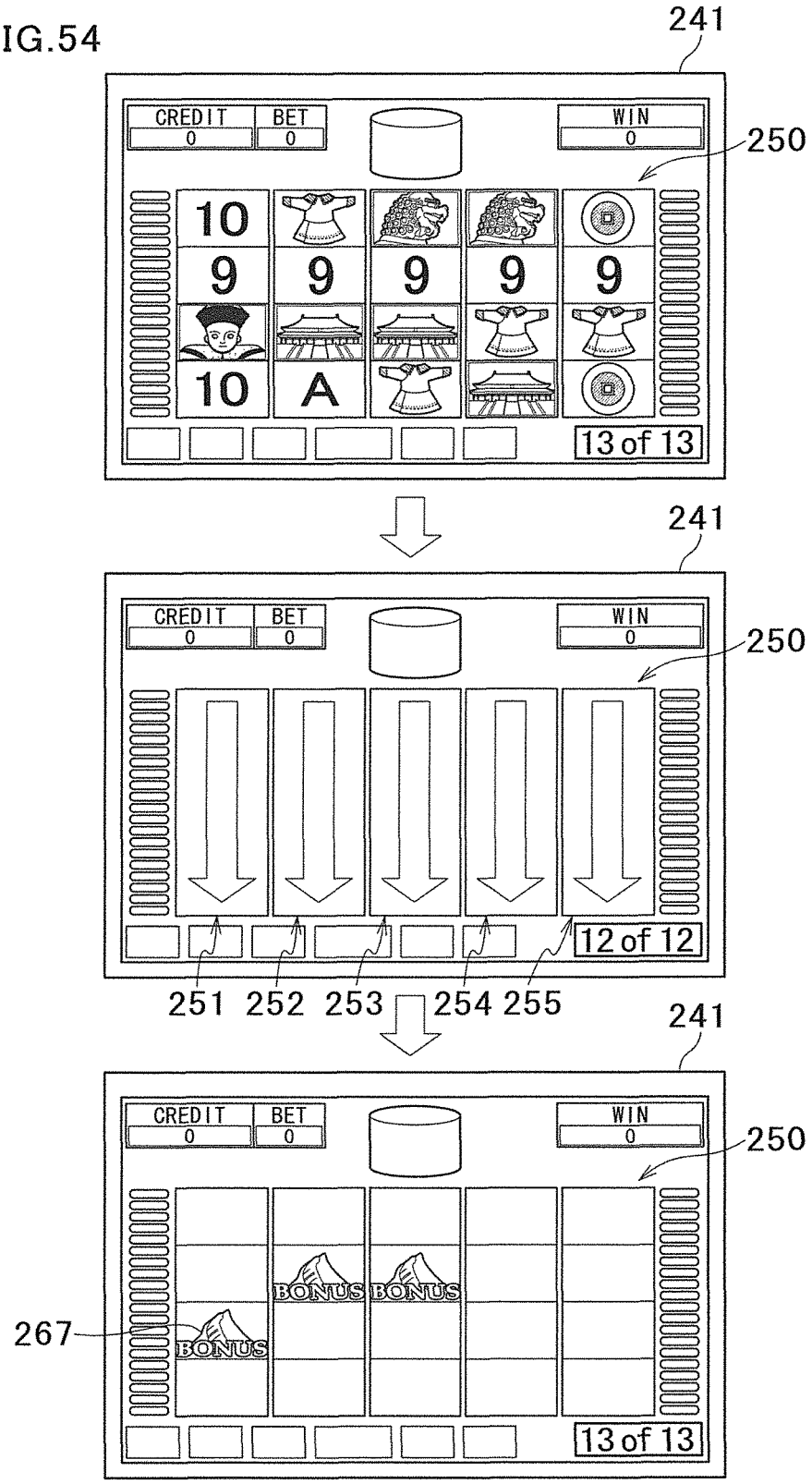
FIG. 54 shows an example of an image displayed on the lower image display panel in the free game running process of Second Embodiment.
Figure 55:
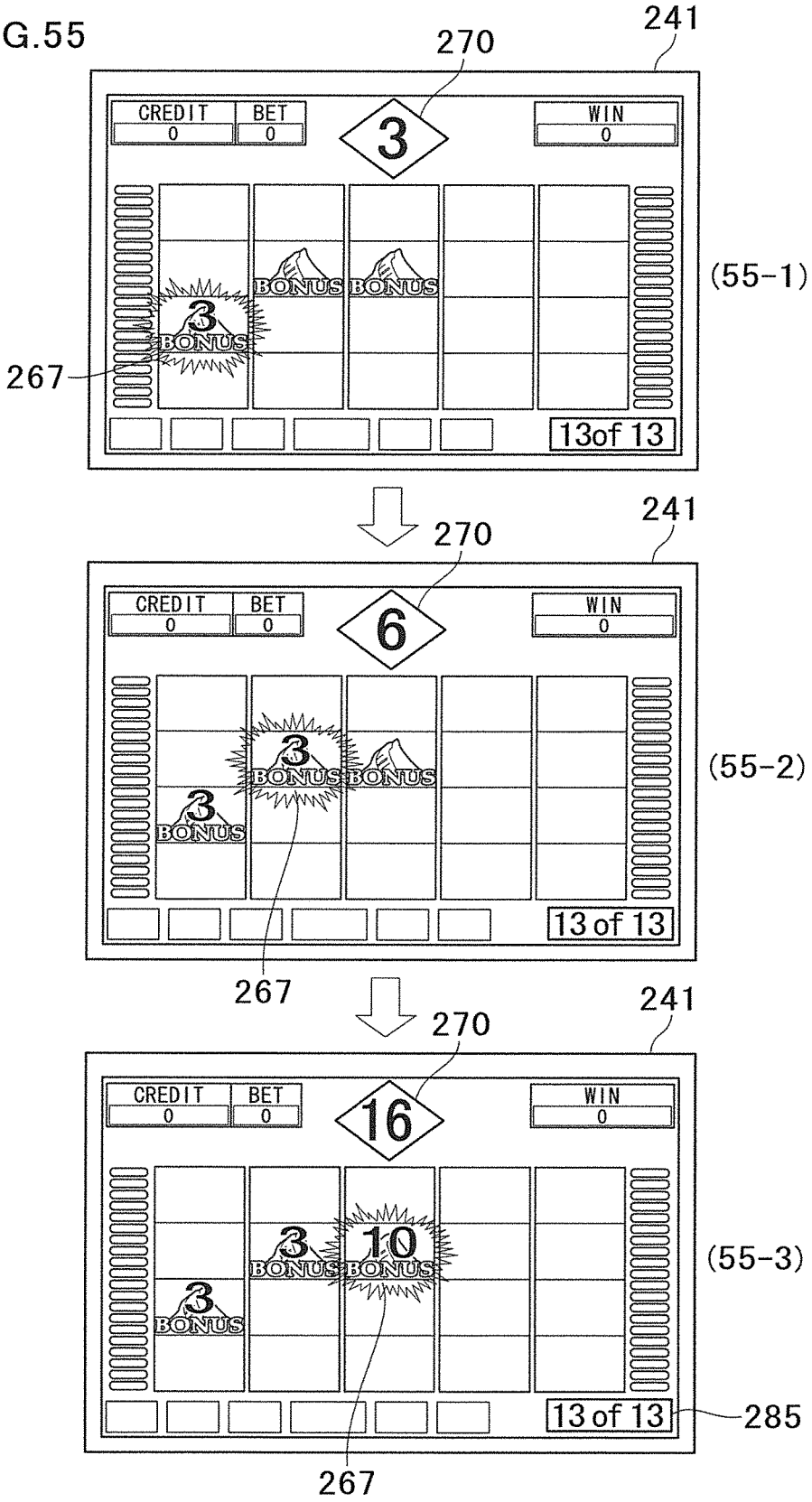
FIG. 55 shows an example of an image displayed on the lower image display panel in a free game addition process of Second Embodiment.

Subsequently, the main CPU 71 determines whether re-trigger is established (step S309). As shown in FIG. 54, the re-trigger of the present embodiment with which the number of times of execution of the free game is increased is established when at least one bonus symbol 267 is rearranged in the display blocks 228 of the first video reel 251, the second video reel 252, and the third video reel 253. When the re-trigger is established (S309: YES), the main CPU 71 executes a later-described free game addition process (step S310).

Subsequently, after S310 or when the re-trigger is not established in step S309 (S309: NO), the main CPU 71 determines whether there is a payout (S311). That is to say, whether a payout has been awarded in S308 is determined. When there is a payout (S311: YES), a payout rate random determination process of randomly determining the payout rate of the payout is executed (S312).

In this payout rate random determination process, the main CPU 71 randomly selects one of "×2", "×3", "×4", and "×5" as the payout rate of the payout. The selected payout rate is, as shown in FIG. 53, displayed in the payout rate display window 286 ("×5" is displayed in FIG. 53).

Thereafter, a payout process is executed (S313). In this payout process, a value calculated by multiplying the payout determined in S308 by the payout rate selected in S312 is awarded to the player as a final payout. For example, when the payout determined in S308 is 100 credits and the payout rate selected in S312 is "×5", 500 credits (100×5=500) are awarded to the player as the final payout.

Subsequently, after S313 or when there is no payout in S311 (S311: NO), the main CPU 71 updates the remaining number of times of execution of the free game in the RAM 73 by subtracting 1 therefrom (S314). For example, when the remaining number of times of execution of the free game stored in the RAM 73 is 13, the remaining number of times of execution of the free game is updated to 12 as 1 is subtracted from 13.

Subsequently, the main CPU 71 determines whether the remaining number of times of execution of the free game updated in S314 is larger than 0 (S315). When the remaining number of times of execution of the free game is larger than 0 (S315: YES), the process proceeds to S301.

In the meanwhile, when the remaining number of times of execution of the free game is not larger than 0 (S315: NO), the process is terminated.

(Free Game Addition Process)

Figure 46:
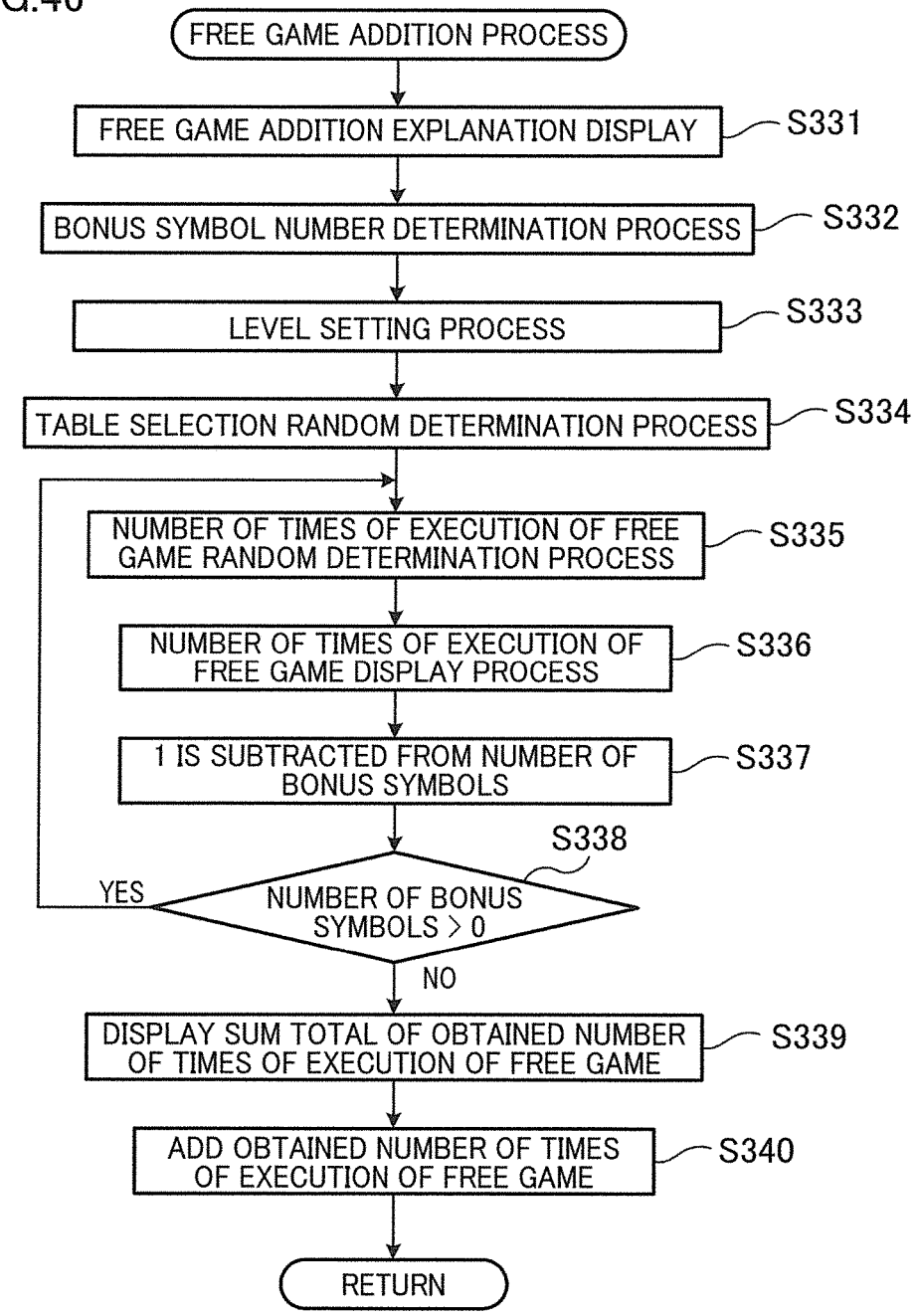
FIG. 46 is a flowchart of a free game addition process of the slot machine of Second Embodiment.

Subsequently, a free game addition process of Second Embodiment will be described with reference to FIG. 46. As shown in FIG. 45, the free game addition process is executed when the re-trigger is established in the free game running process (see the step S310).

To begin with, the main CPU 71 displays, on the lower image display panel 141, a screen explaining the addition to the number of times of execution of the free game (S331: free game addition explanation display). The free game addition explanation display prompts the user to press the spin button 46.

Subsequently, when the spin button 46 is pressed, the main CPU 71 executes a bonus symbol number determination process (S332). In this bonus symbol number determination process, how many bonus symbols 267 are rearranged in the display window 250 when the re-trigger is established is determined. The range of the number of the bonus symbols 267 is 3 to 20. For example, in FIG. 54, it is determined that 3 bonus symbols 267 are rearranged in the display window 250. The number of the bonus symbols 267 determined in the bonus symbol number determination process is stored in the RAM 73.

Subsequently, the main CPU 71 executes a level setting process (S333). In the level setting process, with reference to the number of the bonus symbols 267 determined in S332 and the level setting table 290, a level (rank of the payout) corresponding to the number of the bonus symbols 267 displayed in the display window 250 when the "bonus game trigger" is achieved as a winning combination is determined. For example, when, as shown in FIG. 54, 3 bonus symbols 267 are rearranged on the display window 250, the level is set to "EXTRA" with reference to the level setting table 290 shown in FIG. 38. The level set in the level setting process is stored in the RAM 73.

Subsequently, the main CPU 71 executes a table selection random determination process (S334). In the table selection random determination process, the random number selection is executed based on a table selection random determination table 294 shown in FIG. 42, and one of the three bonus game number random determination tables 291, 292, and 293 (table A, table B, and table C) 3 is selected. In Second Embodiment, as shown in FIG. 42, the winning probability of each of the bonus game number random determination table 291 (table A), the bonus game number random determination table 292 (table B), and the bonus game number random determination table 293 (table C) is 1/3.

Subsequently, the main CPU 71 executes a number of times of execution of free game random determination process for determining the number of times of execution of the free game to be awarded (S335). In the number of times of execution of free game random determination process, the number of times of execution of the free game is randomly determined for each of the bonus symbols 267 rearranged in the display window 250 in the order of "1" to "20" shown in the display blocks 228 of the display window 250 shown in FIG. 50. In this number of times of execution of free game random determination process, the number of times of execution of the free game to be obtained is randomly determined based on the level set in the level setting process in S333 and the bonus game number random determination table selected in the table selection random determination process in S334.

For example, when the level set in the level setting process in S333 is "EXTRA" and the bonus game number random determination table selected in the table selection random determination process in S334 is the bonus game number random determination table 292 (table B), the winning probabilities in "EXTRA" in bonus game number random determination table 292 (table B) are used with reference to FIG. 40. More specifically, the number of times of execution of the free game "once" is awarded at a probability of 15/100, "twice" is awarded at a probability of 20/100, "three times" is awarded at a probability of 30/100, "five times" is awarded at a probability of 20/100, "seven times" is awarded at a probability of 10/100, and "ten times" is awarded at a probability of 5/100.

Because in case of FIG. 54 and FIG. 50 the bonus symbols 267 are rearranged at "3", "6", and "10", first the number of times of execution of the free game is randomly determined for the bonus symbol 267 at "3". This random determination of the number of times of execution of the free game is, as described above, executed based on the winning probabilities in "EXTRA" in the bonus game number random determination table 292 (table B).

Subsequently, the main CPU 71 executes a number of times of execution of free game display process (S336). In the number of times of execution of free game display process, the number of times of execution of the free game awarded as a result of the random determination in S335 is, as shown in (55-1) in FIG. 55, displayed on the front surface of the bonus symbol 267 ("3" is displayed in the present embodiment because the number of times of execution of the free game to be awarded is determined to be "3"). Furthermore, the awarded number of times of execution of the free game display window 270 displays the total sum of the numbers of times of execution of the free game awarded in the bonus game process. In the present embodiment, "3" is displayed in the display window 270 shown in (55-1) in FIG. 55.

Subsequently, the main CPU 71 updates the number of the bonus symbols 267 stored in the RAM 73 by subtracting "1" therefrom (S337). In the present embodiment, the number of the bonus symbols 267 is updated to "2" by subtracting "1" from "3" which is the number of the bonus symbols 267 stored in the RAM 73.

Subsequently, the main CPU 71 determines whether the number of the bonus symbols 267 updated in S337 is larger than 0 (S338). In the present embodiment, because the number of the bonus symbols 267 updated in S337 is "2", the number is determined to be larger than 0 and the process proceeds to S335 (S338: YES).

Subsequently, after the shifting to S335, the main CPU 71 again executes the number of times of execution of free game random determination process for determining the number of times of execution of the free game to be awarded (S335). In this number of times of execution of free game random determination process, in case of FIG. 54 and FIG. 50, the number of times of execution of the free game is randomly determined for the bonus symbol 267 at "6". This random determination of the number of times of execution of the free game is, as described above, executed based on the winning probabilities in "EXTRA" in the bonus game number random determination table 292 (table B).

The main CPU 71 then executes the number of times of execution of free game display process as described above (S336). In the number of times of execution of free game display process, the number of times of execution of the free game awarded as a result of the random determination in S335 is, as shown in (55-2) in FIG. 55, displayed on the front surface of the bonus symbol 267 ("3" is displayed in the present embodiment). Furthermore, the awarded number of times of execution of the free game display window 270 displays the total sum of the numbers of times of execution of the free game awarded in the bonus game process. In the present embodiment, "6" (3+3) is displayed in the display window 270 shown in (55-2) in FIG. 55.

Subsequently, the main CPU 71 updates the number of the bonus symbols 267 stored in the RAM 73 by subtracting "1" therefrom (S337). In the present embodiment, "1" is subtracted from "2" which is the number of the bonus symbols 267 stored in the RAM 73, and the number of the bonus symbols 267 is updated to "1".

Subsequently, the main CPU 71 again determines whether the number of the bonus symbols 267 updated in S337 is larger than "0" (S338). In the present embodiment, because the number of the bonus symbols 267 updated in S337 is "1", the number is determined to be larger than "0" and the process proceeds to S335 (S338: YES).

Subsequently, after the shifting to S335, the main CPU 71 again executes the number of times of execution of free game random determination process for determining the number of times of execution of the free game to be awarded (S335). In this number of times of execution of free game random determination process, in case of FIG. 54 and FIG. 50, the number of times of execution of the free game is randomly determined for the bonus symbol 267 at "10". This random determination of the number of times of execution of the free game is, as described above, executed based on the winning probabilities in "EXTRA" in bonus game number random determination table 292 (table B).

Thereafter, the main CPU 71 executes the number of times of execution of free game display process as described above (S336). In the number of times of execution of free game display process, the number of times of execution of the free game awarded as a result of the random determination in S335 is, as shown in (55-3) in FIG. 55, displayed on the front surface of the bonus symbol 267 ("10" is displayed in the present embodiment). Furthermore, the awarded number of times of execution of the free game display window 270 displays the total sum of the numbers of times of execution of the free game awarded in the bonus game process. In the present embodiment, "16" (3+3+10) is displayed in the display window 270 shown in (55-3) in FIG. 55.

Subsequently, the main CPU 71 updates the number of the bonus symbols 267 stored in the RAM 73 by subtracting "1" therefrom (S337). In the present embodiment, "1" is subtracted from "1" which is the number of the bonus symbols 267 stored in the RAM 73, and the number of the bonus symbols 267 is updated to "0".

Subsequently, the main CPU 71 again determines whether the number of the bonus symbols 267 updated in S337 is larger than "0" (S338). Because in the present embodiment the number of the bonus symbols 267 updated in S337 is "0", the number is determined not to be larger than "0" (S338: NO).

Figure 56:
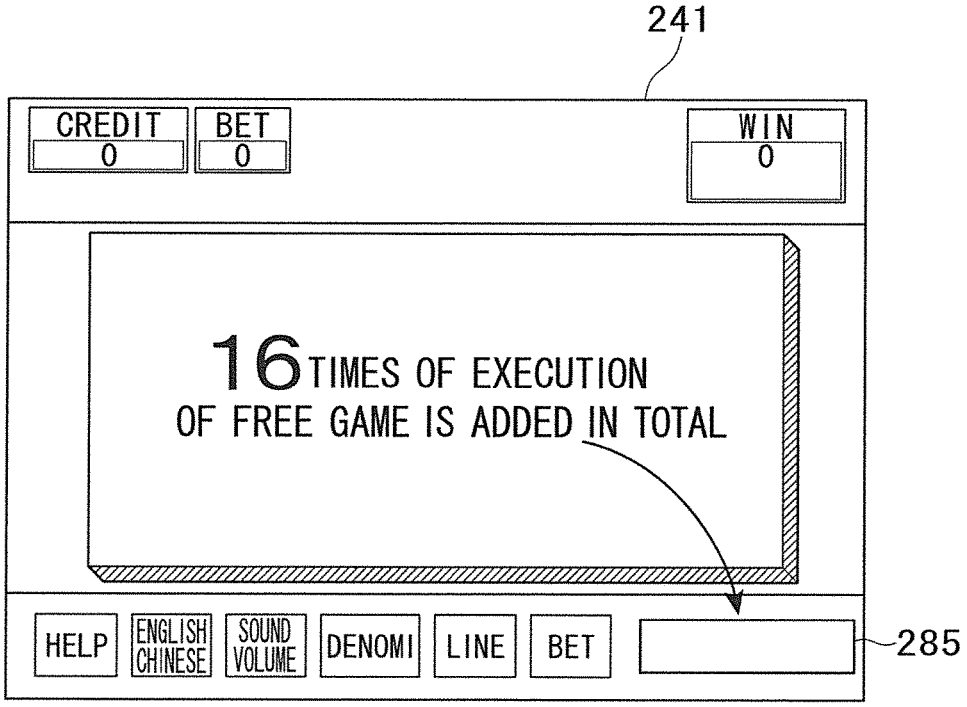
FIG. 56 shows an example of an image displayed on the lower image display panel in the free game addition process of Second Embodiment.

When the number of the bonus symbols 267 updated in S338 is not larger than "0" (S338: NO), as shown in FIG. 56, the total sum of the numbers of times of execution of the free game awarded in the free game addition process is displayed on the front surface of the lower image display panel 141 (S339). In the present embodiment, "16" is displayed on the front surface of the lower image display panel 141 as the total sum of the numbers of times of execution of the free game awarded in the free game addition process. Then "16" which is the total sum of the numbers of times of execution of the free game awarded in the free game addition process is added to the remaining number of times of execution of the free game, and the result of the addition is displayed on the remaining number of times of execution of the free game display window 285 (S340). After S340, the process is terminated.

According to the arrangement above, in the normal game, when a benefit corresponding to a combination of symbols rearranged on the lower image display panel 141 is bonus game trigger, how many bonus symbols 267 are included in the combination of the rearranged symbols is determined. Furthermore, a bonus game number random determination table used for determining the number of times of execution of the free game to be awarded is randomly selected from three bonus game number random determination tables 291, 292, and 293. Then the random determination based on the determined number of bonus symbols 267 and the selected bonus game number random determination table is executed for the number of times corresponding to the determined number of bonus symbols 267, and the number of times of execution of the free game awarded as a result of this random determination is awarded to the player.

Because the random determination of the number of times of execution of the free game is executed for the number of times corresponding to the number of bonus symbols 267 in this manner, the player enjoys the random determination for that number of times.

Furthermore, because the number of times of execution of the free game awarded to the player is determined based on not only the number of bonus symbols 267 in the combination of the symbols achieving the bonus game trigger but also the three bonus game number random determination tables 291, 292, and 293, another condition for determining the number of times of execution of the free game is added. This makes it possible to finely adjust the number of times of execution of the free game to be awarded.

According to the arrangement above, furthermore, because the three bonus game number random determination tables 291, 292, and 293 are different from one another in an expectation value of the number of times of execution of the free game to be awarded, the player enjoys paying attention to results of random determination based on the table selection random determination table 294, because the player is advantageous when the bonus game number random determination table 293 having a high expectation value of the number of times of execution of the free game is selected as a result of random determination based on the table selection random determination table 294.

According to the arrangement above, furthermore, because the selected bonus game number random determination table is notified (see S274), the player is able to know whether the expectation value of the number of times of execution of the free game is high in the selected bonus game number random determination table.

According to the arrangement above, furthermore, because the bonus game number random determination tables 291, 292, and 293 are arranged so that the expectation value of the number of times of execution of the free game varies in accordance with the determined number of the bonus symbols 267 (i.e., in accordance with the level), the player enjoys paying attention to the number of bonus symbols 267 in the rearranged symbols when achieving the bonus game trigger.

According to the arrangement above, furthermore, because the random determination of the total number of times of execution of the free game is executed for the number of times corresponding to the number of bonus symbols 267 in the combination of the rearranged symbols, the player enjoys the random determination for that number of times. That is to say, the more the number of the bonus symbols 267 is, the more the number of times of execution of the free game tends to be.

In the meanwhile, as described above, the expectation value of the number of times of execution of the free game is arranged to increase as the number of the bonus symbols 267 decreases.

For this reason, when the number of the bonus symbols 267 is small, the expectation value of the number of times of execution of the free game as a result of the random determination once is high, but the number of times of the random determination is small. In the meanwhile, when the number of the bonus symbols 267 is large, while the expectation value of the number of times of execution of the free game as a result of the random determination once is low, the number of times of the random determination is large.

This restrains the final number of times of execution of the free game awarded based on the number of the bonus symbols 267 not to significantly vary between different conditions.

According to the arrangement above, furthermore, the expectation value of the number of times of execution of the free game is arranged to be highest when the determined number of the bonus symbols 267 is 3 which is the minimum or 20 which is the maximum. With this, the player becomes interested in how many bonus symbols 267 are included in a combination of rearranged symbols.

According to the arrangement above, furthermore, the random determination is performed for the number of times corresponding to the number of the bonus symbols 267 in the combination of the symbols with which the bonus game trigger is achieved, based on the bonus game number random determination tables 291, 292, and 293 based on which the number of times of execution of the free game to be awarded is determined. Each time the random determination is performed, which bonus game number random determination table is used is randomly determined based on the table selection random determination table 294.

(Other Arrangements: Appeal Rewriting Effect)

While in First Embodiment the symbol columns each constituted by 22 symbols corresponding to the code numbers "00" to "21" are provided for the first video reel 151, the second video reel 152, the third video reel 153, the fourth video reel 154, and the fifth video reel 155, the number of the symbols may be different between video reels as shown in FIG. 57. More specifically, as shown in FIG. 57, the first video reel 151 is constituted by 100 symbols corresponding to code numbers "0" to "99", the second video reel 152 is constituted by 132 symbols corresponding to code numbers "0" to "131", the third video reel 153 is constituted by 134 symbols corresponding to code numbers "0" to "133", the fourth video reel 154 is constituted by 134 symbols corresponding to code numbers "0" to "133", and the fifth video reel 155 is constituted by 131 symbols corresponding to code numbers "0" to "130". Each video reel 151 shown in FIG. 57 is used in the normal game.

As shown in FIG. 57, the types of the symbols arranged on the video reels 151 to 155 are "RED", "BLUE", "PINK", "GREEN", "BLACK", "WILD", "FEATURE", "ACE", "JACK", "QUEEN", "KING", and "NINE".

Alternatively, the video reels 151 to 155 shown in FIG. 57 are used in the normal game whereas the video reels 151 to 155 shown in FIG. 58 are used in the free game. The video reels 151 to 155 shown in FIG. 58 are arranged so that the number of the symbols on each of the video reels 151 to 155 is larger than the number in the video reels 151 to 155 used in the normal game and shown in FIG. 57. In other words, the length of each video reel in the free game is arranged to be longer than the length in the normal game. The added symbols (top symbols) are arranged to be advantageous for the player (e.g., symbols with high payouts are provided or symbols of the same type are successively provided). As such, to appeal for the player that the player is advantageous in the free game because the length of each video reel is longer than in the normal game, it is necessary to cause the player to pay attention to this advantage at the start of the scroll of the video reels 151 to 155 at the start of the free game.

One way of achieving this is to adjust the positions of the video reels 151 to 155 such that the latter ones of the code numbers of each the video reels 151 to 155 are assigned to the symbols (top symbols) added as compared to the normal game, in order to show the added symbols (top symbols) at the start of the scroll of the video reels 151 to 155 at the start of the free game.

Figure 61:
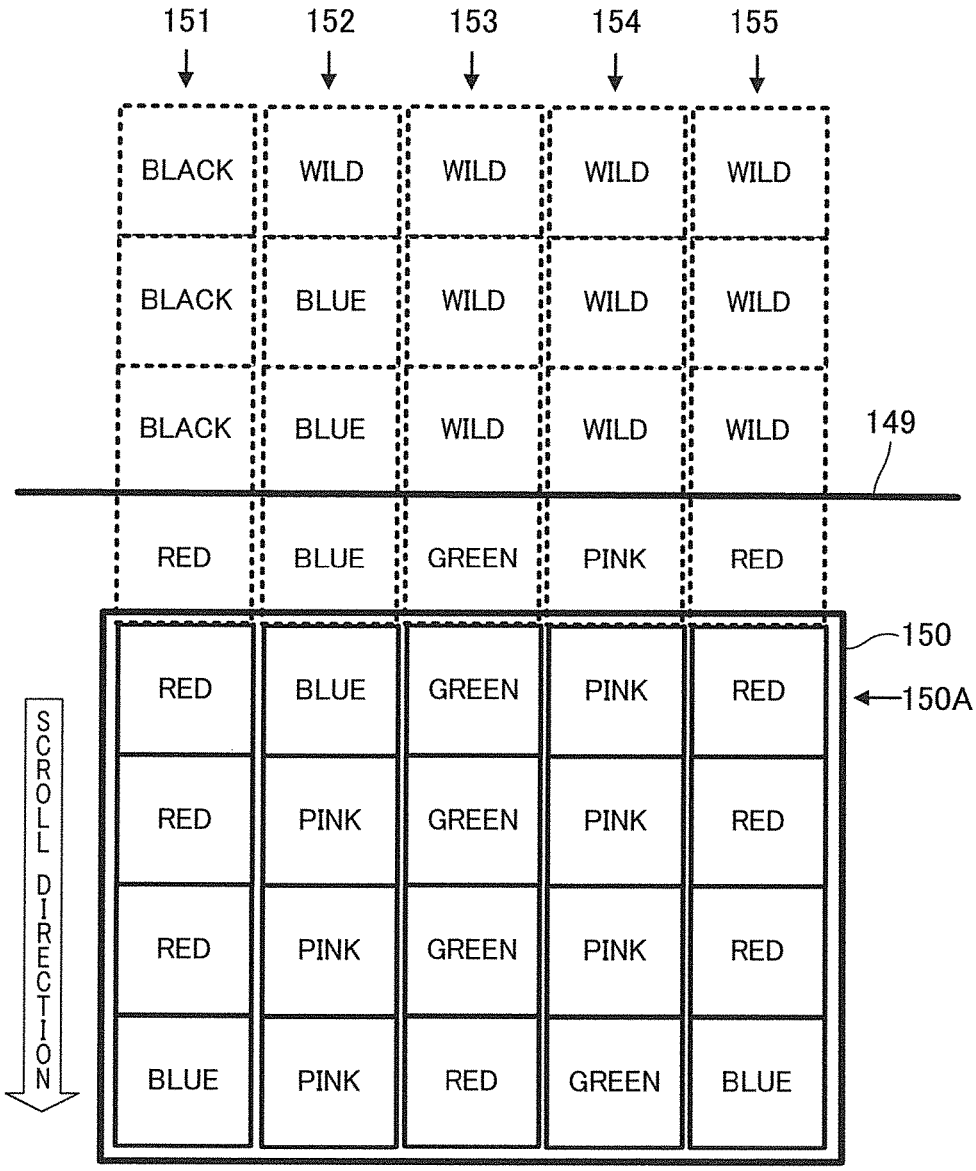
FIG. 61 is an explanatory diagram showing an appeal rewriting effect.

More specifically, as shown in FIG. 61, a rewriting point 149 is provided at a position which is two-level higher than the symbols of the video reels 151 to 155 displayed in the uppermost stage 150A of the display window 150. Furthermore, before the start of the free game, the last ones of the symbols arranged on the video reels 151 to 155 are provided on this rewriting point 149. For example, the "BLACK" symbol corresponding to the code number 109 of the first video reel 151 is provided on the rewriting point 149, the "WILD" symbol corresponding to the code number 141 of the second video reel 152 is provided on the rewriting point 149, the "WILD" symbol corresponding to the code number 143 of the third video reel 153 is provided on the rewriting point 149, the "WILD" symbol corresponding to the code number 143 of the fourth video reel 154 is provided on the rewriting point 149, and the "BLACK" symbol corresponding to the code number 140 of the fifth video reel 155 is provided on the rewriting point 149 (see FIG. 59).

With this arrangement, the last ones of the symbols arranged on the video reels 151 to 155 are provided on the rewriting point 149. However, this arrangement is disadvantageous in terms of the effect because the same symbols are arranged on the rewriting point 149 each time the free game is executed.

In consideration of the disadvantage, which symbols are provided on the rewriting point 149 is randomly determined. More specifically, which symbol is provided on the rewriting point 149 is randomly determined for each of the video reels 151 to 155 with reference to a rewriting position random determination table 389 shown in FIG. 60. For example, when "From 0" is randomly selected for the first video reel 151, the "RED" symbol corresponding to the code number 0 is provided on the rewriting point 149 as indicated by the first video reel 151 shown in FIG. 61. When "From 2" is randomly selected for the second video reel 152, the "BLUE" symbol corresponding to the code number 2 is provided on the rewriting point 149 as indicated by the second video reel 152 shown in FIG. 61. When "From 0" is randomly selected for the third video reel 153, the "GREEN" symbol corresponding to the code number 0 is provided on the rewriting point 149 as indicated by the third video reel 153 shown in FIG. 61. When "From 0" is randomly selected for the fourth video reel 154, the "PINK" symbol corresponding to the code number 0 is provided on the rewriting point 149 as indicated by the fourth video reel 154 shown in FIG. 61. When "From 4" is randomly selected for the fifth video reel 155, the "RED" symbol corresponding to the code number 4 is provided on the rewriting point 149 as indicated by the fifth video reel 155 shown in FIG. 61. When "No Rewriting" is randomly selected based on the rewriting position random determination table 389, the arrangement of the symbols is unchanged.

After the random determination above, the last ones of the symbols arranged on the video reels 151 to 155 are provided in the vicinity of the rewriting point 149. With this, the added symbols (top symbols) appear conspicuous for the player immediately after the start of the scroll of the video reels 151 to 155 at the start of the free game.

The above embodiment thus described solely serves as a specific example of the present invention, and the present invention is not limited to such an example. Specific structures of various means and the like may be suitably designed or modified. Further, the effects of the present invention described in the above embodiment are not more than examples of most preferable effects achievable by the present invention. The effects of the present invention are not limited to those described in the embodiments described above.

For example, while the descriptions above deal with one slot machine 10, the present invention may be employed in a game system including a plurality of slot machines 10 and an external controller connected with the slot machines 10 via a communication line.

The external controller controls the plurality of slot machines 10. For example, the external controller is a hall server installed in a gaming facility having the slot machines 10. Each of the slot machines 10 has a unique identification number, and the external controller identifies which one of the slot machines 10 transmitted data, by referring to the identification number. Further, when transmitting data from the external controller to any of the slot machines 10, the identification number is used for designating the transmission destination.

It is to be noted that the gaming system may be constructed within a single gaming facility where various games can be performed, such as a casino, or may be constructed among a plurality of gaming facilities. Further, when the gaming system is constructed in a single gaming facility, the gaming system may be constructed in each floor or section of the gaming facility. The communication line may be a wired or wireless line, and can adopt a dedicated line, an exchange line or the like.

In addition to the above, when the number of symbols on each of the video reels 151 to 155 which are used in the free game and shown in FIG. 58 is arranged to be larger than the number of symbols on each of the video reels 151 to 155 which are used in the normal game and shown in FIG. 57, an effect of notifying the types and number of the added symbols may be executed when the normal game is shifted to the free game (top symbol addition effect).

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process executed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A gaming machine running a normal game and a bonus game developing from the normal game, the gaming machine comprising:

a symbol display device configured to display a result of a game by rearranging symbols;

a value-input mechanism by which a physical monetary value to be bet can be added to the gaming machine;

a validator; an award payout mechanism that pays out gaming media;

a storage device configured to store a bonus game number random determination table in which the number of times of execution of the bonus game is associated with a random number; and a controller which, via the validator, identifies legitimacy of gaming media that has been added to the gaming machine and which establishes a credit balance for a player based at least in part on gaming media that has been added to the gaming machine, the controller being programmed to execute, as a result of the player having bet a value based on the credit balance, the processes of:

(1A) as the normal game, randomly selecting the symbols to be rearranged on the symbol display device;

(1B) rearranging the symbols selected in the process (1A) on the symbol display device and awarding a benefit in accordance with a combination of the rearranged symbols;

(1C) when the benefit awarded in the process (1B) is a right to run the bonus game, counting how many predetermined bonus symbols are included in the combination of the symbols with which the right to run the bonus game is awarded;

(1D) performing random determination based on the bonus game number random determination table for the number of times corresponding to the number of the predetermined bonus symbol counted in the process (1C); wherein a bonus game number is randomly determined by the random determination for each of the predetermined bonus symbols and a total number is determined as a total sum of the bonus game numbers determined for the number of times corresponding to the number of the predetermined bonus symbols;

(1E) as the number of times of execution of the bonus game, awarding the total number determined in the process (1D);

(1F) as options, presenting the execution of the bonus game for the number of times awarded in the process (1E) and the execution of the one-time game with which the benefit is awarded as a result of random determination once; and (1G) executing the bonus game for the awarded number of times when the execution of the bonus game is chosen in the process (1F), or executing the one-time game when the execution of the one-time game is chosen in the process (1F), wherein an expectation value of the benefit awarded in the one-time game is equal to a value calculated by multiplying an expectation value of a benefit awarded as a result of running the bonus game once by the awarded number of times of execution of the bonus game, wherein the credit balance is updated based on any awards awarded in the bonus game.

2. The gaming machine according to claim 1, wherein, the bonus game number random determination table used in the process (1D) defines that a winning probability of the number of times of execution of the bonus game varies in accordance with the number of the bonus symbol counted in the (1C).

3. The gaming machine according to claim 1, wherein, in the process (1D), a result of the random determination based on the bonus game number random determination table is notified each time the random determination is performed.

4. The gaming machine according to claim 1, wherein, in the process (1F), an estimated termination time which indicates when the execution of the free game for the awarded number of times ends is notified.

5. The gaming machine according to claim 1, wherein, the symbol display device displays the result of the game by displaying the symbols on reels and rearranging these reels, in at least one of the normal game and the bonus game, a random symbol is arranged on at least one of the reels, and each time the normal game or the bonus game starts, a symbol displayed in the random symbol is randomly determined.

6. A method of controlling a gaming machine running a normal game and a bonus game developing from the normal game, the gaming machine including:

a symbol display device configured to display a result of a game by rearranging symbols;

a value-input mechanism by which a physical monetary value to be bet can be added to the gaming machine;

a validator;

an award payout mechanism that pays out gaming media;

a storage device configured to store a bonus game number random determination table in which the number of times of execution of the bonus game is associated with a random number; and a controller which, via the validator, identifies legitimacy of gaming media that has been added to the gaming machine and which establishes a credit balance for a player based at least in part on gaming media that has been added to the gaming machine, the method comprising the steps of:

under control of the controller, as a result of the player having bet a value based on the credit balance, (2A) as a normal game, randomly selecting the symbols which are to be rearranged on the symbol display device;

(2B) rearranging the symbols selected in the step (2A) on the display device and awarding a benefit in accordance with a combination of the rearranged symbols;

(2C) when the benefit awarded in the step (2B) is a right to run the bonus game, counting how many predetermined bonus symbol is included in the combination of the symbols with which the right to run the bonus game is awarded;

(2D) performing random determination based on the bonus game number random determination table for the number of times corresponding to the number of the predetermined bonus symbol counted in the step (2C); wherein a bonus game is randomly determined by the random determination for each of the predetermined bonus symbols and a total number is determined as a total sum of the bonus game numbers determined for the number of times corresponding to the number of the predetermined bonus symbols;

(2E); as the number of times of execution of the bonus game, awarding the total number determined in the step (2D);

(2F) as options, presenting the execution of the bonus game for the number of times awarded in the process (2E) and the execution of a one-time game with which the benefit is awarded as a result of random determination once; and (2G) executing the bonus games for the awarded number of times when the execution of the bonus game is chosen in the process (2F), or executing the one-time game when the execution of the one-time game is chosen in the process (2F), wherein an expectation value of the benefit awarded in the one-time game is equal to a value calculated by multiplying an expectation value of a benefit awarded as a result of running the bonus game once by the awarded number of times of execution of the bonus game, wherein the credit balance is updated based on any awards awarded in the bonus game.

7. A gaming machine awarding a benefit based on at least a result of a normal game and a result of a bonus game developing from the normal game, the gaming machine comprising:

a value-input mechanism by which a physical monetary value to be bet can be added to the gaming machine;

a validator;

an award payout mechanism that pays out gaming media;

a symbol display device configured to display a result of a game by rearranging symbols; and a controller which, via the validator, identifies legitimacy of gaming media that has been added to the gaming machine and which establishes a credit balance for a player based at least in part on gaming media that has been added to the gaming machine, the controller being programmed to execute, as a result of the prayer having bet a value based on the credit balance, the processes of:

(3A) as the normal game, randomly selecting the symbols to be rearranged on the symbol display device; (3B) rearranging the symbols selected in the process (3A) on the display device and awarding a benefit based on a combination of the rearranged symbols;

(3C) when the benefit awarded in the process (3B) is a right to run the bonus game for 100 times or more, as options, presenting a right for choosing any one of the execution of the bonus game for the awarded number of times and the execution of a one-time game with which the benefit is awarded as a result of random determination once; and (3D) executing the bonus game for the awarded number of times when the execution of the bonus game is chosen in the process (3C), or executing the one-time game when the execution of the one-time game is chosen, wherein an expectation value of a benefit awarded in the one-time game is equal to a value calculated by multiplying an expectation value of a benefit awarded as a result of running the bonus game once by the awarded number of times of execution of the bonus game, wherein the credit balance is updated based on any awards awarded in the bonus game.

8. The gaming machine according to claim 7, wherein, in the process (3C), an estimated termination time which indicates when the execution of the free game for the awarded number of times ends is notified.

9. The gaming machine according to claim 7, wherein, in the process (3C), only when the benefit awarded in the process (3B) is the right to run the bonus game for 100 times or more, presenting the execution of the bonus game and the execution of the one-time game as the options.

10. A gaming machine running a normal game and a bonus game developing from the normal game, the gaming machine comprising:

a symbol display device configured to display a result of a game by rearranging symbols;

a value-input mechanism by which a physical monetary value to be bet can be added to the gaming machine;

a validator; an award payout mechanism that pays out gaming media;

a storage device configured to store a plurality of bonus game number random determination tables in each of which an awarded number of times of execution of the bonus game is associated with the number of a predetermined bonus symbol in a combination of symbols with which the right to run the bonus game is awarded and a random number and a table selection random determination table in which the bonus game number random determination tables are associated with random numbers; and a controller which, via the validator, identifies legitimacy of gaming media that has been added to the gaming machine and which establishes a credit balance for a player based at least in part on gaming media that has been added to the gaming machine, the controller being programmed to execute, as a result of the player having bet a value based on the credit balance, the processes of:

(4A) as the normal game, randomly selecting the symbols which are to be rearranged on the symbol display device;

(4B) rearranging the symbols selected in the process (4A) on the display device and awarding a benefit in accordance with a combination of the rearranged symbols;

(4C) when the benefit awarded in the process (4B) is a right to run the bonus game, counting how many predetermined bonus symbols are included in the combination of the symbols with which the right to run the bonus game is awarded;

(4D) performing random determination based on the table selection random determination table to select one of the bonus game number random determination tables based on which the number of execution of the bonus game is determined;

(4E) based on the number of the predetermined bonus symbol determined in the process (4C) and said one of the bonus game number random determination tables selected in the process (4D), performing random determination for the number of times corresponding to the number of the predetermined bonus symbols determined in the process (4C), wherein a bonus game number is randomly determined by the random determination for each of the predetermined bonus symbols and a total number is determined as a total sum of the bonus game numbers determined for the number of times corresponding to the number of the predetermined bonus symbols;

(4F) as the number of times of execution of the bonus game, awarding the total number determined in the process (4E);

(4G) as options, presenting the execution of the bonus game for the number of times awarded in the process (4F) and the execution of a one-time game with which the benefit is awarded as a result of random determination once; and (4H) executing the bonus game for the awarded number of times when the execution of the bonus game is chosen in the process (4G), or executing the one-time game when the execution of the one-time game is chosen in the process (4G), wherein an expectation value of the benefit awarded in the one-time game is equal to a value calculated by multiplying an expectation value of a benefit awarded as a result of running the bonus game once by the awarded number of times of execution of the bonus game, wherein the credit balance is updated based on any awards awarded in the bonus game.

11. The gaming machine according to claim 10, wherein, the bonus game number random determination tables are different from one another in an expectation value of the number of execution of the bonus game to be awarded.

12. The gaming machine according to claim 10, wherein, the controller is programmed to further execute the process of notifying which one of the bonus game number random determination tables is selected in the process (4D).

13. The gaming machine according to claim 10, wherein, the bonus game number random determination tables define that the expectation value of the number of execution of the bonus game to be awarded varies in accordance with the number of the bonus symbols counted in the process (4C).

14. The gaming machine according to claim 13, wherein, the expectation value of the number of execution of the bonus game to be awarded is highest when the number of the bonus symbols counted in the process (4C) is minimum or maximum.

15. The gaming machine according to claim 10, wherein, the random determination based on the table selection random determination table in the process (4D) is executed each time the random determination based on the bonus game number random determination tables is performed.

16. The gaming machine running a normal game and a bonus game developing from the normal game, the gaming machine comprising:

a symbol display device configured to display a result of a game by rearranging symbols;

a value-input mechanism by which a physical monetary value to be bet can be added to the gaming machine;

a validator;

an award payout mechanism that pays out gaming media;

a storage device configured to store a plurality of bonus game number random determination tables in each of which an awarded number of times of execution of the bonus game is associated with the number of predetermined bonus symbol in a combination of symbols with which the right to run the bonus game is awarded and a random number and a table selection random determination table in which the bonus game number random determination tables are associated with random numbers; and a controller which, via the validator, identifies legitimacy of gaming media that has been added to the gaming machine and which establishes a credit balance for a player based at least in part on gaming media that has been added to the gaming machine, the controller being programmed to execute, as a result of the player having bet a value based on the credit balance, the process of:

(4A) as the normal game, randomly selecting the symbols to be arranged on the symbol display device;

(4B) rearranging the symbols selected in the process (4A) on the display device and awarding a benefit in accordance with a combination of the rearranged symbols;

(4C) when the benefit awarded in the process (4B) is a right to run the bonus game, counting how many predetermined bonus symbols are included in the combination of the symbols with which the right to run the bonus game is awarded;

(4D) performing random determination based on the table selection random determination table to select one of the bonus game number random determination tables based on which the number of execution of the bonus game determined;

(4E) based on the number of the predetermined bonus symbols determined in the process (4C) and said one of the bonus game number random determination tables selected in the process (4D), performing random determination for the number of times corresponding to the number of the predetermined bonus symbols determined in the process (4C), wherein a bonus game number is randomly determined by the random determination for each of the predetermined bonus symbols and a total number is determined as a total sum of the bonus game numbers determined for the number of times corresponding to the number of the predetermined bonus symbols; and (4F) as the number of times of execution of the bonus game, awarding the total number determined in the process (4E), wherein, the expectation value of the number of execution of the bonus game to be awarded increases as the number of the bonus symbols counted in the process (4C) decreases, wherein the credit balance is updated based on any awards in the bonus game.

17. A method of controlling a gaming machine running a normal game and a bonus game developing from the normal game, the gaming machine including:

a symbol display device configured to display a result of a game by rearranging symbols;

a value-input mechanism by which a physical monetary value to be bet can be added to the gaming machine;

a validator;

an award payout mechanism that pays out gaming media;

a storage device configured to store a plurality of bonus game number random determination tables in each of which an awarded number of times of execution of the bonus game is associated with the number of a predetermined bonus symbol in a combination of symbols with which the right to run the bonus game is awarded and a random number and a table selection random determination table in which the bonus game number random determination tables are associated with random numbers; and a controller which, via the validator, identifies legitimacy of gaming media that has been added to the gaming machine and which establishes a credit balance for a player based at least in part on gaming media that has been added to the gaming machine, the method comprising the steps of:

under control of the controller, as a result of the player having bet a value based on the credit balance, (5A) as the normal game, randomly selecting the symbols to be rearranged on the symbol display device;

(5B) rearranging the symbols selected in the step (5A) on the display device and awarding a benefit in accordance with a combination of the rearranged symbols;

(5C) when the benefit awarded in the step (5B) is a right to run the bonus game, counting how many predetermined bonus symbols are included in the combination of the symbols with which the right to run the bonus game is awarded;

(5D) performing random determination based on the table selection random determination table to select one of the bonus game number random determination tables based on which the number of execution of the bonus game is determined;

(5E) based on the number of the predetermined bonus symbol determined in the step (5C) and said one of the bonus game number random determination tables selected in the step (5D), performing random determination for the number of times corresponding to the number of the predetermined bonus symbol determined in the step (5C), wherein a bonus game number is randomly determined by the random determination for each of the predetermined bonus symbols and a total number is determined as a total sum of the bonus game numbers determined for the number of times corresponding to the number of the predetermined bonus symbols;

(5F) as the number of times of execution of the bonus game, awarding the total number determined in the step (5E);

(5G) as options, presenting the execution of the bonus game for the number of times awarded in the process (5F) and the execution of a one-time game with which the benefit is awarded as a result of random determination once; and (5H) executing the bonus game for the awarded number of times when the execution of the bonus game is chosen in the process (5G), or executing the one-time game when the execution of the one-time game is chosen in the process (5G), wherein an expectation value of the benefit awarded in the one-time game is equal to a value calculated by the multiplying an expectation value of a benefit awarded as a result of running the bonus game once by the awarded number of times of execution of the bonus game, wherein the credit balance is updated based on any award awarded in the bonus game.

* * * * *